US007341201B2

(12) United States Patent
Stanimirovic

(10) Patent No.: US 7,341,201 B2
(45) Date of Patent: Mar. 11, 2008

(54) FULLY ARTICULATED AND COMPREHENSIVE AIR AND FLUID DISTRIBUTION, METERING, AND CONTROL METHOD AND APPARATUS FOR PRIMARY MOVERS, HEAT EXCHANGERS, AND TERMINAL FLOW DEVICES

(76) Inventor: Daniel Stanimirovic, 2500 Parkview Dr. /#710, Hallandale, FL (US) 33009

( * ) Notice: Subject to any disclaimer, the term of this patent is extended or adjusted under 35 U.S.C. 154(b) by 393 days.

(21) Appl. No.: 11/120,292

(22) Filed: May 3, 2005

(65) Prior Publication Data

US 2005/0258259 A1 Nov. 24, 2005

(51) Int. Cl.
*F24F 7/00* (2006.01)
*F25D 17/04* (2006.01)

(52) U.S. Cl. ..... 236/49.1; 236/49.3; 236/94; 62/186

(58) Field of Classification Search ..... 236/49.1, 236/49.3, 94; 62/186
See application file for complete search history.

(56) References Cited

U.S. PATENT DOCUMENTS 5,579,993 A * 12/1996 Ahmed et al. ..... 236/49.3
7,017,827 B2 * 3/2006 Shah et al. ..... 236/1 B

* cited by examiner

*Primary Examiner*—Marc Norman

(57) ABSTRACT

The described method and apparatus pertains namely to the HVAC (Heating, Ventilating, and Air Conditioning) industry, though its many functions extend into any and all forms of air-fluid movement, metering, distribution, and containment. Essentially, the scope of operation of the method and apparatus encompasses all forms of scientific and engineering measurement dealing with fluid dynamics, fluid statics, fluid mechanics, thermal dynamics, and mechanical engineering as they pertain to precise, articulated control of air-fluid distribution and delivery. The described method and apparatus offers complete, comprehensive, and correct utilization of air-fluid movers and terminal devices under unique sensor logic control, from initial lab testing stages through to equipment cataloguing, selection, design and construction of any and all air-fluid distribution systems in entirety, whereas previously there was no such cohesive, total and terminal method of control for these systems or their components.

7 Claims, 35 Drawing Sheets

TYPICAL WIDE OPEN CURVE FOR AN FC FAN

WIDE OPEN AND SYSTEM CURVES JUXTAPOSED
FIG. 7
KNOWN PRIME MOVER WOC
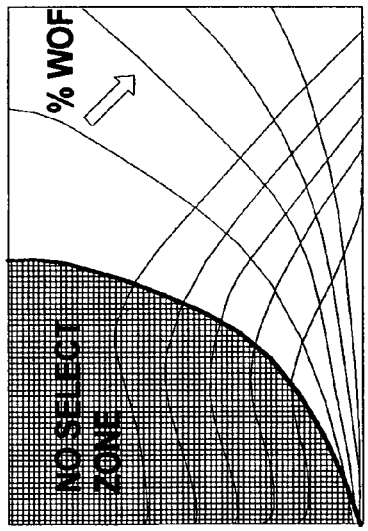
UNKNOWN TOTAL SYSTEM ATTACHED
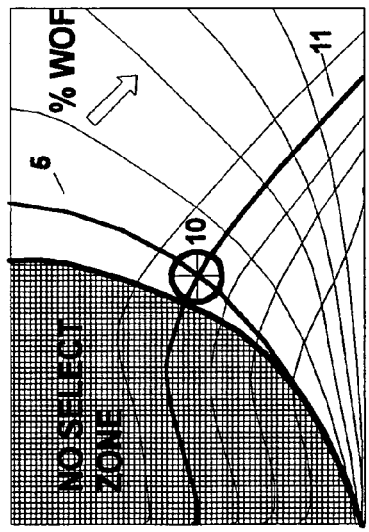
FIG. 7A
TERMINAL OR IN-LINE DEVICE WOC
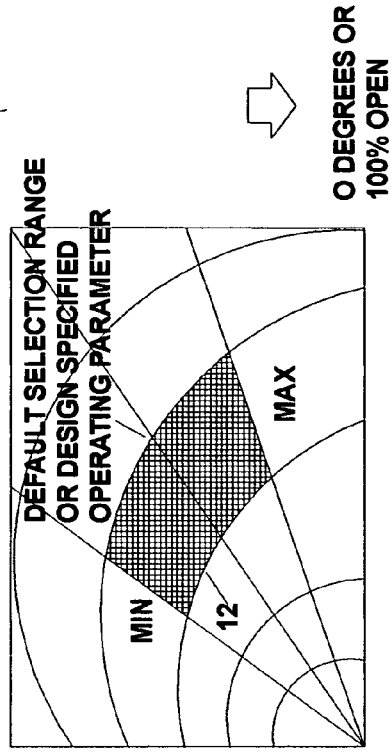
UNKNOWN SUB-SYSTEM ATTACHED
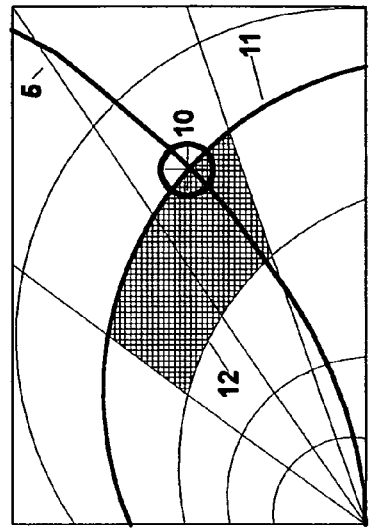

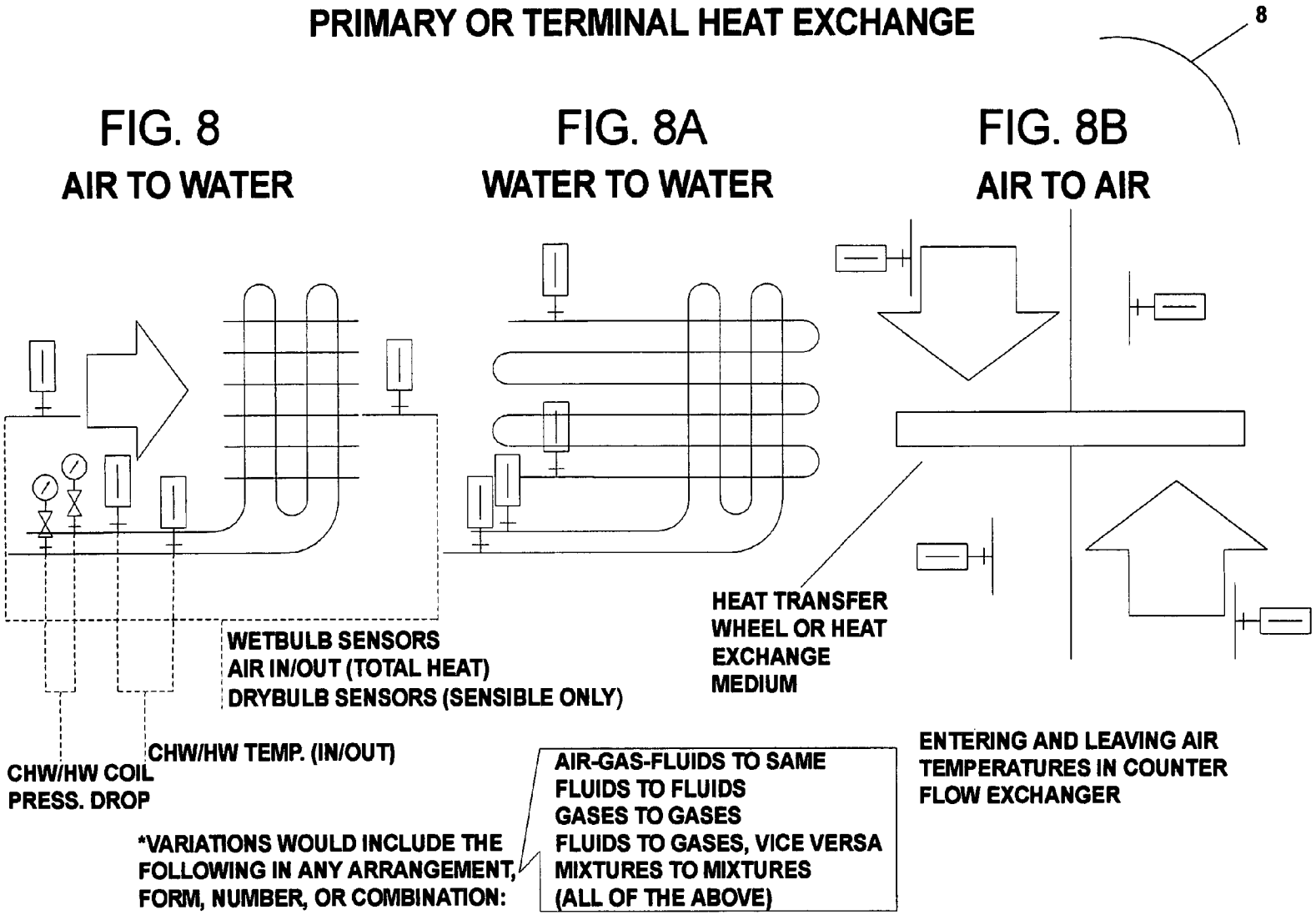
8
PRIMARY OR TERMINAL HEAT EXCHANGE
FIG. 8
AIR TO WATER
FIG. 8A
WATER TO WATER
FIG. 8B
AIR TO AIR
HEAT TRANSFER WHEEL OR HEAT EXCHANGE MEDIUM
ENTERING AND LEAVING AIR TEMPERATURES IN COUNTER FLOW EXCHANGER
AIR-GAS-FLUIDS TO SAME
FLUIDS TO FLUIDS
GASES TO GASES
FLUIDS TO GASES, VICE VERSA
MIXTURES TO MIXTURES
(ALL OF THE ABOVE)
WETBULB SENSORS
AIR IN/OUT (TOTAL HEAT)
DRYBULB SENSORS (SENSIBLE ONLY)
CHW/HW TEMP. (IN/OUT)
CHW/HW COIL PRESS. DROP
*VARIATIONS WOULD INCLUDE THE FOLLOWING IN ANY ARRANGEMENT, FORM, NUMBER, OR COMBINATION:

MAIN PANEL DISPLAY

*TOTAL STATIC PRESSURE AS WITH TRADITIONAL PERFORMANCE CURVES, WHERE TP=SP
OP - OPERATING POINT (CENTER)

*TOTAL STATIC PRESSURE AS WITH TRADITIONAL PERFORMANCE CURVES, WHERE TP=SP

OP - OPERATING POINT (CENTER)

FIG. 10 3-PART SYSTEM CURVES VIEWED INDEPENDENTLY
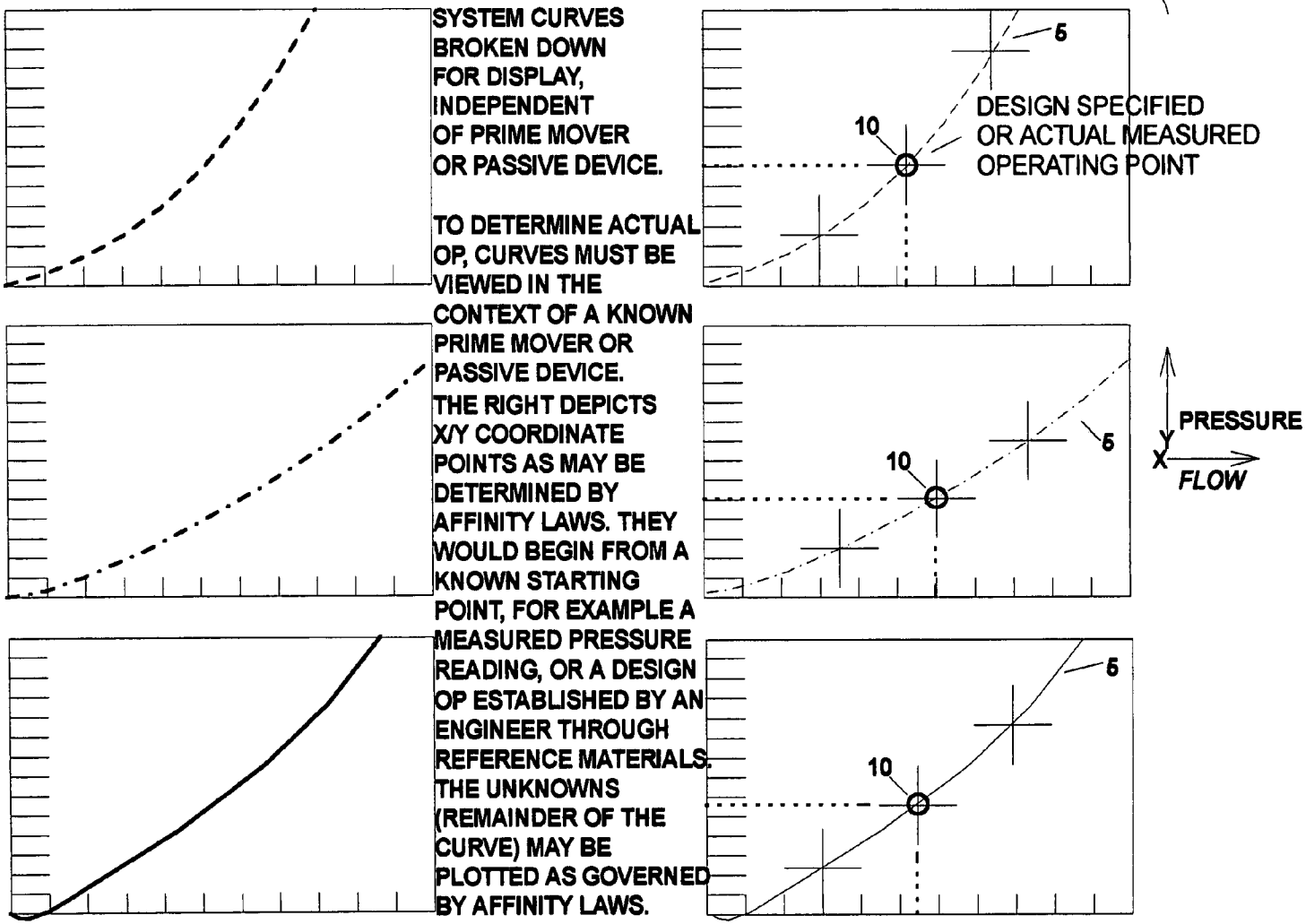

CURVE RIDING AND OP DEVIATION
6

5
10
11
PRIME MOVER CHANGES
ROTATIONAL SPEED
SECONDARY MOVER
SERIES OR PARALLEL OPERATION 5
10
11
SYSTEM CHANGES
TP
SP
Vp

FIG. 13 SENSOR LOGIC
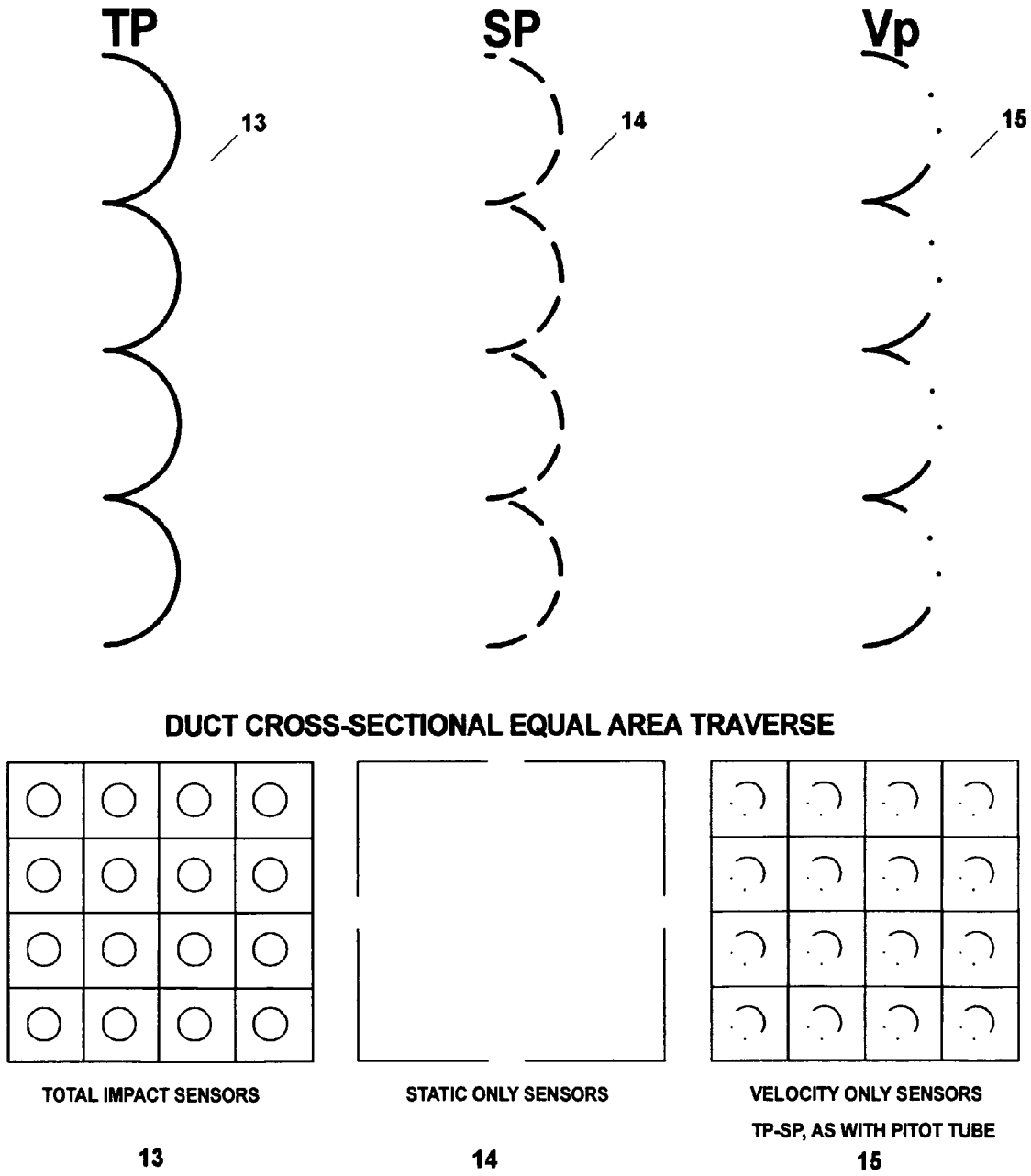

PRIME MOVER SENSOR LOGIC

1

MOVER SENSOR LOGIC IN SERIES OR PARALLEL OPERATION

ONE OR MORE PRIMARY MOVERS IN SERIES OR PARALLEL AUGMENT EITHER SP OR Vp, RESPECTIVELY, AS SHOWN.

FIG. 15 TERMINAL DEVICE SENSOR LOGIC
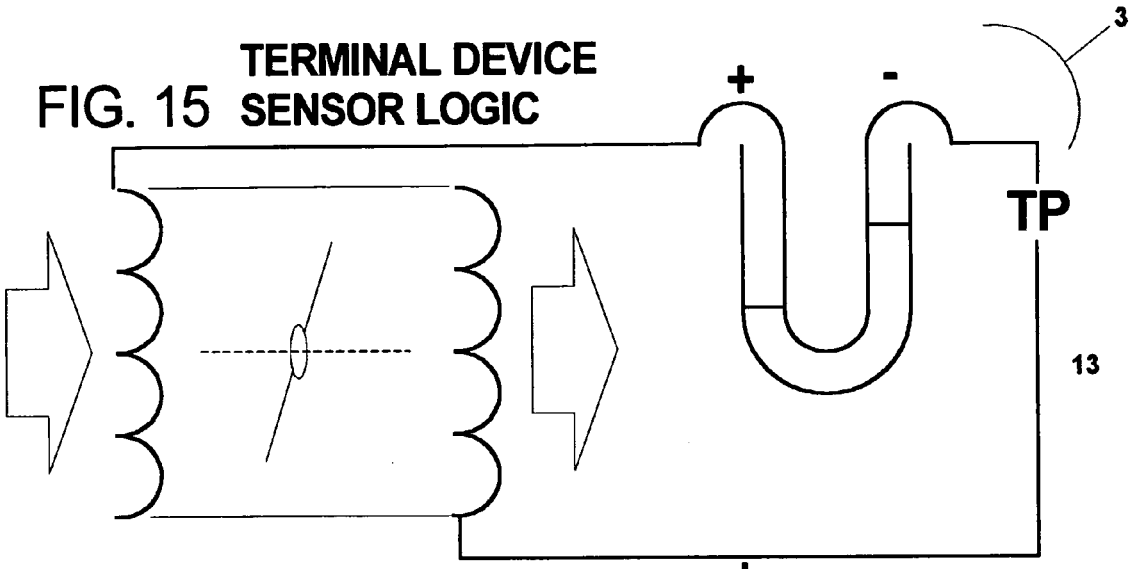
FIG. 15A
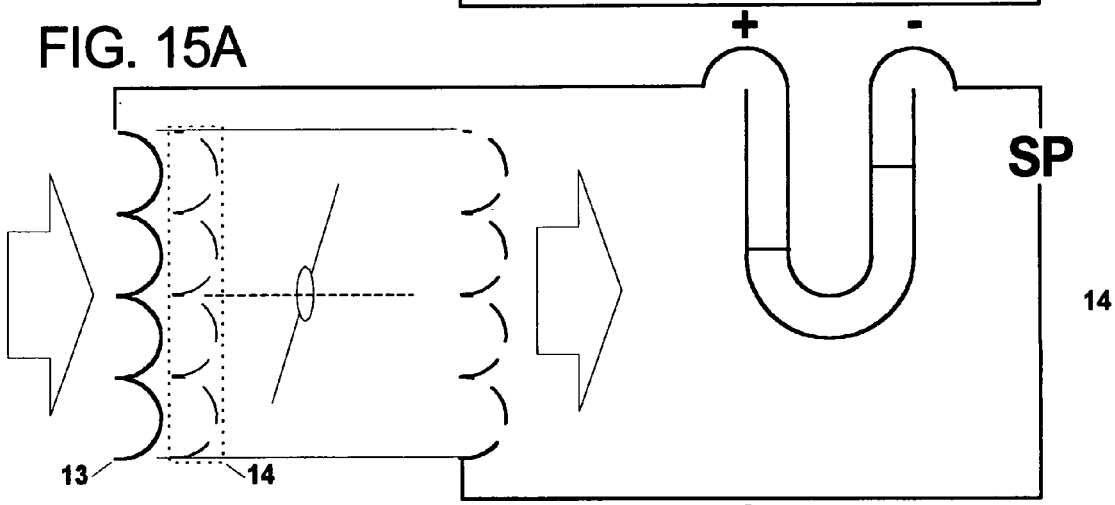
FIG. 15B
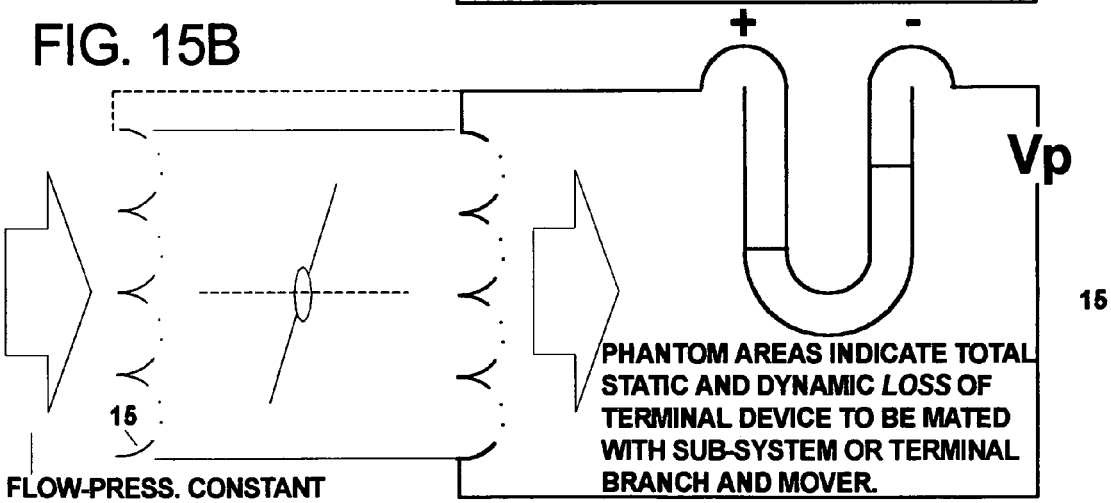

TERMINAL DEVICE SENSOR LOGIC WITH SECONDARY MOVER

SERIES OPERATION

ONE OR MORE SECONDARY MOVERS IN SERIES OR PARALLEL AUGMENT EITHER SP OR Vp, RESPECTIVELY, AS SHOWN.

PARALLEL OPERATION

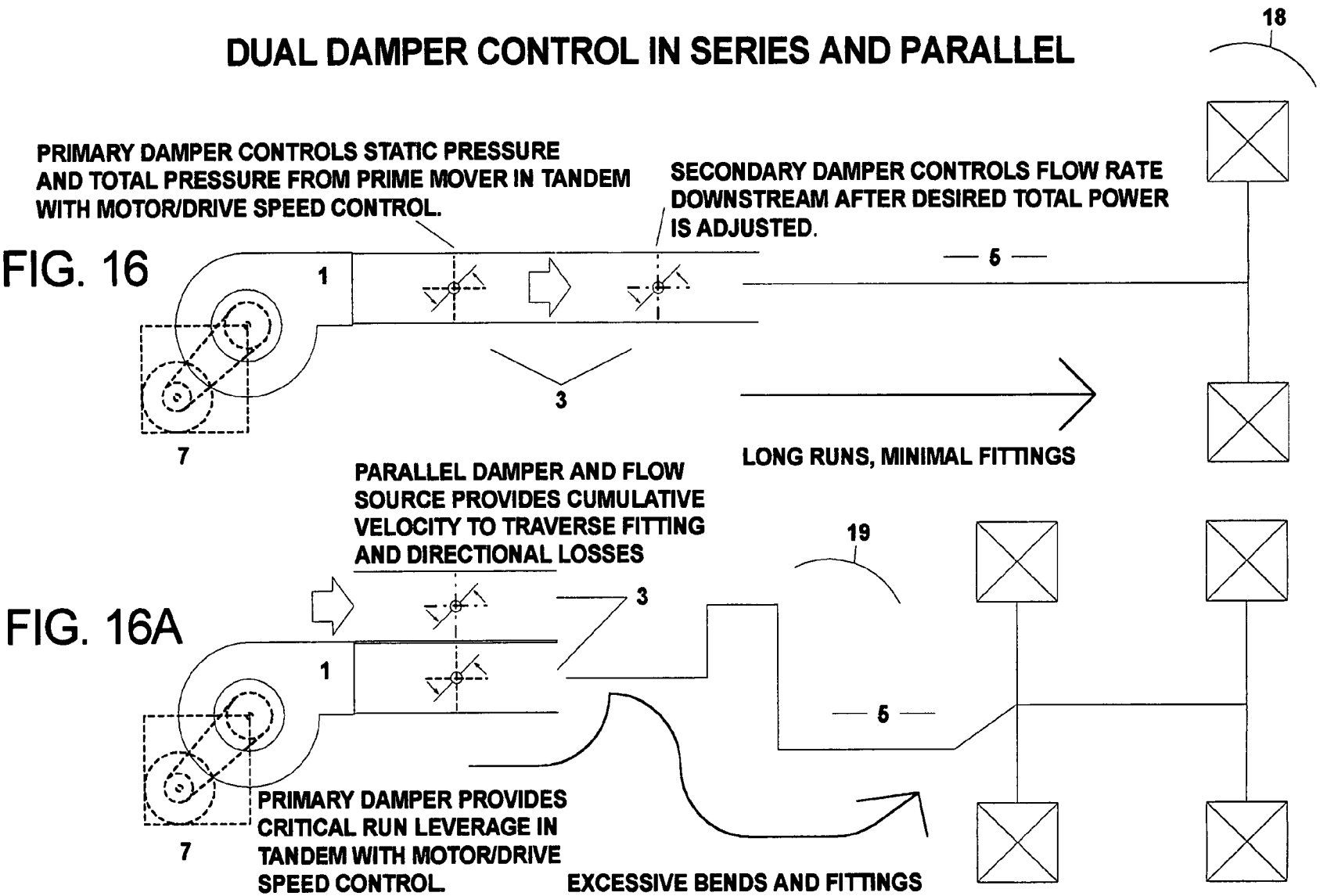
DUAL DAMPER CONTROL IN SERIES AND PARALLEL
18
PRIMARY DAMPER CONTROLS STATIC PRESSURE AND TOTAL PRESSURE FROM PRIME MOVER IN TANDEM WITH MOTOR/DRIVE SPEED CONTROL.
SECONDARY DAMPER CONTROLS FLOW RATE DOWNSTREAM AFTER DESIRED TOTAL POWER IS ADJUSTED.
5
3
1
7
LONG RUNS, MINIMAL FITTINGS
FIG. 16
19
PARALLEL DAMPER AND FLOW SOURCE PROVIDES CUMULATIVE VELOCITY TO TRAVERSE FITTING AND DIRECTIONAL LOSSES
PRIMARY DAMPER PROVIDES CRITICAL RUN LEVERAGE IN TANDEM WITH MOTOR/DRIVE SPEED CONTROL
EXCESSIVE BENDS AND FITTINGS
FIG. 16A

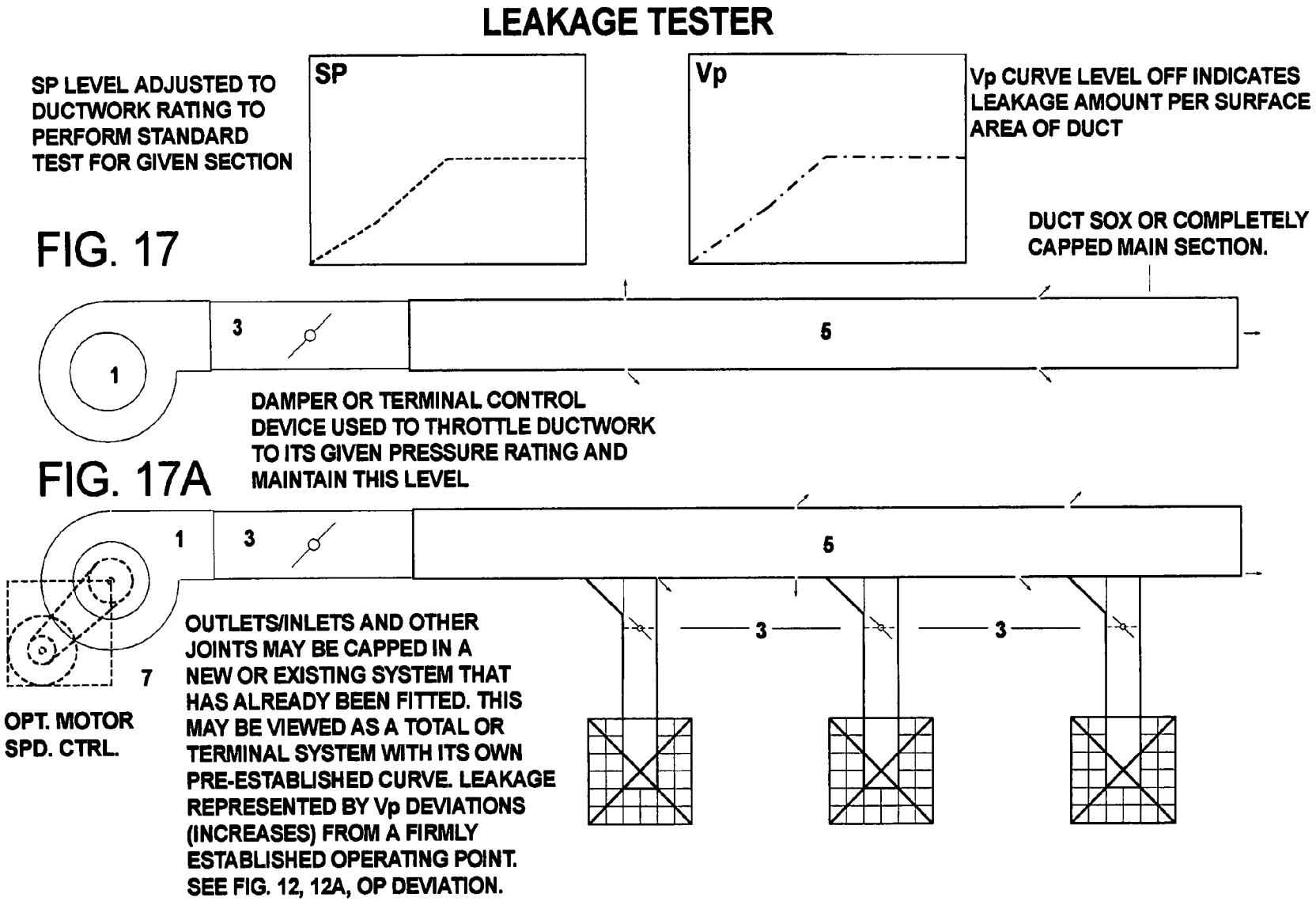
LEAKAGE TESTER
Vp CURVE LEVEL OFF INDICATES LEAKAGE AMOUNT PER SURFACE AREA OF DUCT
DUCT SOX OR COMPLETELY CAPPED MAIN SECTION.
Vp
SP
SP LEVEL ADJUSTED TO DUCTWORK RATING TO PERFORM STANDARD TEST FOR GIVEN SECTION
FIG. 17
1
3
5
DAMPER OR TERMINAL CONTROL DEVICE USED TO THROTTLE DUCTWORK TO ITS GIVEN PRESSURE RATING AND MAINTAIN THIS LEVEL
FIG. 17A
1
3
5
7
OPT. MOTOR SPD. CTRL.
OUTLETS/INLETS AND OTHER JOINTS MAY BE CAPPED IN A NEW OR EXISTING SYSTEM THAT HAS ALREADY BEEN FITTED. THIS MAY BE VIEWED AS A TOTAL OR TERMINAL SYSTEM WITH ITS OWN PRE-ESTABLISHED CURVE. LEAKAGE REPRESENTED BY Vp DEVIATIONS (INCREASES) FROM A FIRMLY ESTABLISHED OPERATING POINT. SEE FIG. 12, 12A, OP DEVIATION.

VECTORIAL DISPLAY
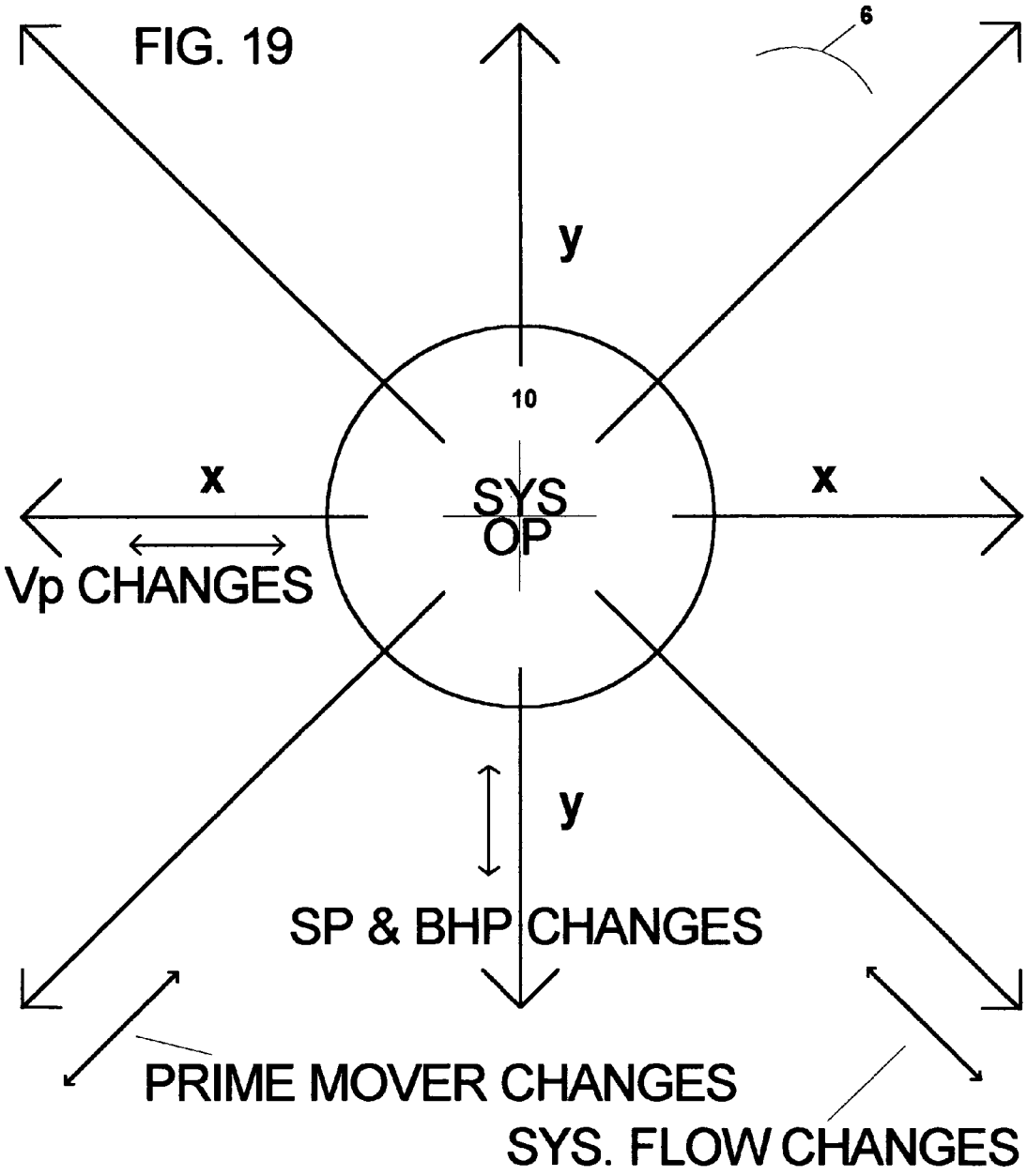

SYSTEM START FLOW CHART (AIR)

TERMINAL DEVICE FLOW CHART

FIG. 22C

POSSIBILITIES DISPLAY MENU (AIR)

VERIFY THAT THE FOLLOWING CONDITIONS HAVE BEEN MET:

IS THE SYSTEM IN THE CORRECT MODE OF OPERATION?

NORMAL, SMOKE, BALANCE, OR TEST MODE OF OPERATION

ARE ALL DAMPERS/VALVES/TD'S FULLEY OPEN OR IN THEIR MAX DESIGN POSITIONS (LESS DIVERSITY) THROUGHOUT THE SYSTEM FOR NORMAL, SMOKE, TESTING, OR BALANCING MODE START UP?

IS MOVER ROTATION CORRECT? MAY REQUIRE PHASE CHANGE

VERIFY THAT MOTOR/DRIVE DATA, TAG, STOCK INFO. IS CORRECT OR APPLY DEFAULT SEARCH OF DATABASE FOR SUITABLE RECOMMENDATION NEEDED TO ACHIEVE OP UNDER CURRENT AS-BUILT CONDITIONS

RA/OA, ECONOMIZER, OR OTHER INTERNAL DAMPERS SET CORRECTLY NORMAL OR OTHER MODE OPERATION - % RA/OA

CHECK PACKAGE HOUSING, BLOWER CABINET FOR OBSTRUCTIONS

CLEAN, REPLACE FILTERS

CLEAN COIL FINS, COIL INTERIOR

CHECK REFRIGERANT PRESS./TEMP. IN/OUT

CHECK EXPANSION/CONDENSATION CYCLE, HI/LO CUTOUTS, EXPANSION VALVE

SMOKE MODE OPERATION

ARE ALL SMOKE DAMPERS OPEN?

NORMALLY CLOSED / OPEN (WITHOUT POWER)

IS OA DAMPER FULLY OPEN? (100% OA)

IS RA DAMPER FULLY CLOSED? (0% RA)

GO TO MOTOR/DRIVE DATABASE (NOT INDEPENDENT OF MOVER)

GO TO SEARCHABLE DATABASE

ADD TO, UPGRADE POSSIBILITY DATABASE

TRY SYSTEM RESTART

PROBLEM(S) REMAIN RETURN TO POSS INTERFACE

PROBLEM ORIGINATES FROM...?

EXTERNAL PROBLEM:

PROBLEM AT PRIME MOVER SUCTION, DISCHARGE?
@ FLOW SENSOR GRID?
@ TERMINAL OR IN-LINE DEVICE?
@ SMOKE DAMPER ON WALL PARTITION
DUCT SMOKE DETECTOR
OTHER EXTERNAL DEVICE

INTERNAL PROBLEM:

MIXING BOX
FILTER SECTION(S) - FORE / AFT OF MOVER
COIL SECTION(S)
BLOWER SECTION
HUMIDIFIER / UV
OTHER SECTION

TEMP./HEAT EXCHANGE PROBLEM

FIG. 22D

POSSIBILITIES DISPLAY MENU (HYDRONICS)

VERIFY THAT THE FOLLOWING CONDITIONS HAVE BEEN MET:

IS THE SYSTEM AN OPEN OR CLOSED SYSTEM?
IS THE SYSTEM IN THE CORRECT MODE OF OPERATION?

ARE ALL VALVES/TD'S FULLEY OPEN OR IN THEIR MAX DESIGN POSITIONS (LESS DIVERSITY) THROUGHOUT THE SYSTEM FOR NORMAL, TESTING, OR BALANCING MODE START UP?

IS MOVER ROTATION CORRECT? MAY REQUIRE PHASE CHANGE

VERIFY THAT MOTOR/DRIVE DATA, TAG, STOCK INFO. IS CORRECT OR APPLY DEFAULT SEARCH OF DATABASE FOR SUITABLE RECOMMENDATION NEEDED TO ACHIEVE OP UNDER CURRENT AS-BUILT CONDITIONS

OPEN SYSTEM

DOES THE SYSTEM HAVE SUCTION LIFT, I.E., PIPING BELOW PUMP CENTERLINE?

DOES THE SYSTEM HAVE ADEQUATE NPSH?

IS WATER BASIN LEVEL BEING MAINTAINED?

IS THERE ADEQUATE MAKEUP WATER?

IS THERE ADEQUATE WATER IN THE SYSTEM AT HIGHEST POINT IN PIPING?

CLOSED SYSTEM

IS THERE ADEQUATE WATER IN THE SYSTEM AT HIGHEST POINT IN PIPING?

HYDRONICS TERMINAL COIL PROBLEM:

COIL CHW IN HAS CORRECT TEMP., BUT NO FLOW/TEMP. SENSED CHW OUT? AERATE COIL

GO TO MOTOR/DRIVE DATABASE (NOT INDEPENDENT OF MOVER)

GO TO SEARCHABLE DATABASE

ADD TO, UPGRADE POSSIBILITY DATABASE

TRY SYSTEM RESTART

PROBLEM(S) REMAIN RETURN TO POSS INTERFACE

PROBLEM ORIGINATES FROM...?

| EXTERNAL PROBLEM: | INTERNAL PROBLEM: |
|---|---|
| PROBLEM AT PRIME MOVER SUCTION, DISCHARGE?<br>@ FLOW SENSOR GRID?<br>@ TERMINAL OR IN-LINE DEVICE?<br>OTHER EXTERNAL DEVICE | PUMP CASING<br>IMPELLER<br>STRAINER SECTION(S) FORE / AFT OF MOVER<br>OTHER INT. SECTION |

TEMP./HEAT EXCHANGE PROBLEM

FULLY ARTICULATED AND COMPREHENSIVE AIR AND FLUID DISTRIBUTION, METERING, AND CONTROL METHOD AND APPARATUS FOR PRIMARY MOVERS, HEAT EXCHANGERS, AND TERMINAL FLOW DEVICES

CROSS-REFERENCE TO RELATED APPLICATIONS

NA

STATEMENT REGARDING FEDERALLY SPONSORED RESEARCH OR DEVELOPMENT

NA

REFERENCE TO SEQUENCE LISTING

NA

BACKGROUND OF THE INVENTION

The method and apparatus of controlling air-fluid distribution and heat exchange may apply to any commercial, industrial, scientific, or engineering application wherein air flow, fluid flow, gas flow, containment or mixture thereof would require most efficient, most precise distribution, articulation, and delivery. However, the main application as described herein will namely address the HVAC (Heating, Ventilating, Air Conditioning) industry.

The following description and claims are supported by established facts known from scientific and engineering principles as set forth by the laws of fluid dynamics, fluid statics, thermal dynamics, affinity laws, and by building and energy codes.

The Primary Mover

The first step in the process of determining system status begins with the primary mover and air handler (or fluid handler) itself, including all of its internal components. Referring to FIG. 2, 2A, 2B, these illustrations depict an "old school" arrangement of mover testing for TP, SP, and Vp (Total Pressure, Static Pressure, and Velocity Pressure [of mover.]) It will establish a premise of known methodology, which will be referred to throughout the specification.

The various testing elements (probes) are arranged at the center of each duct. Note that there is no indication of whether these are meant to suggest a traverse of each duct or a testing at their cross-sectional center points (V-max or maximum velocity.) This also becomes moot when viewing FIG. 2A, as a true static pressure acts laterally against the walls of a duct, not over its cross-section, though some negligible force may be sensed there with a static probe. It would then, therefore, be logical to state that where the velocity is maximal, the static pressure would be minimal. The other assumption in this sensing arrangement is that the cross sections of discharge and suction have laminar flow, which in the case of most centrifugal fans, it certainly would not, particularly on its inlet side in close proximity to the fan. This is why sensors and flow stations must be located a sufficient distance downstream or upstream of the mover and with adequate straight section of duct or piping run.

Ready comparisons may be drawn between these early figures and FIG. 13, 14, 14A, 14B, primary mover sensor logic as employed by the described method and apparatus, which takes these fundamentals further and broadens their scope. These are schematic depictions of the sensor arrangements whose actual configuration may differ in appearance, though the principle function remains. Various sensor stations, assemblies, and "grids," as we will call them, currently exist that may appear vastly different from either an equal area or log traverse, though the comprising elements (static, impact sensors) must be the same or they must be incorrect, though they may be somewhat functional with corrective calibration. References are made according to known and accepted methods of testing.

Referring also to FIG. 15, 15A, 15B, terminal or in-line device sensor logic, one key difference between a mover and its terminal device when making a dynamic (Vp) comparison under lab conditions with no system attached, is that the mover's flow-volume can only be measured on one side. Being an active device and a constant volume machine, its manometer reading (or differential) would otherwise equal neutral or zero.

A static differential comparison where a constant volume mover is concerned will be contingent, as this will be largely dependent on whether the inlet remains open to atmosphere (entirely in the form of velocity and, thus, negated) or ducted to some degree. Additionally, the percent "wide open" testing will have an impact on this arrangement. As different degrees (or percentages) of closure are applied to the mover, the static content will shift more from one side to another under varying conditions. Its total amount will remain potentially, but conversion and shifting will occur. And, this will affect namely how much "system" may be applied to the suction of the mover, where system design length of run per cross-section is concerned. The optional sensor arrangements shown have to do with already packaged or housed existing systems that may incur SP or Vp losses on one or the other side of the mover.

Undoubtedly, the type of mover will have an impact on test methods. For example, an axial fan or positive displacement pump will lean towards pressure constancy inlet to outlet, while centrifugal movers will exhibit more flexibility because of the nature of their construction and the forces at work. Mover aside, the described methodology clearly holds for the terminal device, particularly through its range of motion and with the mover's total power applied as a constant or variable.

One key difference in the diagram shown in FIGS. 2, 2A, and 2B, is that the SP and Vp readings in determining "Fan SP" and "Fan Vp" seem to be slanted toward only the discharge of the mover, in so far as each is concerned. This probably assumes inlet open to atmosphere (100% dynamic flow) on the mover's suction side with little or no ducting, ideally suited to an open plenum return, perhaps. Lab testing standards typically use this condition: open inlet with ducted discharge.

In the case of FIG. 2, it is safe to assume that the dynamic aspect is negated by the total impact sensing on the inlet, though this negates SP on this side as well, especially once ducted and how ducted. Typically speaking, however, when one side of a mover is 0.00" WC static (or 100% velocity,) the other side is deemed to be 100% of its static power. But analyzing these effects are crucial to avoiding the pitfills of presumption.

Additionally, the arrangement doesn't account for 1) System Effect losses once the mover is fitted and packaged. 2) The characteristic ductwork, namely on the suction side and the effect it will have on the mover, totally speaking. 3) There is no apparent reference to atmosphere wherein TP and SP are concerned, and establishing this may be difficult considering that the interior of building envelopes will taint the results, for the very reasons described in this specification.

The aim here, however, is not to play out differences, but rather describe how the said method and apparatus refers to known principles and progresses from these as a valid starting point to those already schooled in "the art" and provide a logical background to its development for clearer understanding.

The Fan Total Presssure

The Fan Total Pressure is a core measurement of the primary mover's total strength or total muscle, internally speaking. This determination is crucial to sizing the air-fluid distribution system in its entirety, full circle—discharge to suction—and, subsequently, establishing the representative system curve connected to the primary mover. This reading is taken directly at the mover's inlet and outlet with no other elements between. FIG. 3 shows a schematic of a typical "draw-through" unit with this demarcation and others delineated across its profile.

As shown in this example of a typically packaged or housed system, each component has a section. Firstly, we find the mixing box, where return air and outdoor air enter and mix airstreams; or simply return air alone, whether in the form of 100% return air or containing some percentage of outdoor air content. It may also contain an added air stream or fluid content supplied (ducted in) at some point upstream The next section, moving in the direction of suction flow, is typically a filter or pre-filter section, followed by the cooling or heating coil itself, where primary heat exchange takes place. Following these, the blower cabinet and, finally, discharge. In some cases, there may be additional segments aft of the blower (filters, additional coils, etc.) It is here, however, exactly at the primary mover's inlet, where one sensor grid is connected and the other at the fan's discharge in determining a Fan Total Pressure.

In the past, with "built up" systems, i.e. systems that didn't arrive from the manufacturer with cabinets and housings, but were rather just blowers, motors, drives, and other basic components for field assembly, the traditional method of determining Total Fan Power was to arrange an impact tube (total pressure sensing element) at both the fan's ducted inlet and its ducted discharge. For a proper "Fan Total Pressure" to be taken, these two impact tubes were connected directly to a manometer (HI+ and LO−) and, hence, the total "muscle" of the blower was determined by the manometer differential in "WC or "WG units (same denotation.) Similarly, a "Fan Static Pressure," to use generic terms, would be determined by a static sensor at its outlet, minus total pressure (impact sensor) at its inlet as a differential across both manometer connections. Again, refer to FIGS. 2 and 2A.

However, with modern "packaged" systems, blower mounting and housing inside of a cabinet has made this process vary considerably. For practical purposes, the new meaning accepted or simply understood by manufacturers and design engineers is that the blower's "Total Pressure" is simply measured as two "added" static pressure readings directly at the blower inlet and its discharge, these actually being subtracted (differentiated) as a negative and positive; for example, +5 "WC read at outlet minus −5 "WC at suction inlet equaling 10 (5−−5, or 5+5, a double negative thus added.) This can also be thought of as two absolute values, since it represents the fan's total power, coming and going combined.

Though technically, this is not the tried and true method, since it only considers static forces and not dynamic ones, it is the widely used method and has been employed for practical field measurement purposes, so long as the manufacturer's, design engineer's, and balancing agency's understandings are the same, thus the idea is corroborated and the intentions are the same. The design engineer, manufacturer, and balancers, however, should be aware of this fact for serious consideration when selecting, supplying, and testing the equipment, respectively, so the dynamic aspect of this equation is not overlooked. This point is stressed by the known fact that field measured Static Pressure readings are considered among the least reliable data in an existing or "as-built" system.

Furthermore, the immediate discharge in close proximity to a blower is primarily in the form of pure, non-uniform velocity, until static regain occurs approximately ⅔ of the way into the system, when there is a system. This fact alone may contribute to misleading or misinterpreted test results as well. Though in terms of static measurement, a higher static reading will occur at the enclosed inlet to somewhat compensate for this, reflecting the fan's total static power if only on one side, and with the added proviso that those are the terms agreed upon.

The recommended standard for testing any type of fluid flow is a uniform, stable condition known as laminar flow, normally occurring 2.5 duct widths for every 2500 FPM or less of discharge velocity from a mover and 1 additional duct width for every additional 1000 FPM. It is also accepted that there should be no more than 15 degrees converging or 7 degrees diverging in any fittings under such conditions. This is an equivalent round duct diameter, whereby a rectangular fitting would be converted through: SQ. RT. 41 w/PI. This criterion is also known as the 100% effective duct length, through which it is supposed that the total effectiveness of the mover may be realized.

The traditional method (two impact tubes) may have been employed where such systems offered an inlet duct run directly into the blower inlet where possible. In-line axial and radial-type centrifugal fans, both being ducted in series, end to end, may have been tested this way, so long as differences were noted and understood when compared to dissimilar systems. Those skilled and experienced in the art, such as HVAC engineers or Testing & Balancing Supervisors should be aware of these differences.

It is understood, for example, that packaged units are assigned an ESP (External Static Pressure) and that simpler movers, such as fans with no filters, coils, or other sectional devices fore or aft of the mover itself are understood to be assigned with what is both an ESP and TSP (Total Static Pressure,) these becoming one and the same concept because of no internal component losses coming into play.

These concepts still remain the source of much debate in the industry, and as a result, no consistent air-fluid distribution control system has been adequately or consummately applied, but rather the emphasis has been more on temperature control alone. Aside from this fact alone, this is true for many more reasons, which will be discussed in various sections of the following specification.

Practically speaking, this outdated terminology will be cited more carefully since it produces a conflict in terms: Total Pressure, Total Fan Pressure, and Total Static Pressure, the latter being the newer term, as normally understood. The method and apparatus described here, however, does, in fact, take the dynamic side of the equation into account throughout the system as a whole, from main runs to terminal runs as will be described in great detail in the following sections, as this is a key basis of its operation in whole and part.

Catalogued fan systems typically present tabulated or plotted fan data as Total Static Pressure for all intents and purposes and, as a result, the velocity factor is considered secondary, usually assumed as a safety factor. Though a keen design engineer may be aware of this and account for it in the equipment selection and specifications, it is the basis of the following description to emphasize the significance of this velocity factor or "gradient" as it pertains to system operation, after a system is installed and is purported to be under some degree of automated control under normal operation, after the fact.

The Packaged Unit's Total External Pressure

The packaged system's External Static Pressure is, again, a differential of static pressure at the primary system's most exterior intake (before pre-filter section) to its most external discharge side. The purpose of this is to establish the surmountable losses of all internal components within the packaged system, blower itself aside. In basic terms, this measurement is taken from end to end of a packaged unit. Note FIG. 3

Many manufacturers apply this figure instead of what is normally understood as the "Total Static Pressure" of the blower or primary mover. This may be a source of confusion as well, though it may arguably be considered a better starting point in selecting equipment, since it already includes the packaged air handler's own internal losses, which the primary mover must overcome before dealing with any system ductwork/piping/vessel to which it will be connected. For convenience, the engineer, then, need not include additional losses for the internal housing of these systems, though should again be aware of mover characteristics being the heart of a system and the dynamic aspect of this problem, both internally and externally.

The Static Pressure Profile

Beginning from the negative (suction) side intake, a profile is produced with a static, single-point measurement of each key section of the system, sequentially following the path of airflow through to its final discharge into the supply air plenum/duct. FIG. 3 delineates locations for each static pressure sensing point, though these single point or averaged readings, when possible, are taken laterally against the housing wall.

The purpose of this is to obtain pressure drops across each defined section within the packaged system to determine any effectual changes therein as a more detailed analysis. For example, a filter section's pressure drop will rise considerably after it is "loaded" or saturated with dirt and particulate matter. A wet coil will produce a higher pressure-drop than a dry one. These, among other things, will affect total system performance, as well as provide key indicators as to the cause of specific deficiencies and where they originate from within the system. They may point out, for example, the need for a filter change or coil fin cleaning. The type and condition of internal components also affect the primary mover with regard to its ability to deal with any changes occurring external to itself over time and under differing load conditions of cooling, heating, modulating damper control in the mixing box, or other unforeseeable obstructions placed there. Conversely, pressure loss (leakage or undue flow) may be noted there as well.

Normal Mode Vs Smoke Mode Operation

A common oversight in system design involves improperly sizing or equipping a primary mover for all ranges of motion that a mixing box, face-bypass, or other damper control system internal to the unit housing undergoes. This range of motion alters the pressure profile and may place more or less system curve load onto the primary mover. One example: If a primary/secondary air handling system is equipped with both normal mode and smoke mode operation, it will normally produce mixed air (returning and outdoor air combined) at its mixing box to be injected into the building, primary air being the outdoor air portion as building codes and occupancy would dictate. Under smoke mode operation, however, the return air damper closes to 0% and the system will inject 100% fresh air (primary air) into the building to purge smoke, and to work in cooperation with a smoke evacuation fan or other such system in smoke removal. As shown in the following figures, when the path, amount, and temperature/density of entering air shifts from one route to another on the suction side of the unit, the system undergoes a drastic change. FIG. 4 shows normal mode operation within a mixing box, and FIG. 4A shows what typical changes occur in smoke mode operation.

Total Power Available and Required

The key problem arising in the above example is caused by the shift from one duct system to another, each of which has a completely different system curve assigned to it on the suction side and, thus, as a whole system. Adding to this, this is the side where special dynamic losses, known as System Effect losses, most impact the performance of the primary mover in an adverse way. Unlike most losses, these system effect losses associated with dynamic flow occur in such a way that they are not recoverable at any point in the system. They also distort the true performance of the mover and/or system curve. It should be noted that these unique losses cannot be identified by field measurement, only by visual inspection from an experienced Testing and Balancing or Engineering Supervisor.

To begin with, the primary mover and packaged system must be sized bearing the above stated facts in mind, then must be adapted to operate within the framework of changing system conditions. For example, adjustment to minimum conditions should never allow full damper closure due to the necessity of maintaining minimum outside air requirements and free flow (one way or another) that also prevents the suction side ductwork from collapsing, if conversion to 100% suction static pressure or close to it should occur. Ultimately, the correct and final sizing of the primary mover is normally based on the following conditions: lowest minimum outdoor air setting and proportionally minimum return air setting to maintain fresh air and re-circulated air requirements as design and code would dictate. Normally, return air is a fixed setting in its maximum position. Since the advent of single blower systems for supply and return in a single unit housing, most ducted returns fall short of design rates before they would ever increase and, thus, seldom necessitate throttling. This will be further explained in ductwork and fitting losses. Here, the term minimum return air setting provides the most restrictive scenario that a mover might have to contend with, though any additional losses imposed, especially on the suction side of a system should be avoided if not absolutely necessary, again referring to System Effect losses. This could also greatly impact the sizing of the primary mover for little or no reason, further complicated by the effect loss.

Once all total system changes and the normal operating state is clearly determined, the above settings, then, establish the total system curve. This includes all fitted ductwork to and from an established critical run—main and terminal branches intact—needed to be supplied, delivered, and returned by the primary mover to operate at design flow rates, totally and terminally, under maximum demand conditions. Where a variable system is concerned, minimum rates manifest themselves in the form of a system diversity factor, which is further noted.

First and foremost, establishing this initial operating point can prevent the largest and least solvable problem in the initial makings of an entire air or fluid distribution system: over-sizing or under-sizing of total system power required from a primary mover.

Primary Air/Secondary Air Variations

It should be noted that some systems operate only as secondary systems (100% RA, Re-circulated Air or Return Air,) while other systems supply only 100% OA (Outdoor Air,) these being primary systems. Most commercial systems use a mixing box to establish the right mixture of both in one packaged unit, rather than designate another dedicated system to one or the other purpose. Outdoor air requirements are currently 20 CFM per occupant in commercial buildings. Keeping outdoor air to its minimum requirement is generally desirable in seasonal cooling systems, because more outdoor air means more humidity entering the building and more load on the system, thus higher energy demands. Conversely, more re-circulated air means more energy recovered and less load on the air handling unit or any heat exchange terminal. Newer systems employ a mixing box fitted with actuated dampers and sensors which monitor and regulate the entering OA amount when unacceptably high levels of CO2 are sensed in the returning air, this being produced primarily by the exhaling inhabitants of the building. This and other types of controls present a similar problem to smoke mode operation where the system curve and total impact on the primary mover is concerned. These automated systems also directly affect the amount of re-circulated air and cause constantly fluctuating conditions, especially in a VAV (Variable Air Volume) system already plagued with this problem. A modulating OA damper has a minimum setting, never fully closed unless the mode is unoccupied or "off-season," as some systems would have it. This setting reflects the code requirement for occupancy, and the maximum setting (full open or a specified design maximum rate) is the position taken when high levels of CO2 are detected. The OA setting may be the minimum required or more, not less. As stated before, the major drawback is that more OA=more energy load on the system, unless the example is a heating system operating on an economizer cycle, which takes advantage of cooler outdoor air in such climates. The opposite would then be true, though it is known that hot water systems can maintain as high as 90% of their heat exchange at 50% of hot water flow. The same is not true of cooling systems, which always require at least 80% of their (chilled) water flow to maintain adequate heat exchange.

Consequently, the total RA lowers as the OA goes up. The key terms here are SA (Supply Air,) RA (Return Air,) OA (Outdoor Air.) SA or the total capacity (CFM) of the system is made up of the two components: RA+OA=SA. Also, SA−OA=RA, in this case. Therefore, as one goes up, the other goes down, less total losses or plus gains to the system whole caused by damper positioning changes, leakage, or other internal losses, such as bypassing or infiltration within the unit housing, particularly those equipped with over-sized exhaust fans and relief dampers. The above combined or deducted air equation also applies to older twin blower systems (serving RA and SA independently) when ducted inside the same system, without an exhaust (relief system.) Otherwise, this equation becomes OA=SA−RA+EA when there is an integrated exhaust system.

The Shop Drawing Stage

After a project is approved and building has commenced, the HVAC drawing is usually turned over to a sheet metal fabricator contracted to install the ductwork as true as possible to the engineer's intended design and, later in the process, a certified Testing and Balancing firm is contracted to ascertain this fact, among others, by balancing flow rates within acceptable tolerances, usually 5-10% plus or minus flow rates at terminal outlets and total rates at primary, secondary, tertiary, etc., movers at specified loads with minimal losses.

At this shop stage, a shop drawing is usually produced. This is additional or follow-up drafting work performed by the sheet metal fabricator/installer per "as-built" conditions. It is at this stage, however, that many deviations occur, mainly due to architectural and logistical changes that were never coordinated/scheduled with the rest of the trades on the building project.

This being the case, many fittings, branches, sub-branches are added, taken away, refitted, or entirely omitted as a result. One typical example might be caused by electrical conduits that were run prior to the ductwork being installed and somehow took a wrong turn around where a light fixture was not supposed to be and, hence, blocked the path of an air duct, causing two unplanned elbow fittings to be added where there was supposed to be straight length of run.

Or, it may simply be that an architect decided that an exhaust outlet louver was not aesthetically pleasing on the observable exterior wall of a five star hotel, and so additional length and two 90 degree bend fittings were added to avoid this faux paux. Whatever the situation, these can be taken as typical occurrences on every building project with rare exception.

The ultimate effect of these "as-built" revisions results in system curves changing, sometimes dramatically. And this is the source of most problems on most projects, aside from poorly designed or improperly installed, leaky systems to begin with.

The described method and apparatus may not only assist with this problem, but will become a valuable tool for the system designer and installer throughout the entire commissioning process.

Over all, the best way to counter these recurring problems is for late revisions to be made every step of the way and the described method and apparatus can be involved as early as the computer drafting stage with appropriate recalculations and adjustments pre-programmed to the primary mover and terminal device control panel's memory as they are implemented. Additionally, this process can draw from an entire tabulated database of known equipment, fitting, and performance data as is detailed in this specification. The design operating point will then adjust accordingly against the known flow-pressure constants of the aptly sized primary mover and terminal device(s.)

Key Terminology

Two key types of devices will be discussed: active devices and passive devices. Any motor or otherwise kinetically powered, rotating, pulsating, vibrating, flagellating mover (pump, blower, rotor, etc.) will be referred to as an active device, a device producing force and/or kinetic movement. Terminal, in-line, or discharge devices (variable air volume boxes, valves, monitor stations, diffusers, infusers, registers, grilles, etc.) will be referred to as passive devices. The purpose here is to distinguish between TP, SP, or Vp as actively generated by a mover, or as passively received in an air-fluid stream supplied by that mover.

In air distribution systems, total pressure and its relationship to dynamic losses are expressed as TP(loss)=C×Vp. Total Pressure Loss Equals Coefficient×Velocity Pressure, the coefficient being a tabulation of known fitting losses, such as those provided by ASHRAE publications. Piping head loss in hydronics is expressed as H=FLv SQ./2 gD.

In hydronics, a Cv (valve flow coefficient) is commonly used for valves, terminal devices, and other fittings; while in air systems, a K factor or Ak factor (including free area) is used for grilles, coil face areas, and other terminal flow devices. The above factors indicate losses as they specifically pertain to dynamic flow in either medium and will be referred to as necessary; this to distinguish from provided catalogued data that would only indicate static pressure drops in inches of water column (or gauge) units and the one-sided myopia this may incur.

With regard to Cv's in hydronics, these represent a flow coefficient of a valve or terminal/in-line device in its 100% open position with one PSI of pressure drop across the valve or device itself for standard water, noting that GPM units require no temp./density correction: Cv=GPM/SQ. RT. of Dp (pressure drop must be in PSI units); also, Dp=(GPM/Cv) SQ.; GPM=Cv×SQ. RT. Dp/d (density correction.) Cv's may be established for any hydronics device to be used as a flow meter in so far as catalogued pressure drop data can be relied upon.

K or Ak Factors

Catalogued pressure drops, however, are more in current use in place of K factors where RGD's (Registers, Grilles, Diffusers) are concerned and perhaps for the better. RGD's are the ultimate terminal devices that deliver air-fluid to a given conditioned space. Re-circulated air aside, they are the air/gas/fluid's final destination as far as delivery is concerned. Pressure drops themselves are perhaps a more convenient idea from a design perspective and what it need be concerned with, since K factors are now established under field testing conditions, usually by a Testing and Balancing agency. Terminal devices, however, are inherently dynamic (velocity-oriented) vehicles of air-fluid delivery and should be viewed as such from any standpoint. Due to long time vagaries associated with their proper use, however, K factors are seldom seen in catalogued equipment submittals.

To differentiate the two, a K factor alone is a coefficient associated with a given air terminal device, while an Ak, as noted, includes the free area (cross-section) of that device, factored therewith. At times, these two are used interchangeably, and mistakenly so. This flow coefficient deals specifically with dynamic losses expressed as a diminished free flow area. The K factor simply whittles down the free area to a number less than 1 (a perfect square foot of free flow area) for 12×12 RGD's, keeping in mind that free area is already less than one for those smaller than 12×12. (12×12=144/144=1 sq ft.)

For example, a 12×12 grille (free area of 1) with a K factor of 0.70 (or 70%) has an Ak of 0.70×1=0.70. The Ak includes the free area and may be a number greater than one with larger RGD's and, hence, larger free areas. For example a 12×24 RGD has a free area of 12×24/144=2. If its K factor were determined to be 0.65, then its Ak would be 2×0.65=1.30. This applies to terminal outlets greater than 12×12 or equivalent RGD's.

The K factor is determined by measurement at a terminal flow outlet/inlet with the key equation Q=V×A. Flow equals velocity times area When a "free" flow rate, albeit in a ducted system, is determined upstream of a terminal or in-line device, along with a face velocity at the outlet discharge of a terminal device, A (or Ak) may be solved for: A=QN. If not a free area cross-section, A represents Ak (A & k together) when solved. The K factor alone is not independent of this. If it need be known aside from the free area connected with it, it must be solved separately. The known free area is derived from the nominal dimensions of the cross-sectional duct holding the device without its terminal face RGD, which itself reduces the free area. The K may be solved for alone, or simply put: K=Ak/A Supply Air Vs. Return Air Distribution In the case of an exhausting or returning air system, the inlet intake (as opposed to outlet discharge) of a terminal device has differing characteristics. The flow rate upstream of the terminal/in-line device would in this case be on the opposite side, for example, air entering from a conditioned space. This is where free flow rate exists in the form of 100% velocity before encountering the dynamic loss of the RGD.

Velocity readings may then need to be obtained from a traverse of the duct downstream of the grill, moving back toward the primary mover. The flow rate on the face of an RGD is sometimes taken by a barometer (flow hood) reading covering the inlet. Though more questionable in discharge air readings due to taking an air measurement at the face of an RGD after the air stream has already experienced its dynamic losses, this method is widely used by balancers to determine K factors for terminal outlets or inlets out of practical field considerations. Then, of course, Ak=Q (balometer or CFM reading)/V (velocity FPM at RGD face in direction of flow.) Though static and total pressures may have a negative value in exhaust systems relative to atmosphere, velocity pressures or units of velocity, such as FPM, are always thought of as positive values. They are taken in a closed loop differential, High and Low on a micromanometer facing the direction of flow.

The disadvantage of this distinctly different path of flow and the reason most ducted return air systems fall short of their required flow rates is that they don't have the benefit of ducted total power, and namely static pressure behind them (or rather in front of them) prior to experiencing dynamic losses at the face of their inlets. Leakage rates are also more pronounced on the RA, or EA suction side, where the Vmax (velocity max) is inverted rather than protruded. This also distorts the actual total fan power being applied effectively, as the leaked air still returns to the mover. These, then, are the key differences between the two terminal types and bring to light a problem in current systems with single blower return/supply air. Not to imply that it is impossible to achieve acceptable tolerances, it simply means much less room for error in sizing and fitting return air ductwork and in selecting a primary mover for minimum SA/OA requirements without compromising the RA.

In the case of open plenum (non-ducted) returns, there is less overall restriction, or more dynamic flow at the expense of high, if not complete, pressure loss. Also, there is the distinct disadvantage that return air distribution cannot be precisely controlled, and this is important because it is desirable to return air exactly from zones from where it was distributed in equal measure, less any outdoor air, for optimal recovery. Open systems also suffer from much dirt and outdoor air infiltration from many sources external to the conditioned zones, namely from the equipment room in close proximity to the blower and its open intake. Alternatively, direct-ducted RA/OA systems work best for those that have a smoke control sequence, because less indoor air and, hence, smoke contained therein, may be infiltrated through to the equipment room and re-circulated, despite the best efforts of sealing doors, ceiling plenums, and other adjacent spaces. Partial ducting, a common problem, as with transfer ducts, does not improve the situation and cannot work effectively without direct-ducted fan power—a common oversight in system design. Static pressure is not regained after it is lost through broken duct sections and, at best, this provides only a suggestive pattern of functional return flow through leaky ceiling plenums. Typically, open return systems are susceptible to load mixing from "crossover" zones, discussed later.

Once the true cross-sectional area of a terminal flow device is determined, a non-dimensional velocity passing it (FPM–ft./min., or FPS–ft/sec. in hydronics) is factored to produce a CFM rate of flow (Cubic ft./min.,) or a GPM (gal./min) rate of flow for hydronics, this after the FPS is converted to dimensional cubic ft./sec. units and a minute time frame is applied. This may be expressed as: Q=GPM/60×7.49 (gal/cu. ft. of standard water); also, V(FPS)=Q(cu. ft./sec)/A (cross-sectional area of pipe size.) And finally, GPM=FPS×A×60×7.49.

Piping sizes for fluid flow use the FPS unit, while air systems and standard instrumentation for their testing use FPM units. These are found in traditional tables and charts, which plot head loss against piping length, size, flow rate (GPM,) and velocity (FPS) for various types, such as steel, copper, or plastic pipe. Similarly, air duct tables plot friction loss ["WC (inches water column,) or "WG (inches water gauge) static units] per 100 ft against FPM velocity, flow rate (CFM,) and size of equivalent round duct, this tabulated from rectangular sizes as these cannot be used directly. Noting for emphasis, both types of charts are plotted against friction loss only (a static unit of measurement,) as it would relate to length of run, or equivalent length of run, this to isolate the dynamic aspect of system sizing and design which has to do with fitting/directional losses and reduced area coefficients. This is the industry standard terminology using the inch/pound system, which will be the choice of this specification, though the described method and apparatus may also function in metric equivalent units, if desired.

Among other pitfalls of designing and maintaining an air-fluid distribution system, the problem with catalogued K factors and any other such air-fluid flow coefficients, is that the data may be largely erroneous due to misrepresentation of actual field conditions, the point being that the K factor is unique to a given system and must be established by field testing of that system, as opposed to tests conducted under "ideal," static lab conditions. This is particularly true of plenum box or soffit-type vessels with sidewall registers or grilles connected perpendicular to airflow and connections generally not in the direction of flow. Many of these infinite dimensional variations would never or could never be reproduced under lab conditions. In fact, there are simply too many possibilities and variables within a system to warrant such constancy, as it can never be possible, especially with the unpredictable nature of "as-built" conditions caused by late shop changes to ductwork, capped extensions, turbulence or non-laminar flow, and other un-contoured paths of air-fluid flow.

Another issue with K factors involves their use in VAV systems in adjusting the sensed flow versus actual flow to a terminal branch via a terminal branch device (VAV box, zone damper, valve, etc.) Currently, most leading systems are equipped with adjustment of a K factor or K "value" for given terminal branch flow characteristics. This may be adjusted by a Balancer to calibrate the terminal device's sensor to what flow is actually not only passing the control device/flow monitor station, but reaching each terminal outlet, the final destination of delivery. The difference of these two, sensed versus actual, indicates losses due to leakage, dynamic losses, or friction losses—one of these three. Normally, the balancer has only to enter the sub-total flow reading he ascertains per outlets for that branch with his own timely calibrated equipment and enter this data into the control system, which makes the basic adjustment: Actual flow/Sensed Flow=K value used to adjust sensor reading and, thus, damper position.

If this value is less than 1, then the flow rate is less than the sensor indicates. If this value is greater than one, flow is more than sensor indicates. The sensor is then calibrated based on this entered data reflecting actual system conditions by calculating a new flow coefficient that reflects unique system losses for that particular branch. However simple this process may seem, it still belies the fact that the system must work harder, terminally and totally, to achieve the flow rates due to system losses producing flow factors that may be unacceptably low. Typically, these may fall between 0.65 and 0.80 and rarely, if ever, produce factors at or above 1.

Prior to the balancing procedure, the controls contractor or supplier presets the terminal device with a factory setting per design specifications at the outset of the project. In current practice, the terminal device is roughly sized for a flow capacity-range, or at least as closely as stock sizing will avail. Afterwards, the device seeks to establish this setting with it own sensing faculties and maintain what it believes to be the correct setting until it is told otherwise by a user.

The above procedure establishes the main user-control system interface where those skilled in the art are primarily concerned, though a control contractor may be more attentive to zone temperature settings and changes, and, above all, achievement of those settings one way or another, whereas a Testing and Balancing contractor is concerned primarily with air-fluid flow rates, in both total capacity and terminal capacity.

Noted discrepancies between design capacity and actual performance, however, are due to the system characteristics of the ductwork/piping/vessel downstream of that terminal device not readily apparent due to current control sensing limitations. In some cases, improperly placed, connected, or malfunctioning sensors could also distort actual conditions. The former may stem from late changes made to the terminal branch, unexpected losses due to obstructions, acute bends or turns, changes to sizing of the terminal device for its range and capacity versus any revised terminal branch system requirements, etc. Additionally, an effect caused by downstream throttling of terminal or takeoff branches contributes to adverse effects, as this may confuse current flow sensors, which, contrary to popular belief are more precise in taking measurements in closer proximity to the terminal/in-line device or flow station at which they are situated.

What Goes in does not Come Out

Consequently, where flow-volume is concerned, "what goes in does not come out," contrary to widely held belief. This goes for system total or terminal branch. The difference results from losses in one of three forms: leakage, friction losses (SP), or dynamic losses (Vp.) Perhaps the denial exists due to the fact that the primary mover is a "constant volume machine" as long as rotation is constant. However, aside from leakage, nothing is truly lost, but rather converted. Curve riding and changes to a mover (namely speed of rotation) versus changes to a system (length or fitting) also explain this phenomenon. This also stresses the importance of why these relationships must be viewed in the context of an operating curve and not independently, as they tend to be.

The key problem, however, lies in the issue of making best use of this conversion. Much of this has to do with the improper pairing of a mover with its system, or a terminal device with its sub-system, and the claims address this problem as supported by this description. Most commonly, the losses are a result of leakage, but when the expected volume "does not come out," the remainder may be deemed as static pressure resulting from undue restriction. Essentially, potential energy pent up inside the system is not yet or perhaps never released as flow. It does, however, exist dormant within the system so long as mover power is applied. The applied force will also exist as long as the ductwork can contain it for its class and rating. Otherwise, it becomes leakage at one or more points in the system.

One adverse result of this is that more input power must be applied to achieve the same flow rates at terminal outlets. When applied deliberately, however, static pressure may be manipulated to produce intended results, as is discussed in embodiments. Main and terminal branch problems are also further examined in the section on "Upstream Leverage," an additional supporting claim on the said method and apparatus, and in the section on terminal device flow control and all problems associated with this.

Overall, the issue of K factors, Cv's, or flow coefficients in general is an additional supporting concept for the said method and apparatus, referring in particular to terminal devices and their characteristics within a given, real system, as opposed to a theoretical one. Lab testing and equipment cataloguing also stand to benefit from implementing this method and apparatus at the very outset.

Current Use of ATC: DDC-AD Conversion

Among previously mentioned problems, current DDC (Direct Digital Controls) also suffer from quite severe limitations imposed by their very linear nature, namely the linear nature of the micro controllers they are comprised of, because mechanical, thermal, and fluid dynamic relationships are anything but linear. This points out another key advantage of the described method and apparatus: complex curves and relationships are plotted first and foremost, then coordinated data is processed after this crucial process and other key processing occurs.

Affinity laws alone do not apply to movers outside of a controlled context, only theoretically speaking, where direct, squared, and cubed relationships are concerned. And when they are, they rely heavily upon extrapolation, rather than interpolation. However, where actual field-testing is concerned, these conditions always vary and stray quite abroad, especially at low and high ends of the spectrum when dealing with a lab-tested mover in the constantly changing framework of a real, "as-built" system.

In the proposed system, heat flow is plotted using psychrometric principles, namely tabulated data in tenths of degrees. Affinity relationships governing the mover will be displayed on graphs and are used to plot actual performance curves, as opposed to how they might perform theoretically at varying positions of WOAF (Wide Open Air Flow.) FIG. 6 and FIG. 6A.

Following this initial pairing of system to mover, true coordinates are determined, then translated into readable data as required by a logic-oriented micro-controller. This point also conflicts with current use of temperature sensor-oriented controls, which are not governed by the affinity laws or even thermal dynamics. They simply operate on the direct linear scale of the micro controller, using single integer math, or operate some form of motor control to effect conditioning changes, normally on a proportional (direct-acting) interface between motor controlled damper-actuator and basic sensors. The key problem remains, however, that they go little or no further in obeying the laws of thermal dynamics or fluid mechanics, or in making use of them for efficiency or effectiveness.

As shown in FIG. 10, the described method and apparatus uses plotted coordinates established with known affinity laws as a starting point and guided by them whenever unknowns are present. This can then offer a complete picture where there may be missing links or data unavailable. Following this, the transfer of data inputs and outputs can then be adjusted correctly to perform the necessary functions as required by the hardware. However, this description emphasizes that in using the described method and apparatus, no unknowns will cause an extrapolation to become necessary. Between the breakdown of Total Power and Total Pressure, there shall always be a solid deduction (as opposed to induction) made never contingent upon unknowns.

Most industrial sensors still require AD (Analog to Digital conversion,) and so are technically not "directly digital," as the name would suggest. Such sensors still require transduction at some point to convert an inherently analog signal, for lack of a better term, to a code palatable to a microprocessor. The crux of the problem lies in correct sensor interpretation and signal utilization. Characteristic and performance curve plotting based on proper sensor placement, input, and configuration is the best approach. This may be done first by true sensor feedback based on correct thermal and fluid mechanics principles, curve plotting, then processing, as explained with said method and apparatus in this specification. Any other method, therefore, must be assumed to be grossly limited, if not wholly incorrect, particularly if based on principles of temperature zone sensing and direct damper control alone with localized, unilateral feedback.

In summary, the prevailing difference between the described method and apparatus and current systems lies in temperature control with direct digital motor control alone versus complete fluidic control; thermally, statically, dynamically, and totally.

Key Prime Mover Types and Configurations

Generally, there are two types of movers at either end of a wide spectrum: High-pressure type and Low-pressure type. An archetypal example of a Low-pressure type air mover would be the basic propeller fan or axial fan. Typically, this moves air at a high velocity, high volume (CFM) and does so at the expense of static pressure. Vane Axial or Tube Axial may be easily confused with Radial in-line fans, which are actually centrifugal and sometimes referred to as the same or may appear similar, though they are not. A radial fan's blades don't stem from the shaft, as with a vane or "prop," but a radial ring of blades rotates about the interior housing rim. They are however, SWSI (Single Width, Single Inlet) and in-line with the ducting much like Vane Axials. The most typical example is the outlet-capped, "mushroom" fan that generates high end-suction typically used in rooftop exhausts.

On the opposite side of the spectrum, the centrifugal fan and its variants produce higher static pressures with less flow-volume output, comparatively speaking. The FC (Forward Curved) and BI (Backward Inclined) fans are two key types of centrifugal fans, each with desirable and undesirable characteristics of their own. BI type fans are an example of a higher-pressure type blower, while FC's, used most commonly for commercial applications, are a compromise of pressure and flow (or velocity content, which translates to flow.) Most centrifugals are DWDI (Double Width Double Inlet) for maximum flow-through capacity and air movement volume at given pressures, though even higher-pressure types are narrow, single-inlet designs for dust, particle collection, or other high suction vacuum applications. Again, with loss of flow-volume under applied motor force, there is pressure gain, whether suction or discharge. There is also more demand on brake horsepower with this configuration.

Whatever the traits of each type of mover are, its general performance characteristics are displayed on a "characteristic curve" and each is suited to a specific application. In current usage, this identifies specific qualities and desirable operating points for flow-volume rates at given static pressures and maximum "static efficiency," which is a concept that is flawed from the inception of equipment cataloguing, along with percentage of WOAF, also a static, theoretical projection of mover-system performance that completely misuses the dynamic gradient. Percentage of closure testing as currently in use has known, acknowledged failures and in no way substitutes for real system characteristics and/or how the mover reacts to those unique characteristics in actual field operation. As currently accepted, most FC fans' operating ranges fall on their 60% of wide open flow for peak static efficiency, still providing adequate flow rates, while BI fans have a non-overloading (amperage) characteristic and a higher static efficiency at the expense of lower flow rates. In terms of their pressure content, the FC fan produces approximately 20% SP (Static Pressure) and 80% Vp (Velocity Pressure,) while the BI fan produces approximately 70% SP and 30% Vp. This theme of specific flow-pressure content will be referred to throughout this specification. FIG. 5 shows typical performance curves for various fans.

BRIEF SUMMARY OF THE INVENTION

The described technology proposes an integrated fluid control unit and metering device equipped with self-calibration through all system load variation as required by changing scalar or vector flow coefficients, including Brake Horsepower, critical Total Pressure, and Critical Mass Flow as consummately applied.

In support of this current novelty, many factors place prior art in question. One popular misconception in flow testing and mover control is that the mover's RPM will change as dampering differences or relief openings are imposed on a distribution system. For example, one may feel that if they open an access panel with the blower running—and release Static Pressure—that, along with a notable increase in amperage, the mover's rotation will also increase. This is not so. The mover speed of rotation and unique loading characteristic is independent of the system (unless it is changed in of itself) and it is precisely for this reason among others that the relationship must be viewed in a context that properly adjusts these changing parameters, further including BHP or Total KW.

Basically put, changes to one conform to the other in a curve-riding relationship along corrected sine/cosine tangents. This offers a comprehensive way to control and monitor such a fluid handling system and expect to achieve predictable results. This may also be expressed through PHI, phase angle on the electrical side, clocking signal under modulation, or effective damper angle for a valve or terminal device under modulation.

Variable geometry also figures in converging or diverging angle fittings for fixed ducting or opposed blade dampers. Otherwise, changing valve coefficients (10) are precisely tracked and pinpointed by degree opening or effective radian angle (5) as shown on the quadrant chart example (FIG. 11) for the terminal device and its constant (11). In electrical signal modulation, this chart simply spans 360 degrees and two or more Operating Points are in play, such as with total system parameters (23, 24) for a moving signal or waveform.

In prior use, certain physical laws known as affinity relationships were employed to estimate the performance of such fluid systems through an extrapolation (educated guess) as to how the actual system may perform under given conditions (FIG. 10). These, however, were simply projections based on presumptive logic and guesswork. The described method takes appropriate measures using interpolated data, deducting the solution from three or more known and firmly established verification points.

By virtue of pure logic, one novelty of the described technology is that it need never rely on any extrapolation (educated guess) to determine true performance characteristics. The procedure will always conform a precise deduction from BHP or Total KW calculating steps, as these parallel Total Pressure and its subsequent conversion into Velocity Pressure ($V_p$) and Static Pressure (SP). This offers the basis of a new form of logic gate for fluid-mechanical systems. It also proposes a computer operating system for virtual and real physical environments where in place of the "cursor", a point or points of operation are interpolated by the processor for the appropriate physical actions, whether sealar or vector in nature.

In current systems, so-called "floating" data points tend to be viewed independently and compound errors result. Current systems utilize extrapolative performance projections based namely on Static Pressure sensing with sensors also placed in a questionable context, both up and downstream of dampering or other variables where correct interpretation is rendered inaccurate and unreliable. Movers and valves can only "hunt" for an obscure range or point of operation from conflicting sensor data as pressure increases can be as equally attributed to block-tight Static Pressure as they can be to fan power being applied effectively. This also easily confuses the blower because most typical centrifugal fans exhibit the same Static Pressure characteristics despite a vastly different flow rate, at approximately their 30% and 70% points of "Wide Open Flow", known as their surge points. This is especially pronounced on the low and high end of the curve where the motor's Power Factor is also not made use of appropriately. This problem explains "blower surge", however, the method algorithm also addresses the phenomenon known as "system surge", another adversity in fluid systems.

Though the described Operating Point may be placed in any desired field for efficiency or effectiveness, its prime function also accounts for "Tan Horsepower", "Air Horsepower", and "Water Horsepower", additional forms of BHP denomination, as well as overall "Mechanical Efficiency" where the unit "driver" and "driven" components are in play. This covers any internal drive losses as well as polytropic effects imposed by the compressible or incompressible state of fluids.

Efficiency is usually the biggest questions mark in such systems, because it is often obtained from a manufacturer's said tag HP (not BHP) or some previous estimation. Mechanically, this component may also be derived from sensor data where BHP is first determined by alternate means such as on a torque gauge along with RPM readings; Torque (lb−ft)×RPM/5252. Mechanical output, however, is appropriately determined and distributed via the sensing apparatus from Total Pressure conversion as produced by system load under specific variation. ME (Mechanical Efficiency)=AHP (Air Horsepower/BHP; or WHP (Water Horsepower)/BHP; any fluid stream power/BHP.

Electrically, a direct Power Factor reading (KW/KVA) or P/S can be taken and remaining electrical unknowns are derived from the power triangle consisting of P, S, and Q (True Power, Apparent Power, and Reactive Power, respectively). The Pythagorean Theorem follows in this relationship where Q (reactive)=SQ. RT. S SQ.−P SQ. and so forth. Additionally, comparative data may be derived from Mechanical Efficiency to assess the electrical-mechanical translation of these components.

Power Factor is central in assessing electrical power output, along with electrical efficiency—power available for useful work, as opposed to KW input. But between power draw from the mover and translations of Total Pressure, the actual unit efficiency is accurately determined in a real system as opposed to a "proposed" efficiency, whether mechanical or electrical. Also, BHP may be derived from input KW (voltage and amperage readings) where only the Power Factor is known, this determined by direct Power Factor reading, input KW/KVA, or other means. KW output=I×E×PF/1000 (single phase power); or I×E×PF×1.732/1000 (three phase power). Once true power output is assessed, then electrical Efficiency=746×BHP/E×I×PF (single phase power); or 74633 BHP×E×I×PF×1.732 (three phase power). If this were "proposed" efficiency, then BHP would be tag or manufacturer "HP" and estimated "PF".

Velocity reading as per pitot tube multipoint traverse is deemed among the most accurate datum points with its closed-loop sensing, second to BHP. Static reading is deemed the least accurate. Additionally, Static Pressures are prone to atmospheric differences inside of a building envelope (highly significant at 14.747 PSI) when used out of context of these other crucial data veritication points. This discrepancy in itself can equal the addition or absence of a large capacity mover. This unacceptable margin for error can easily be breached if such pressures are not viewed as "absolutes", taking an atmospheric reference into account at both manufacturing stages and at final testing stages of an "as-built" system.

Under VAV operation, the method algorithm performed by the said apparatus establishes a set criteria for the "System Diversity" amount—the specific energy saved—and the control system may itself "map out" this diversity through its own default operation setting as most effective for an existing or "unknown" system. Solved unknowns are extracted from precisely coordinated relationships using the said verification data points. The diversity manifests itself in minimum requirements for all loading demands and minimum valve positioning in a real system.

The Diversity is a valuable amount of the distribution system that can be set aside when not in use, a margin for saving energy, when portions of the mover and system are not in full demand instantaneously or, in other words, "not instant." Current methods of "instant" reading or sampling flow and pressure data, however, cannot keep up with these complex changes, namely due to a problem known as "flow-pressure stability" and other analog-digital control limitations. These can be viewed on a power triangle signal graph. Logging these clocked leading and lagging "trends", this adverse effect becomes increasingly apparent on the fluid control side of the equation and then reverberates through a cascading effect through all high and low voltage electrical systems, including microprocessors as well. The described technology offers a solution to this inherent problem on a fluid-mechanical, thermal, and electrical level.

Because critical areas of a fluid system change under modulation, the mode of operation continually adjusts the total circuit path and its demands on the mover, which fall into play precisely where needed at any given time or constant as the ordinate, abscissa, and "sigma" sensor values would indicate (FIG. 13). This is especially crucial in air systems due to their changing flow coefficients with adverse effects imposed by damper modulation and damper angle adjustment. Due to limitations of current systems, valves operate within only a small part of their usable range. Utilizing the specified method algorithm and prescribed apparatus, the variable mover and plurality of valves are placed in the broadest and most effective range possible within the given system.

Aside from the VAV Mode, other specified modes, notably Test Mode, Balance Mode, and Smoke Mode, simply use similar terminal device or main dampering techniques to effect other actions. Lab Test, then Balance Modes would apply from initial lab testing stages through to start-up, troubleshoot and calibration of the system as needed. "WOAF" (Wide Open Air Flow) originates from the nascent stage, where initial data points are first established and recorded in the database provided, or derived from some other accepted source. Smoke Mode is triggered by a condition in a built-up system of fire smoke evacuation in which all valve variables are at wide open parameters, namely 100% O/A (Outdoor Air) injection, but filly closed R/A (Return Air). As added measures, the remaining functions deal with eliminating leakage and "System Effect" factors through isolated sensing and dampering techniques as specified.

The Expansion-Compression Cycle

The fluid metering and control unit also applies optimal functioning in refrigeration systems where the DX expansion-compression cycle is used. Here, the terminal device or heat exchanger may be a vessel of compression or a vessel of expansion. This subject matter pertains to compressible fluids or gases where a polytropic process is assumed along with air-fluid changes occurring above atmosphere as well as those below, such as in vacuuming (suction) applications. Critical mass flow rate and timing through the heat exchange refrigerant coil, expansion valve, water coil, or other HX medium are also precisely controlled this way through functions pertaining to heat exchange of diverse fluids crossing paths with one another in different configurations, counter-flow being the most effective.

In summary, the path of critical mass flow in variable systems is precisely manipulated and tracked by the "Point of Operation" reference point, expressed as either a scalar function or a vector function. This complex coefficient maintains an adequate flow-volume-pressure relationship in the whole system, totally and terminally, thus satisfying the need for system diversity on a fluid-mechanical and thermal dynamic level.

Moreover, the key utility of this patent provides the means of "tuning" most all machines and mechanical devices for operating at their optimal level of power and efficiency at any given time or constant. This includes fully articulated operation through all varying volumes, densities, variable geometries, and, ultimately, critical mass flow rates at their maximum possible effectiveness.

The method and apparatus offers a complete air-fluid distribution, control, and management system beginning with the primary mover of such system and extending through to all components, branches, sub-branches, and terminal outlets/inlets required for air-fluid delivery of that system. The key basis for its operation is its fully articulated and comprehensive flow-pressure analysis, namely a breakdown of Total Power in the form of Total Pressure, Static Pressure, and Velocity Pressure, where in previous automated systems and design methods the velocity gradient was largely ignored and temperature-based systems more the focus. Considering thermal measurements, the method and apparatus also monitors heat flow at primary and terminal heat exchangers, and may do so in coordination with flow-pressure gradients.

The method and apparatus utilizes the three key pressure gradients to establish an exacting degree of influence that each carries throughout the system by determining a percentage of content of Total Pressure and, as a result, is able to diagnose specific problems and present solutions to those problems in an innovative and complete way as never before.

When designing an air-fluid distribution system, the method and apparatus evaluates Total Gains and Losses, then Specific Gains and Losses occurring throughout every section of a new or existing system. This procedure begins with the primary mover and extends to all components of the system, such as any terminal flow control device in either series or parallel operation, or in any form, number, or combination.

The method and apparatus can also make precise assessments as to whether equipment sizing and specifications will adequately and efficiently serve said system, beginning with the primary mover and its total power input/output, down to every terminal branch or component of the system and its repercussive impact on the whole.

BRIEF DESCRIPTION OF THE SEVERAL VIEWS OF THE DRAWING

FIG. 7 juxtaposes a known mover "wide open" curve alone and same with an unknown system attached.

FIG. 7A juxtaposes a known terminal or in-line device "wide open" curve alone and same with an unknown sub-system attached.

FIG. 8 depicts a typical Air-to-Water terminal heat exchange device with sensor placement and configuration.

FIG. 8A depicts a Water-to-Water terminal heat exchange device with sensor placement.

FIG. 8B depicts an Air-to-Air terminal heat exchange device with sensor placement.

FIG. 10 displays the three part system curves as they might be viewed independently with x/y coordinates and affinity law mapping of the curve segment unknowns from a known starting point established through sensor logic or reference materials.

FIG. 13 is a sensor grid schematic of the sensor logic employed by the method and apparatus, including cross-sectional areas for sensor arrangement. The symbols are familiar as flow monitor stations, though are referred to in this specification by solid, broken, and dotted-broken lines to indicate TP, SP, and Vp, respectively.

FIG. 15 depicts Terminal or In-line device sensor logic as employed by the method and apparatus to measure such a device's TP.

FIG. 15A depicts Terminal or In-line device sensor logic as employed by the method and apparatus to measure such a device's SP. Optional sensor grid fitting also shown.

FIG. 15B depicts Terminal or In-line device sensor logic as employed by the method and apparatus to measure Terminal Device Vp. Optional sensor grid fitting also shown.

FIG. 16 demonstrates an embodiment utilizing dual damper and motor speed control in Series Operation in a system with long runs and minimal fittings.

FIG. 16A demonstrates an embodiment utilizing dual damper and motor speed control in Parallel Operation in a system with excessive bends and fittings.

FIG. 17 demonstrates one version of a leakage tester embodiment using a mover, terminal control device (auto damper control,) and a capped main section of duct. SP and Vp curve level offs are shown as indicators.

FIG. 17A demonstrates another version of a leakage tester embodiment using a mover, terminal control device (auto damper control,) and a new or existing system that has already been fitted. Leakage represented by Vp deviations (increases) from firmly established OP's.

FIG. 19 shows a detail view of the Vectorial display compass cross hairs, which illustrate all OP changes in any given direction, in any given context of mover and system or sub-system. The display acts as a kind of cursor to all effective system changes as they happen or after they occur within a given time frame. It may also be "locked in" at a specified operating point to display all related changes of a real or designed system in its entirety, prior to anything being built.

FIG. 22C consists of a Possibilities Display Menu for Air systems, including but not limited to any and all known possibilities for adverse mover-system performance in whole or part. This also refers to an upgradeable, searchable main database encompassing every available component of such a system, offering output such as motor/drive recommendations, or final "as-built" retrofit options.

FIG. 22D consists of a Possibilities Display Menu for Hydronics systems, including but not limited to any and all known possibilities for adverse mover-system performance in whole or part. This also refers to an upgradeable, searchable main database encompassing every available component of such a system, offering output such as motor/drive recommendations, or final "as-built" retrofit options.

DETAILED DESCRIPTION OF THE INVENTION

The process begins with the primary mover 1, which in this example shall be an HVAC unit and system equipped with some form of blower or fan to create air movement and generate system pressure.

The prime concepts at work here will be TP (Total Pressure,) the intended meaning conveyed to be understood as "all impact forces," static and velocity combined. SP (Static Pressure,) and Vp (Velocity Pressure.) TP=SP+Vp. It is understood that the latter two are mutually convertible throughout a given system and that TP decreases in the direction of flow.

As mentioned previously, unlike the traditional concept of TP, most fan curves indicate Total Static Pressures for viewing fan and system performance curves due to current packaged systems. A notation will be made where applicable.

Initial Operating Point for System Total and Primary Mover

Figure 9:
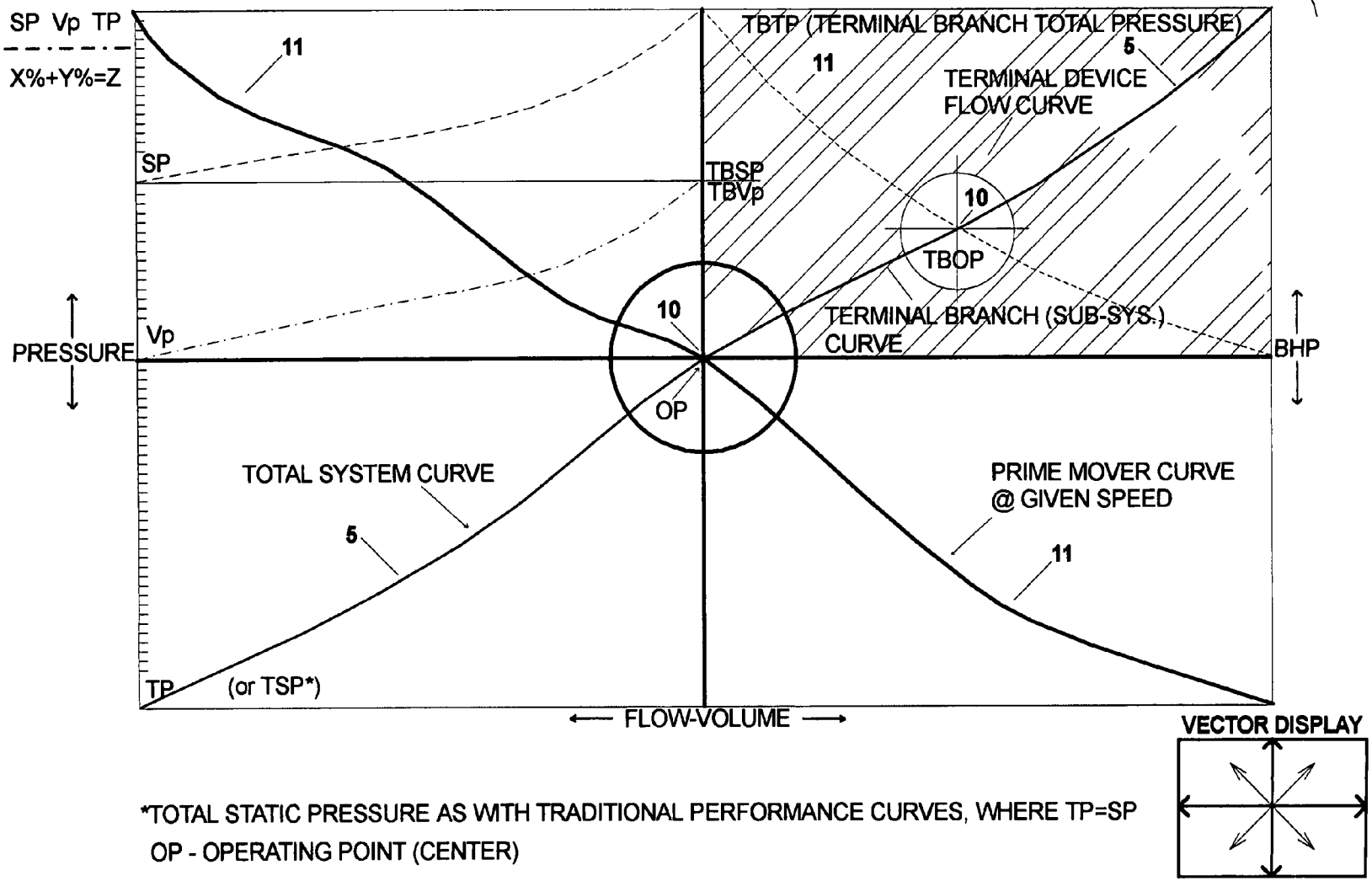
FIG. 9 illustrates the main panel display of the performance curves governing the entire air-fluid distribution system with all components shown as related to flow-volume and pressure relationships. This includes the Total System Curve and main cross hair operating point, the Terminal Branch system (or Sub-system) curve and operating point, mover curves and given constants, and SP/Vp breakdown by percentage, ratio, and visual display indicators. A vectorial display compass is also shown as an image overlay option.

The standard procedure after "as-built" system start-up occurs begins with the following: A design system curve 5 operating point 10 based on fan selection will be displayed as intended for normal operation. Following this, the method and apparatus will take all necessary readings with its own sensors 13, 14, 15 and controls arranged according to the described method to establish an actual operating point 10. FIG. 9

The conditions will be with completed, connected ductwork and all dampers/valves "wide open" or indexed to maximum positions with no unintended obstruction, under full load conditions, less diversity if one is present.

Dispersed throughout the system and not concentrated in any areas, the number of variable air volume terminals, automated dampers or valves whose terminal branches equal this diversity amount 22 shall be closed or placed in their minimum positions to accurately represent the system curve the mover is actually sized for, this amount being less diversity. "Terminal branch" shall be defined as a total of given individual terminal outlets/inlets and, thus, a subtotal of the whole system.

Figures 12, 12A:
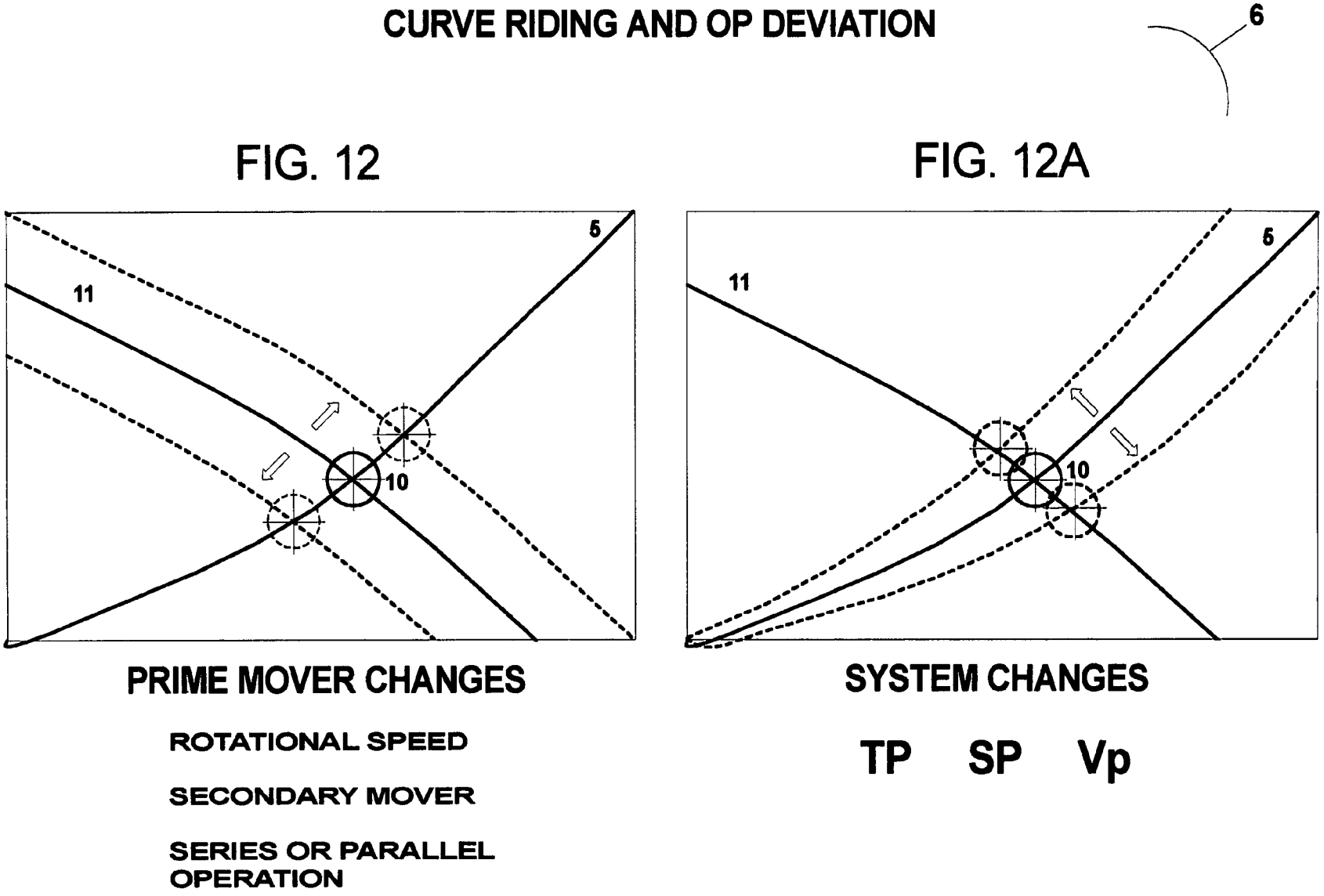
FIG. 12 depicts curve riding and OP deviation when mover changes occur and, conversely.
FIG. 12A depicts curve riding and OP deviation when system (or sub-system) changes occur.

The above point often misunderstood, the primary mover's capacity should be sized exactly for the amount of "system" 5 it is to be applied to, no more, no less. Mover 11 and system 5 are plotted against each other based on this premise being correctly established. The diversity 22 is an amount added to this that the system 5 can cope with when other parts are not in need or demand. This is why we negate that portion of the system when establishing a curve. Otherwise, the curve is misrepresented with more dimensional system 5 (length, surface area, etc.,) and, hence, a substantial deviation from the intended operating point 10 is depicted 6. FIG. 12, 12A. Also, the whole point of a diversity factor 22 is defeated if not correctly applied. Another key advantage of the said method and apparatus is its allowance of considerably higher diversities, as well as its ability to map them within a given system 5. These functions result from traversing the varying landscape the system 5 as a whole is comprised of (See section on system diversity and related claims.)

Figure 1:
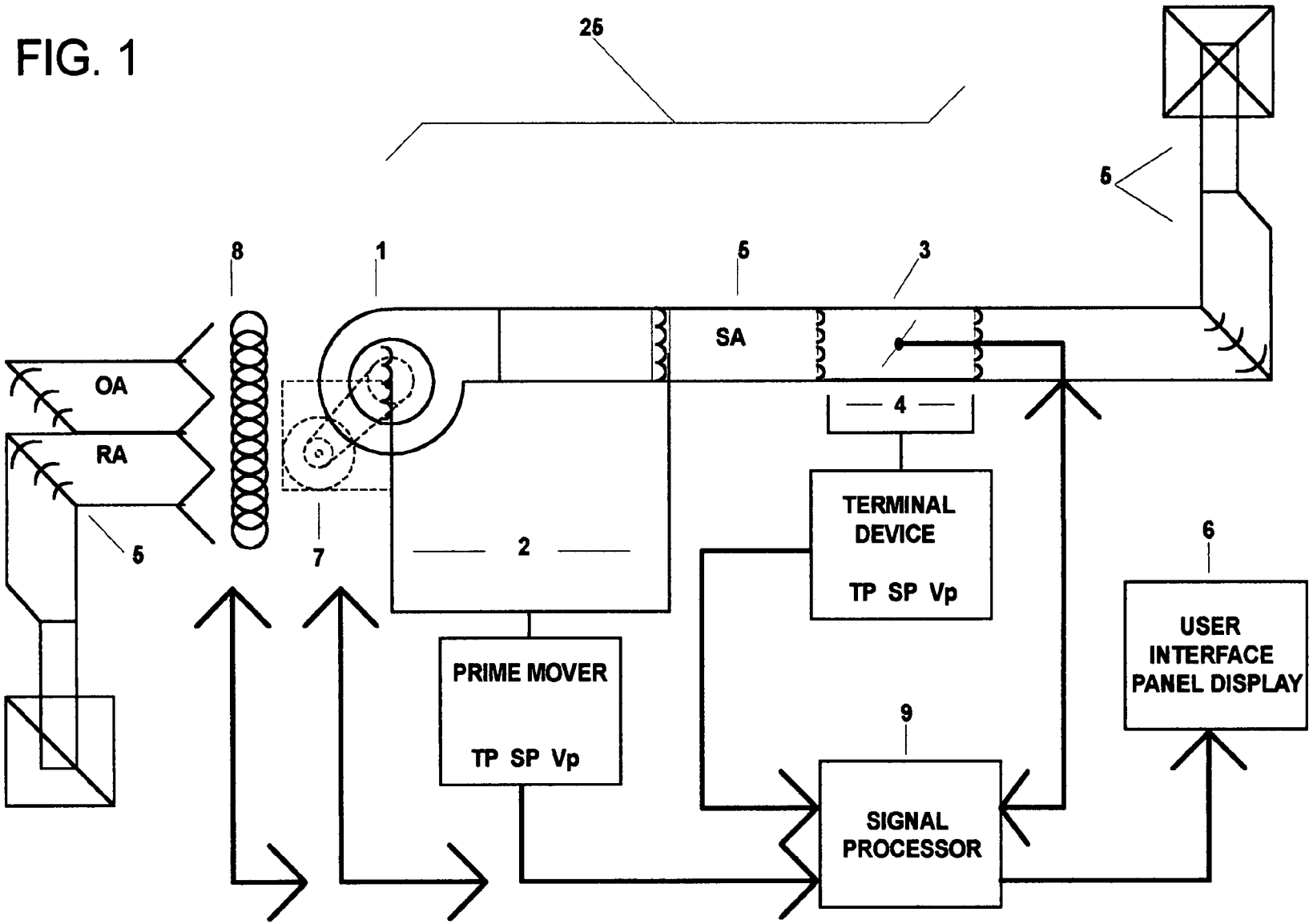
FIG. 1 depicts a schematic main overview of the method and apparatus as it might appear on a simplified HVAC distribution system with one primary mover, one terminal device, two heat exchange terminals, and return air/supply air ductwork fitted to a typically housed draw-through unit.
Figure 2:
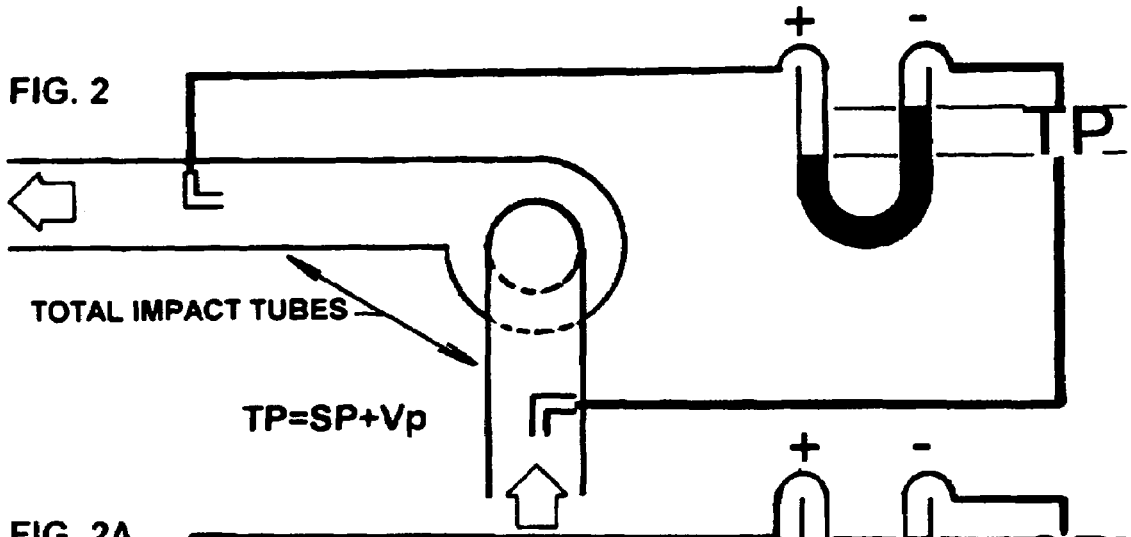
FIG. 2 depicts an "old school" rendition of how Mover Total Pressure is measured with two total impact tubes and a U-tube manometer.
Figure 2A:
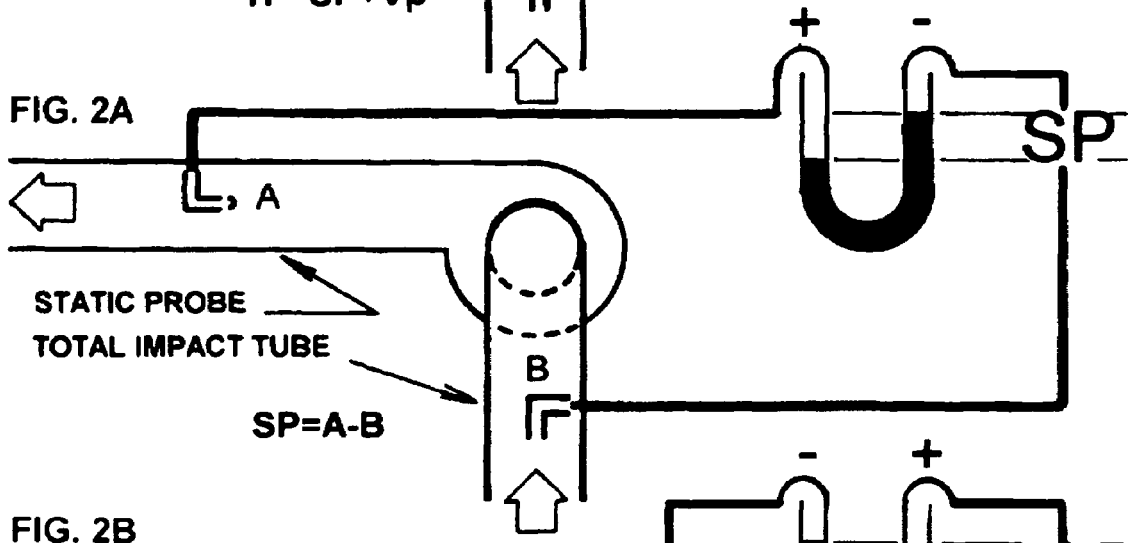
FIG. 2A depicts an "old school" rendition of how Mover Total Pressure is measured with a) a static probe and b) an impact tube, and U-tube manometer.
Figure 2B:
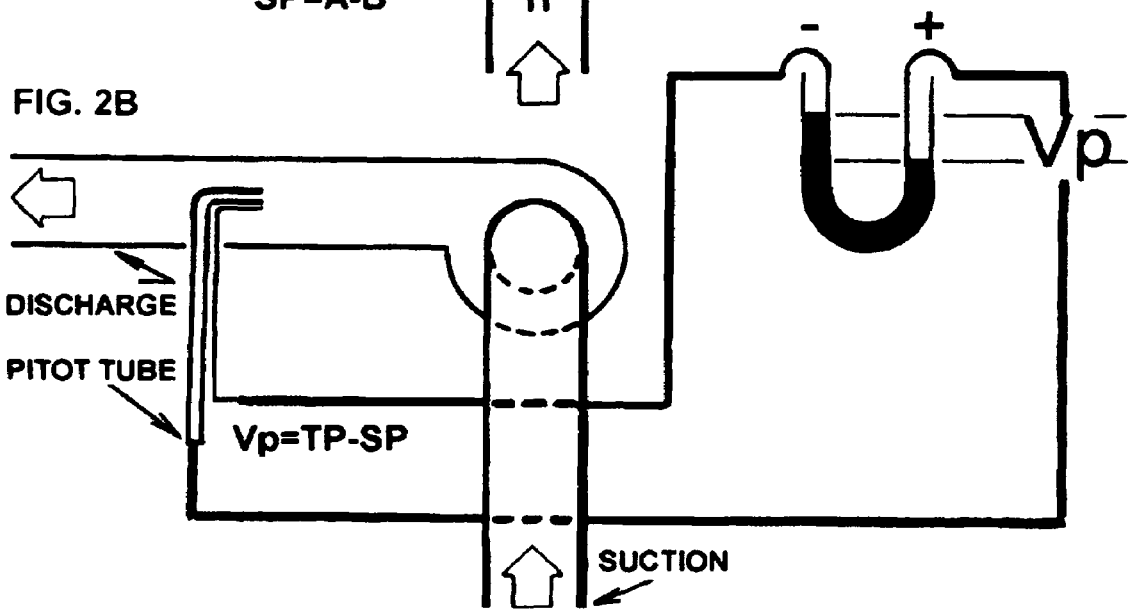
FIG. 2B depicts an "old school" rendition of how Mover Velocity Pressure is measured with a pitot tube connected to U-tube manometer.

After the above conditions are firmly established, the process resumes as follows:

1) A fan rpm reading may be taken with a photoelectric tachometer installed inside the blower housing and aimed at a reflective marker on the fan wheel. Alternatively, the FRPM reading may be taken by other means via motor control 7, etc. The motor tag data, namely Efficiency, Power Factor, HP, Volts, and Amps, will be entered as known inputs to determine 2) BHP (Brake horsepower,) through the equation: V×A×PF×EFF×1.73 (3 phase)/746. The factor of 1.73 is negated for single-phase systems. 3) A Total Static Pressure will be taken with those static sensors correctly placed laterally at the blower cabinet, facing the inlet, and at the surface discharge of the blower; this to concur with manufacturer data and terms set forth previously. The appropriately situated flow monitor station 2 will accurately establish this static reading at its sensing station, along with 4) a Total Fan CFM, all at a location where there is laminar (uniform) flow. FIG. 1

Note: The above sensing arrangement example conforms to current equipment performance data, based on Total Static Pressure, as described in Background. This is used for clarity, though all added advances of the method and apparatus, including the three-part curve analysis, are detailed subsequently.

Based on the above fundamental data, the system will attempt to establish at least three verification points that agree with projected system characteristics as specified. Mover performance is anticipated to follow the affinity laws and, if not exactly, conform to or closely parallel intended design curves, wherever their placement may be. If the fourth item deviates greatly from this framework of known characteristic operation and principles, some other unknown variable is at work in the system. The user interface system will display this as an error message and request that the problem be corrected before proceeding.

Only certain, known occurrences may distort the system curve 5 or plot one falsely. Among these known from prior testing and experience are the following: System Effect losses, as previously noted. This is a condition that will be recognized by an experienced balancer or engineer through visual inspection, followed by calculations to determine the extent of this effect, as it cannot be measured in the field with instruments or current automated control systems. However, the System Effect may be determined, or moreover, ruled out, with said method and apparatus as the description supports this added claim, particularly due to the Vp gradient in mover evaluation.

The following known phenomena could also wrongly portray the system curve: two typical blowers operating in parallel and separately ducted to one another, load shifting with one another, a little known fact which has confused system and fan curve performance in the past; another, substantial leakage or bypassed flow within packaged unit housings, this being the minor concern. In any case, both are highly unlikely and a greater concern with outdated existing systems quickly being replaced. Another confusing factor may be poor instrument or flow sensor calibration (instrument inaccuracy,) leakage within near-obsolete dual duct (dual deck systems,) significant leakage in general, and other oddities that may be prevented with proper care, maintenance, and standard procedure as set forth by the certified balancing process of such systems.

A certified balancing firm ascertains flow-pressure rates with their own regularly calibrated instrumentation and this sets the record in agreement with properly installed flow-pressure sensors and hardware at the outset of a project. The described method and apparatus will be in agreement with this standard testing procedure. Any more obvious discrepancies such as motor belt-drive adjustment, alignment, motor power, slippage, or unit sizing will become immediately apparent simply through following these processes, one way or another, whether by field inspection or automated feedback from the method and apparatus.

This is where the role of a Testing and Balancing Supervisor is central. In conducting their own independent testing, the balancing agency will first confirm the collected field data with timely calibrated instrumentation. This will correct any calibration problems or more obvious logistical problems stemming from installation of the system, and most commonly resulting from simple equipment scheduling conflicts. After a certified balancing firm has followed their standard procedure correctly, all items affecting these systems will be covered as they follow the initial procedures outlined here.

Figure 3:
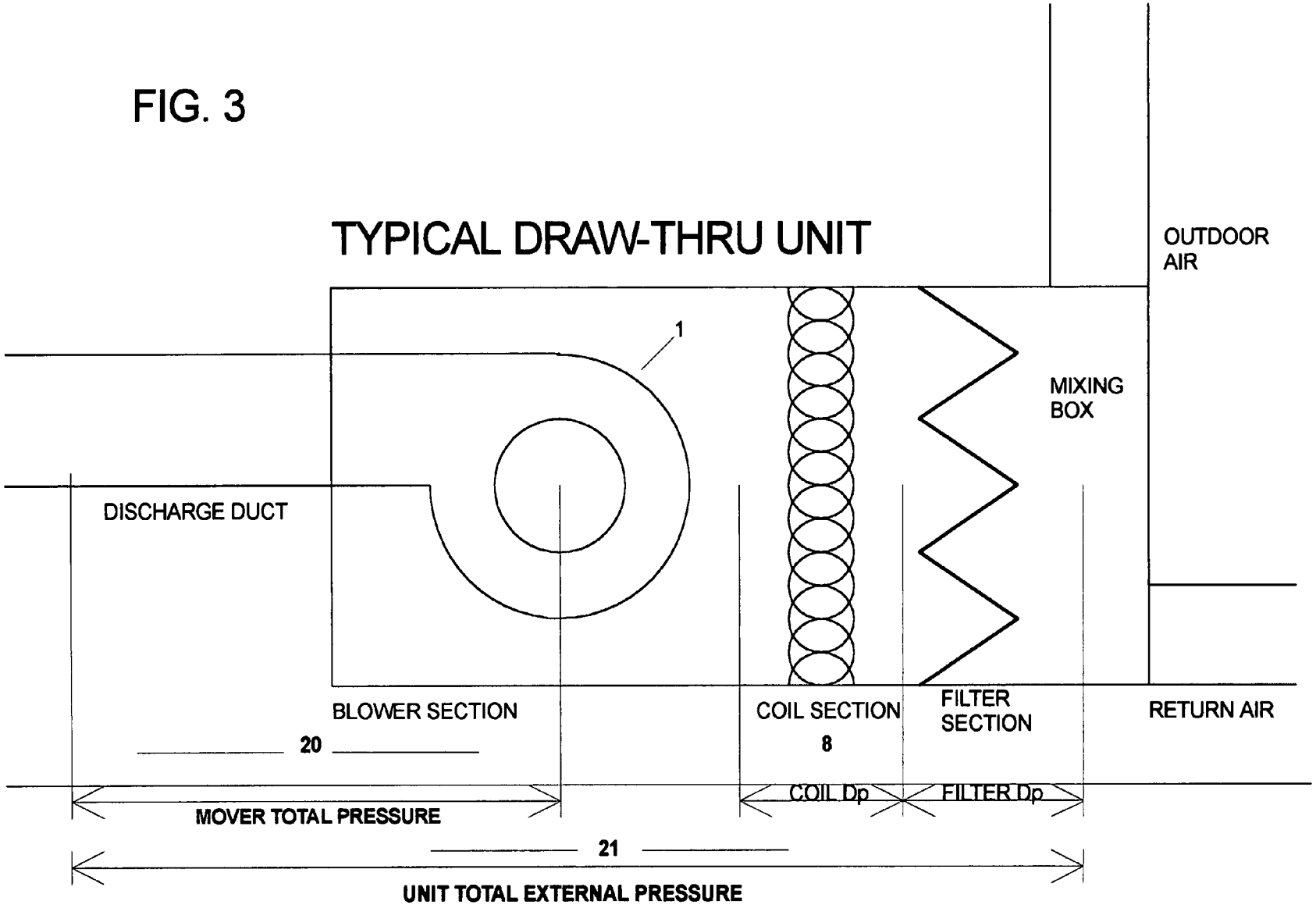
FIG. 3 shows a schematic illustration profiling a typical draw-through unit and its internal components with a breakdown of TSP (Total Static Pressure,) TESP (Total External Static Pressure,) Filter pressure drop, and Coil pressure drop.
Figure 4:
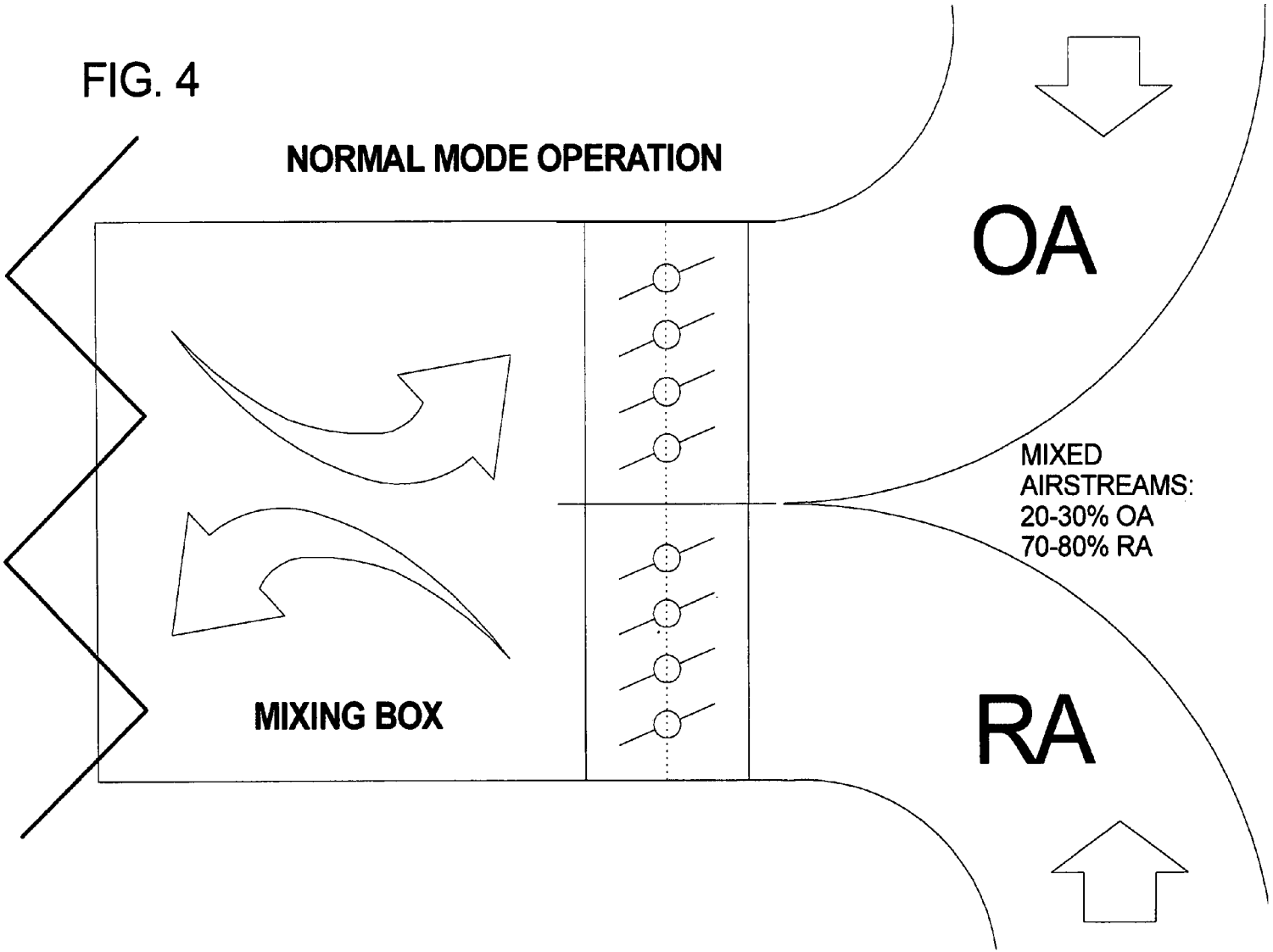
FIG. 4 depicts an enlarged view of a mixing box with mixed airstreams and damper control in Normal Mode Operation
Figure 4A:
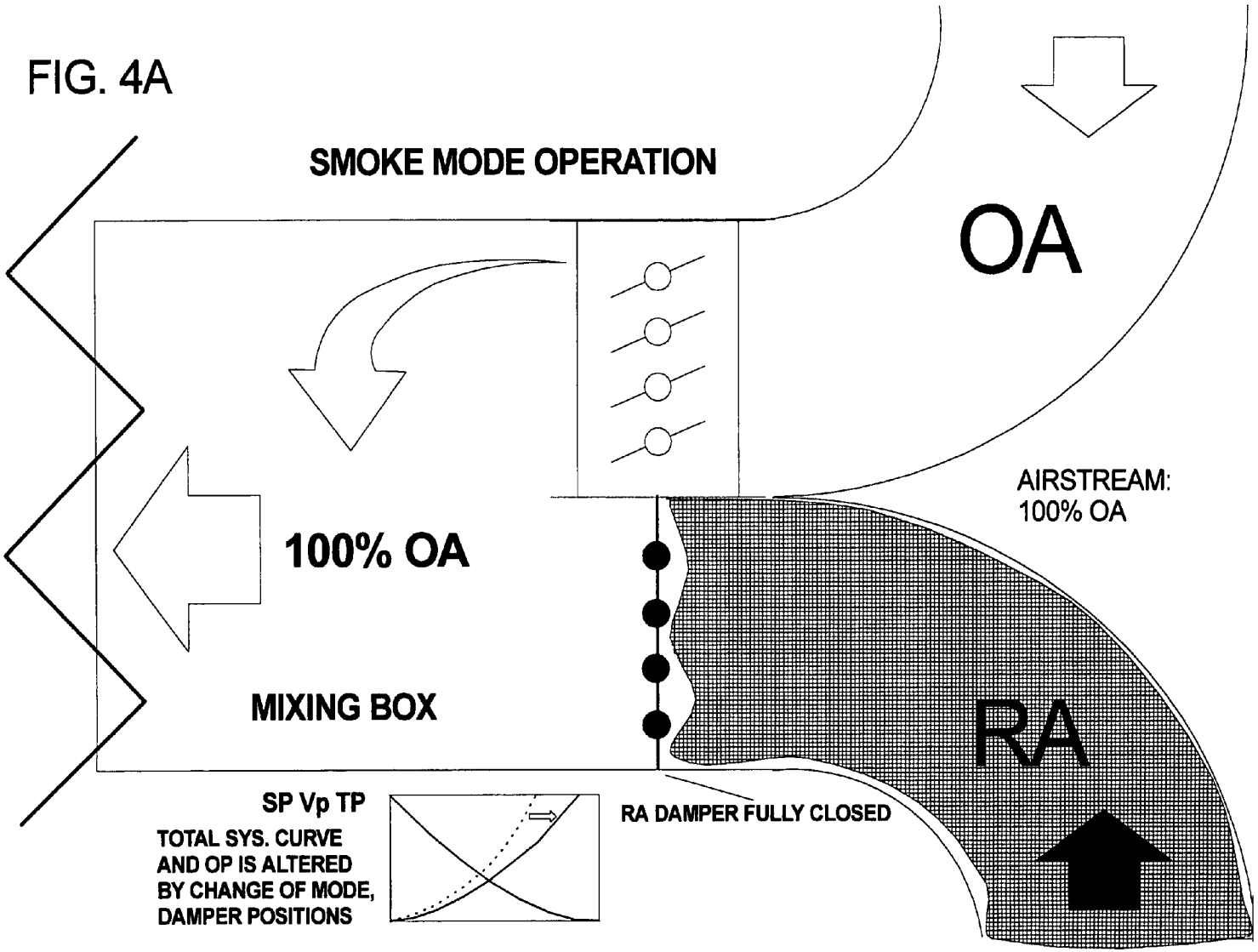
FIG. 4A depicts the same mixing box with 100% OA (Outdoor Air) and 0% RA (Return Air) as seen in Smoke Mode operation, along with a Total System Curve window reflecting SP, Vp, TP changes and OP (Operating Point) deviation.
Figure 9A:
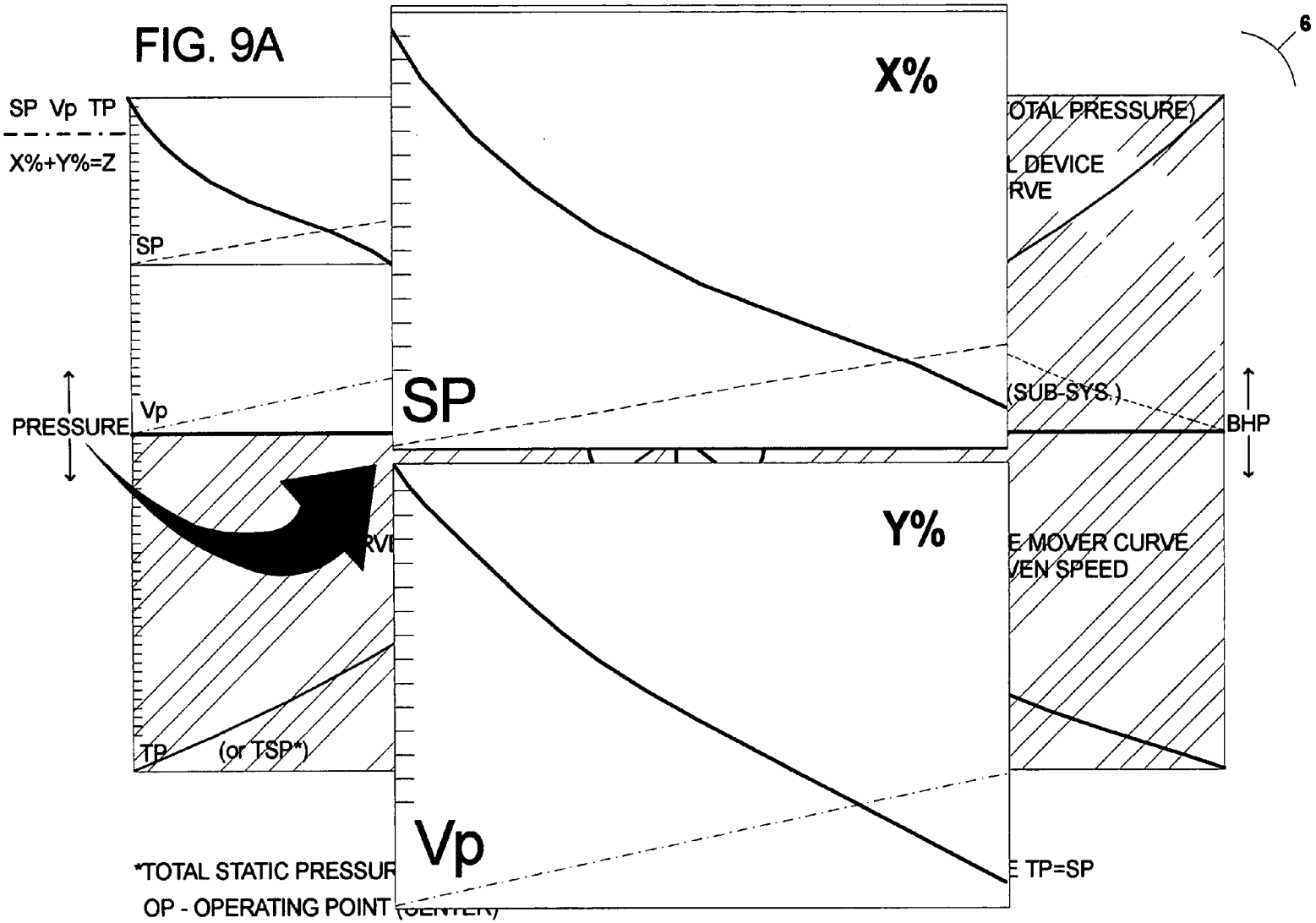
FIG. 9A is a blow-up view of the SP and Vp curves individually, along with the mover/system constants they are plotted against. Also shown are variable X % and Y % content, these comprising Z (or Total Pressure.)
Figure 9B:
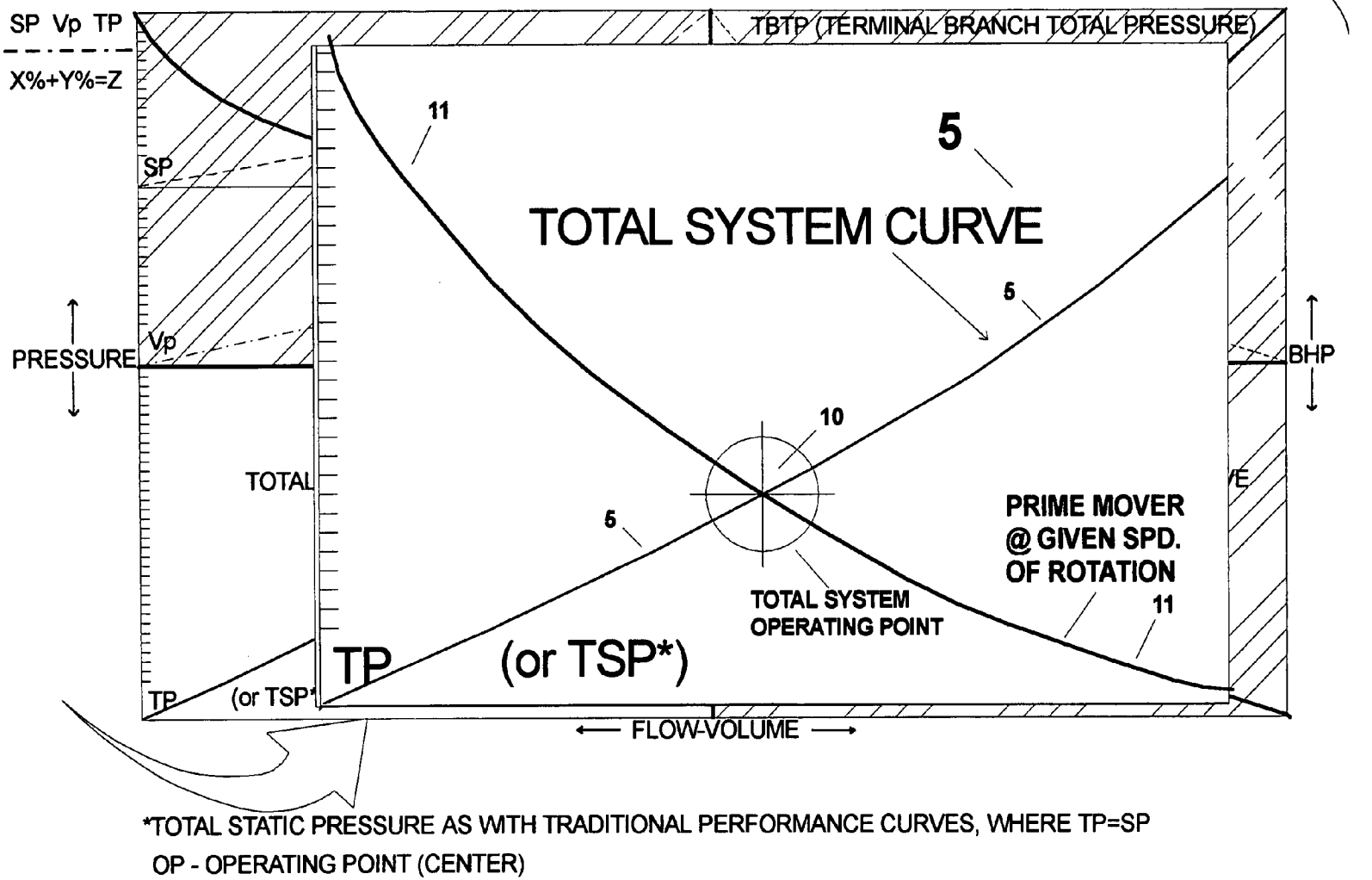
FIG. 9B is a blow-up view of the Total System Curve plotted with TP (Total Pressure) sensor logic against the primary mover. Total system OP also shown in cross hairs.

The flow monitor station 2 will also supply additional data underlying the theme of the isolated velocity gradient and static gradient as separate analytical elements, here comprising the total pressure and effective power which will be made available to the remainder of the system downstream Aside from establishing total capacity (CFM) and Total Static Pressure, the station will also perform these functions as illustrated in FIGS. 9, 9A, and 9B. Additionally, the static pressure profile, as previously described, will be displayed with the overall system diagram as shown in FIGS. 1 and 3.

This will permit further, more detailed analysis of the air stream across its full path of flow from suction to discharge of the air-handling unit itself, namely to determine any deficiencies which may be caused by localized effects, such as filter loading or coil fin clogging and other such obstacles within the housing which may cause unusually high losses of a dynamic and/or static nature. When the profile is in question, it is understood that this be an SP (Static Pressure) profile, since using sensors only of this type are practical considering the logistics of unit housing. This may only require a single point reading in a normal enclosure, though an equal area average will be recommended when used in housings with unusual internal components that may created turbulence or eddy currents with air pockets.

If determining dynamic losses within a mover housing is desired, however, this may offer a lab use application, namely for the manufacturer to catalogue known dynamic losses at given pressure drops under pre-determined lab conditions. Note that static pressure drops alone are not indicative of flow rates through a known device (active or passive) in an unknown system, though this is one of many problems solved with the said method and apparatus, as set forth. The method and apparatus may also deduce that any static gain relative to total losses is indicative of a dynamic loss, and assess its specific content: TP−SP=Vp; % Vp of TP.

A Distinction of Uses: Lab Use Versus Field Use

Lab Use: Wide Open Curve

Figure 14:
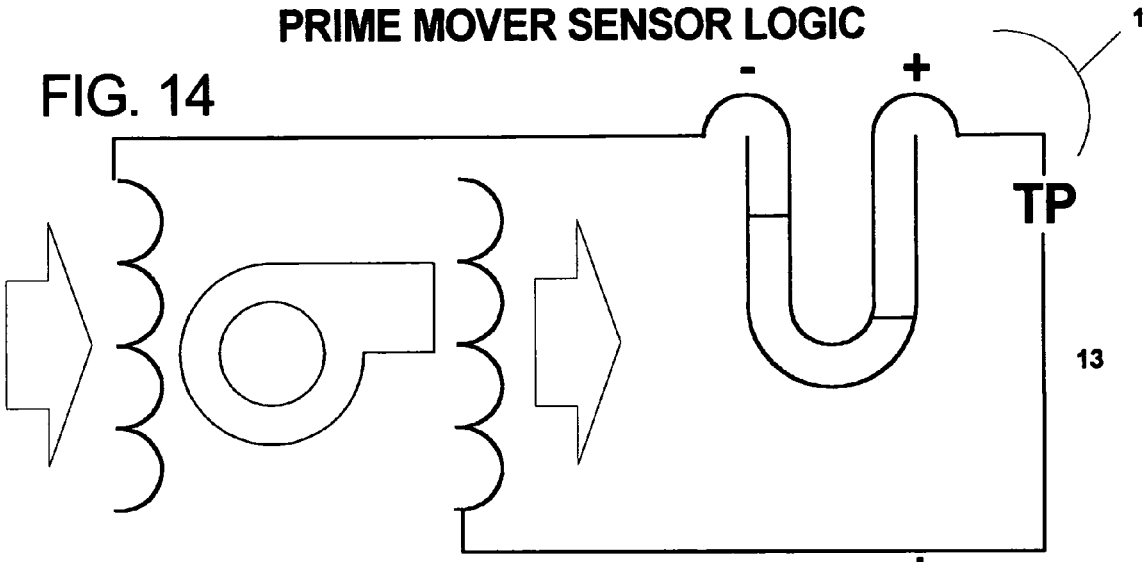
FIG. 14 depicts Primary Mover sensor logic as employed by the method and apparatus to measure Mover TP.
Figure 14A:
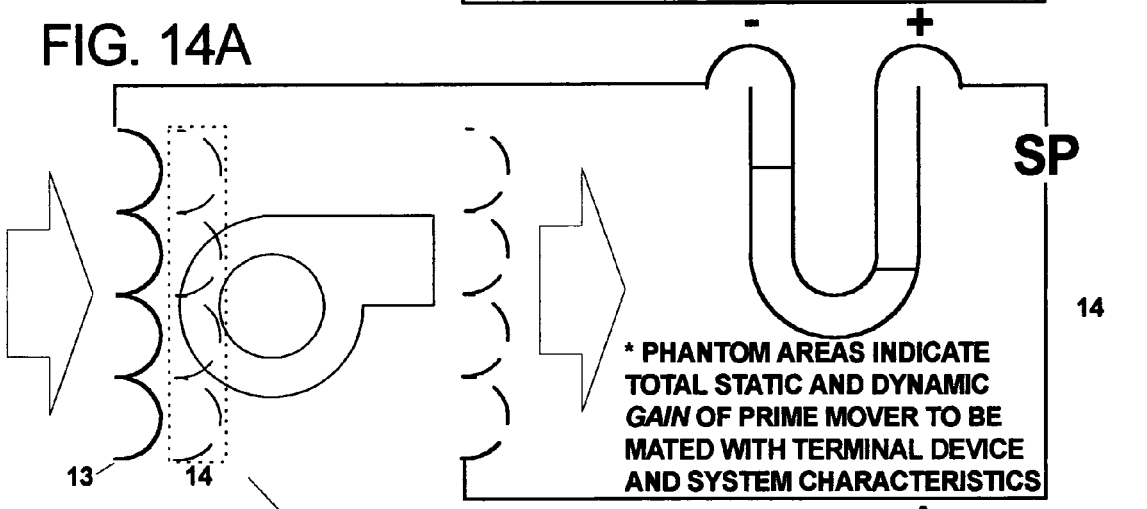
FIG. 14A depicts Primary Mover sensor logic as employed by the method and apparatus to measure Mover SP with an optional attachment (sensor grid) for packaged, housed, or otherwise fitted movers under field or existing conditions.
Figure 14B:
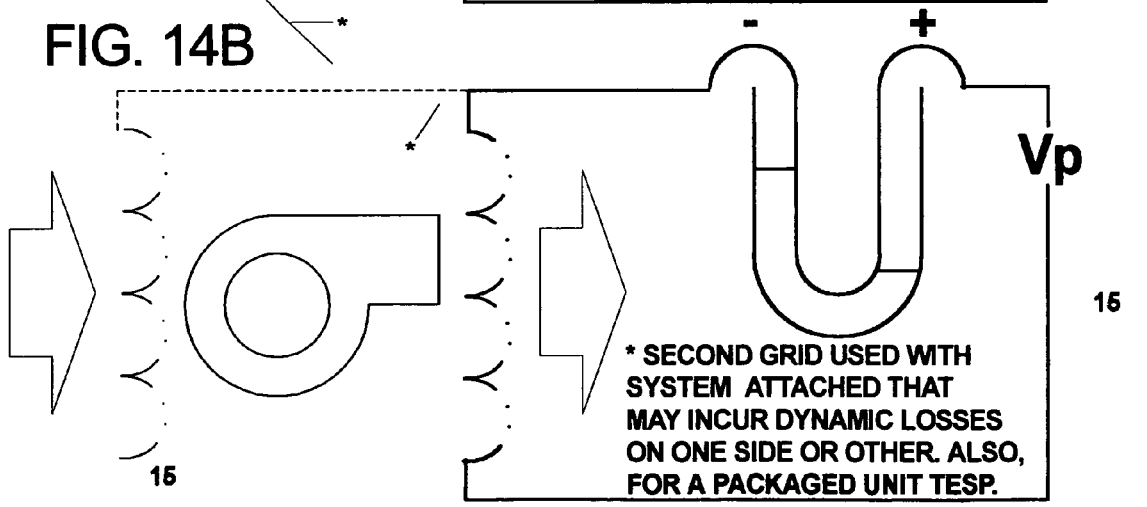
FIG. 14B depicts Primary Mover sensor logic as employed by the method and apparatus to measure Mover Vp with an optional attachment (sensor grid) for packaged, housed, or otherwise fitted movers under field or existing conditions.

To begin with, a "wide open" test can be conducted under defined lab conditions. Note the typical "wide open" fan curve in FIG. 6, and the added options presented in FIG. 6A This utility is the one that will use a three-fold method of assessing mover characteristics for tabulation or cataloguing purposes. The procedure will employ the base concepts of Fan Total, Fan Total Static, and Fan Velocity Pressures as illustrated in FIGS. 14, 14A, and 14B. Also refer to the main sensor logic layout in FIG. 13.

This arrangement will utilize three distinct sensor grids: 1) a total impact grid 13, 2) a static pressure grid 14, 3) a velocity pressure grid 15, this simply being a differential of the previous two averaged signals, though a separate grid avoids any additional losses caused by T-fittings or other "tap-ins" from the other two grids that may distort the signal and produce an unacceptable standard of testing. Obviously, this lab use variation of the method and apparatus is best suited to a lab arrangement, where grids (sensing elements) can be removed and installed independently for each separate performance curve.

The test conditions must be made relative to atmosphere, and with any appropriate corrections made for other than standard air (70 F, Cp=0.24, sea level, 29.92 Hg.) Again, Vp is a positive reading taken in a closed signal loop (High to Low on a micro-manometer,) moving in any direction, but TP and SP are both either positive or negative, and relative to open atmosphere. Therefore, the manometer High or Low connection (depending on whether the air stream is discharge or suction) is to be taken in lieu of a tainted building envelope.

The mover itself must also be in a location that is in perfect balance or constant volume neutrality, wherein outdoor air entering a building envelope equals exhausted air. If testing a non-ducted blower inlet, the discharge is usually ducted to its "100% effective length" to develop laminar flow and some form of static power by way of enclosure on the discharge side, as suggested by AMCA standards of testing. The described method and apparatus allows for this form or any other form of testing, with or without fittings attached as outlined by current methods. Note optional sensor grid arrangements in FIGS. 14A and 14B.

The readings can be made with test instruments, such as micro-manometers in certified calibration or a classic U-tube manometer, which requires none.

The arrangement intended for establishing mover characteristics at any percentage of "wide open" flow will answer the following key questions:

Q: How much of a total impact gain did this unit generate in of itself?

Q: How much of the total gain is in the form of SP (Static Pressure?) %

Q: How much of the total gain is in the form of Vp (Velocity Pressure?) %

A Vp/SP ratio or SP/Vp ratio may also be expressed as factors: Vp Factor. SP Factor. This data can then be used in coefficients and friction loss tabulation.

The above method and apparatus will provide indispensable engineering or "lab conditions" test data and is not the same as the arrangement in the installed version, as it may not be practical to have this three-fold sensor arrangement in a field version, let alone remove or replace sensor grids. For all intents and purposes, the above description is only necessary to establish comprehensive and official certified data for a catalogued device. And once this is done, the mover is of known characteristics and its performance can then be accurately predicted with simplified sensing devices in field use.

Measurements will be taken from inlet to outlet of said mover to illustrate the gain occurring during the air-fluid's path before and after encountering the mover at its full speed of rotation, namely driven RPM, where there is a drive involved 7, as opposed to direct drive, or other rotational speed as arbitrarily set. This will be useful for design considerations among many other uses. Following this initial orientation, a three-part performance curve comprised of TP, SP, and Vp will be plotted across the full range of rotation (fan RPM,) whether this is achieved by means of drive (pulley) adjustment, VFD (Variable Frequency Drive,) or any form of variable/multi-speed control 7.

The "percentages of content," a term traditionally used in reference to mixed airstreams, will be determined: SP and Vp of TP. Namely, the Velocity Factor or Gradient of this content will be the key consideration in high velocity applications or systems and what remains is in the form of static pressure, or Static Factor. The latter would apply to high pressure-type applications and systems. Useful ratios will be noted, from percent closure to maximum/minimum flow capacity. Total Gains and Specific Gains, changes, losses, valuable characteristics can be viewed 6 entirely across the plotted full range of motion (fan speed or % of wide open flow,) with the ability to "interlock" all desired characteristics and constants for viewing consideration for their ultimate effect on the system whole.

The main panel display and user interface 6, made up of key components, may produce real or virtual testing by locking in the desired characteristics and obtaining all needed data required to build the ideal system 5, down to the very drive and pulley sizing required to do so. This process may begin as early as in the design stage all the way through to "as-built" status.

Figure 5:
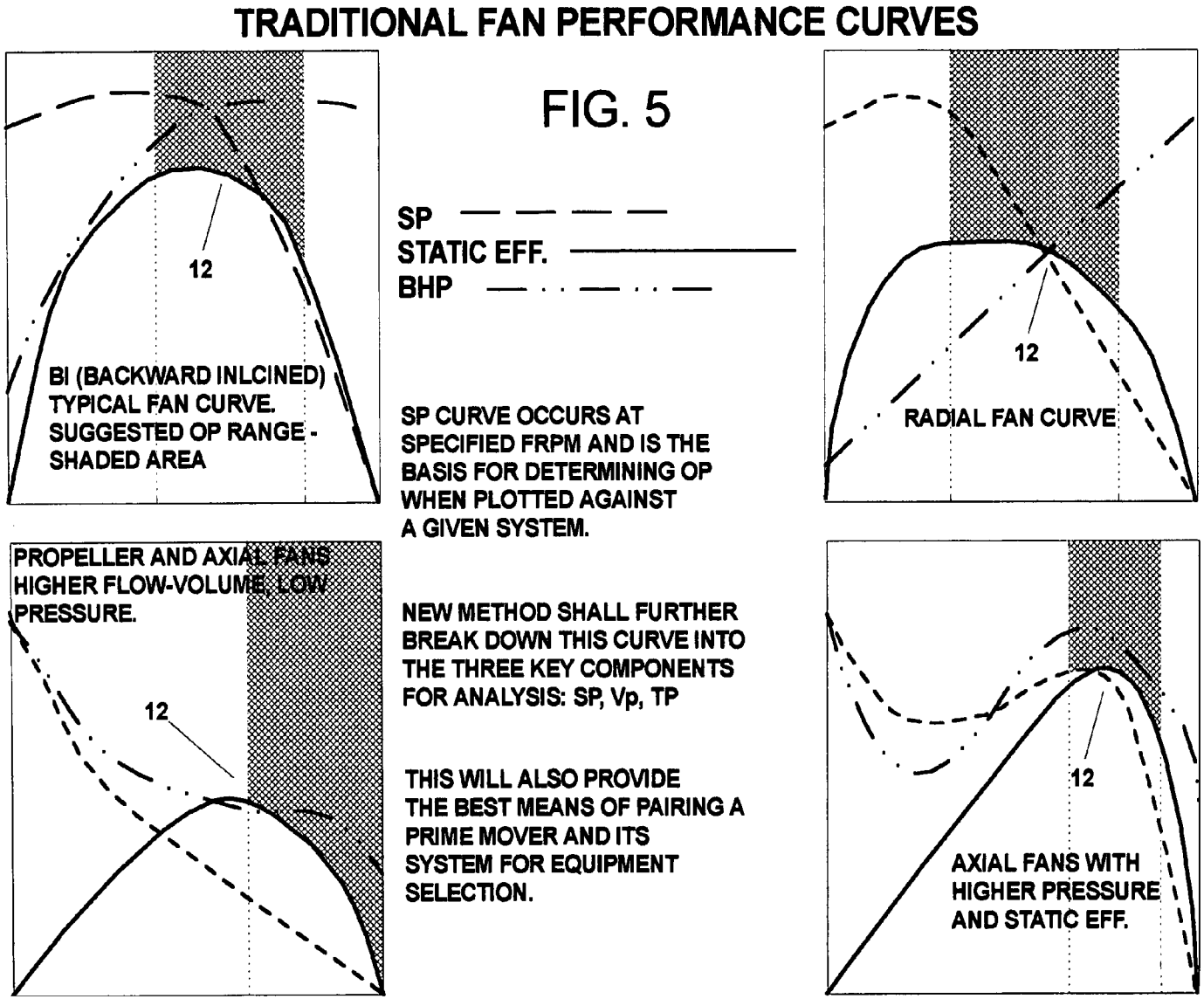
FIG. 5 depicts traditional fan performance curves of four different types.
Figure 6:
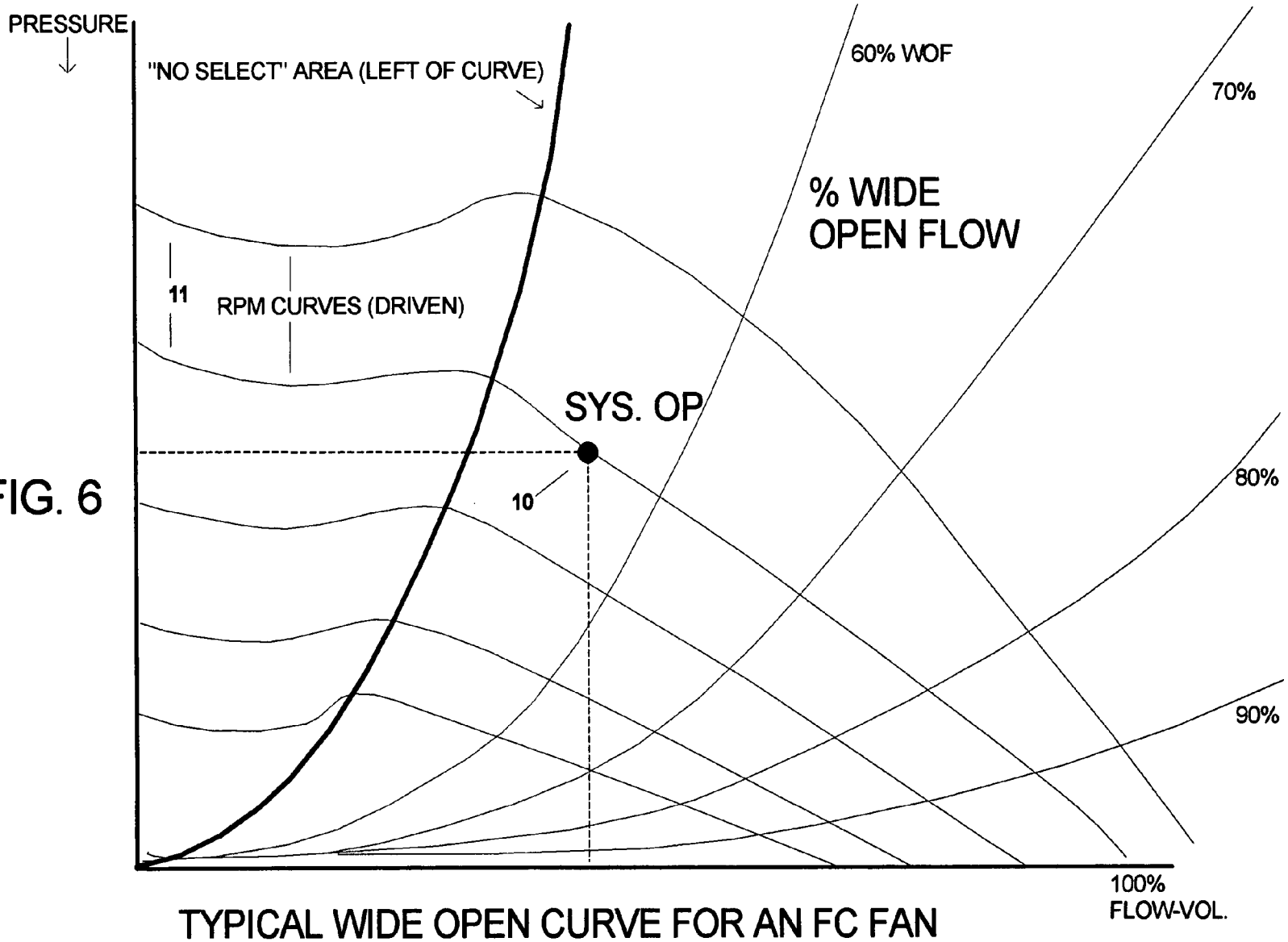
FIG. 6 depicts a typical "wide open" curve for an FC (Forward Curved) fan with a suggested system operating point shown.

Alternatively, traditional blower characteristic curves, such as those shown in FIG. 5, may also be plotted, though these may be found to be less useful, if not irrelevant within the context of a given real and articulated system connected thereto owed to current limitations of stock sizing and the "static" projection of such a system's "would be" performance based only on percentage of some damper closure. The key elements will be displayed 6, however, with the TP, SP, Vp gradient curves opted for, along with BHP curves plotted on the right side of the curve display, noting that these vary greatly with various mover 1 types. Most notably, centrifugal-type movers experience their lowest BHP at full closure while, conversely, axial or positive displacement movers experience their highest BHP at full closure or "no flow" shut-off head. This latter point again emphasizes that any obstruction to the velocity gradient or its proponents within a system is counter-productive. As described, BHP is plotted from electrical data obtained from the motor 7 that powers the mover 1, namely its Voltage, Amperage, Power Factor, and Efficiency. This is plotted along with all other gradients across the full range of closure and mover rotation. FIG. 6, 6A.

In summary, the described method and apparatus will establish a comprehensive evaluation of all mover 1 characteristics, its values or lack thereof, in full scope of operation, within or without the context of a connected system 5. This, in turn, will establish the best suited operating range, or point of greatest SP/Vp throughput gain for the given mover. Most movers have a "no select" performance zone, roughly defined as anywhere below 40% of wide open flow, where flow characteristics are deemed unpredictable enough to preclude reliable equipment selection below this point. Wide Open Fan Curves will clearly delineate this boundary in cataloguing.

The method and apparatus can also be employed to determine which system 5 or type of system (vessel or conduit of air-fluid delivery) is best suited to that specific type of mover 1 for the desired application by mating the given mover to its ideal system in every measurable degree. This automated pairing of mover to system, and vice versa, along with being a mover-system design and selection tool, presents additional claims.

Again, alternate functions may be served with or without a "blow-through" or "draw-through" system attached. Also, it should be noted that a blower alone is not a packaged system, but merely an atmosphere exposed "wide open" system that is tested under agreed upon standards, such as those established by AMCA. The Wide Open Curve will show the recommended operating percentage of closure, although the optional sensor arrangements shown in FIGS. 14A and 14B may be used to test an already packaged or fitted unit within or without a complete system 5.

This condition becomes understood when a packaged system is placed in the typical fan housing cabinet, along with any throttling that occurs beyond that point by means of main dampers, vortex blades, mixing boxes, etc. Again, the effect of atmospheric pressure bearing down on the inlet (+14.696 PSIA absolute,) such as would be created under wide open testing of a mover, will not be the same once enclosed and operating within a building envelope, especially where an open plenum (non-ducted) return is involved. Building pressurization will compromise the test area. These or any such biased conditions should be noted, controlled, and parlayed with consistency through to the mover's final packaging and application in the field.

Finally, after the mover's "wide open" characteristics are evaluated using the described method and apparatus, the process may be continued through to a packaged system, where the TP curve is replaced by TSP or TESP (refer to FIG. 1 and FIG. 3.) in any other form, delineation, or combination.

Field Use

Under field conditions testing of an "as-built" system, best results will be achieved if the said method and apparatus was used from origination. If this is not the case, "aftermarket" components may be installed as a retrofitted option. For example, necessary key system components may be fitted with some or all of the sensor grids 13, 14, 15 or equivalent inlet/outlet-only sensing arrangements, along with the user interface, which may be as large as an entire building management system 6, or as small as a localized push-button display panel 6.

In any case, utilizing the method and apparatus according to specifications will produce far superior results than traditional methods of sensor control currently in use, particularly with proper calibration using the same procedures outlined here.

Again, the TSP, SP profile, and resulting TESP will be the main concerns in field use with an existing system. First, maximum load conditions as described in "Background" are clearly established. The initial start-up procedure then follows, as outlined in the section: "Initial Operating Point of System Total and Primary Mover"

Subsequently, many unknowns may be determined. For example, a known mover 1 with an unknown system 5 attached may be evaluated, or vice versa. Once mover characteristics 11 alone are established, then the true operating point 10 of an unknown system connected to that mover may also be established. FIG. 7. This added function presents additional claims on the method and apparatus.

Hydronic and Fluid Pumping Variations

Unlike air and gas systems, hydronics or heavy fluid systems will have key differences as follows. The primary concerns will be TDH (Total Dynamic Head), NPSH (Net Positive Suction Head), suction lift in open systems, maintaining a water level datum line in open system basins, and having adequate fluid in either type of system to reach the highest point of the given system without any entrained air. The key breakdown of hydronics terms: dynamic heads (velocity head pressures—dynamic discharge and dynamic suction head) or static heads (weight or pull of a length of water column in the form of either static suction head, static suction lift in open systems, or static discharge head.) The other determining factor in hydronics pump sizing is piping friction losses.

Open and Closed Systems

Total Dynamic Head is the fluid equivalent of Total Static Pressure in modern blower performance curves and for all intents and purposes establishes total power generated by the primary mover 1. It is measured as a differential of suction and discharge (dynamic) forces produced by the working pump, preferably by one differential gauge connected to do so. The measuring unit is Ft/HD (Feet of Head) for pumps and terminal, in-line units, and inches of water for calibrated balancing valves, or "circuit setters." PSI gauges are often connected anywhere taps or gauge cocks are located in the system and are then converted to Feet of Water units as required for monitoring basic pressure drops at critical points of the system, such as makeup water or bypass junctures.

Open systems require more critical monitoring, particularly those having elevated pump centerlines and, hence, static suction lift due to elevation. In hydronics mover selection, suction lift is added in total pumping head required in this type of system, including piping friction losses and static discharge head. This is done rather than figuring a difference of the two heads as in systems having both sides, supply and return, elevated above the pump centerline, open or closed inclusive. In the latter case, the elevated piping systems have the closed, connected water columns bearing down upon them and these forces are hence, negated, from the pumping total power, plus piping friction losses.

Unlike raised piping systems, having a suction head makes it more difficult to maintain an adequate Net Positive Suction Head in open systems. Maintaining water levels at cooling tower basins are also a prime concern with open systems, as if they drop, vortexing can occur at the basin and possibly cavitate the suction side of the tower's pump with entrained air. These are not concerns with closed systems. Some common problems they do share, however, are the following: air entrainment. Having air vented from the systems at crucial points to prevent damage due to entrained air entering the pump casing is critical. Having an adequate water level in the whole system, as determined by a "pump-off" PSI (converted to feet) as a direct indication of actual height from the pump centerline to the highest terminal point of the system. The expansion tank or compression tank is another key component that handles any volumetric changes due to temperature/density and air entrainment that might damage the system as well. The tank generally needs protection against a condition known as "water logging" when managing air entrainment and volumetric changes in the system.

Aside from these variations, the lab and field condition testing procedures outlined in air systems apply as well with hydronics or fluid sensing elements using the same basic principles. Dynamic flow or Velocity Head in heavier, less compressible fluids, however, has been all but negated entirely for practical design considerations (from a design perspective,) though lighter fluids and mixtures may reap a greater advantage from establishing the velocity gradient, along with the Static Head (or Pumping Head) content, especially since large demands are made on brake horsepower and, thus, total power (kilowatts) where high static heads (or pressures) are applied too liberally. Terminal devices, however, in either air or fluid systems, are velocity-oriented when plotting flow curves and may show more relevance in this area where practical field or lab considerations come into play; the prevalent point here being that neither factor be neglected throughout the given system.

As with air movers, high and low-pressure type pumps are available as well. Low pressure types (positive displacement pumps) are seldom used, centrifugal being the most widely used in most commercial/industrial pumping applications. The former have other specialized uses, such as in scroll or screw-type compressors and engines moving gas or other light fluid mixtures. In this context, however, positive displacement pumps present problems to hydronics systems, which are inherently pressure-oriented. These pumps are pressure constant and cannot deal with sudden or extreme pressure changes, like being throttled at their discharge or suction side, or having automatic two-way valves in a system close down on low demand. They can be seriously damaged this way, and when they are used, many employ a differential bypass sensor to counter this effect, directly bypassing flow from inlet to outlet of the pump. They generally produce a steep performance curve, while flatter curved pumps (typically centrifugal) are desirable for most applications where pressure drops are to be kept relatively equal at all piping loops, particularly around the equipment room, where heat exchangers, the expansion tank, and other key components of the system are located. Differential sensors (velocity oriented) are also used in normal hydronics systems to maintain constant flow through the pump, chiller/boiler (heat exchanger,) and other key equipment while piping sub-circuits fluctuate in their own pressure drops under the varying conditions of automatic control.

After all entrained air has been removed and all strainers cleaned to bring the system to normal functioning status through normal start-up by an installing contractor, the procedure for establishing performance characteristics is begun. This parallels the blower's sequence of steps and the testing and balancing procedure therewith, with the key differences illustrated in FIG. 22A, a hydronics system flow chart.

The pumping affinity laws are basically the same for head (pressure) flow and BHP relationships, the major difference being that flow and pressure increase with an increase in impeller diameter, directly in relation to flow and squared to pressure ratios; whereas fan rpm (rotation) 11 is the key difference with air systems, though driver pulley adjustments parallel this as well: an increase in sheave size (pitch diameter) equals direct increase in flow by increasing fan RPM 11.

The other notable difference in a hydronics system is that as Total Dynamic Head (a velocity head) goes down for a given system, flow (GPM) goes up, whereas in a given air system a higher velocity pressure will always signify higher flow-volume (CFM,) whether at the primary mover or terminal flow device. This hydronics contingent, however, is based on the context of a given piping system, one that has much less friction loss than designed for and, thus, more free flow. This is quite common since many safety factors are employed in hydronics systems design.

One source of confusion in both systems perhaps stems from equating a velocity head or pressure with a pressure drop, also a differential measurement, often wrongly ascribed as a measurement of velocity. This may be delineated from the inlet to the outlet of a terminal or in-line device, or the given distance across which force is applied. A flow metering process may arise from using the known pressure drop of a device, for example to establish a Cv, though this is not a method of determining any kind of true velocity change the fluid is undergoing aside from a known device in a known context. Therefore, this idea follows out of contingency, not necessity. And certainly, this is not a Velocity Pressure (Vp) in the true sense, though it has often been misconstrued as such in many a practice. Again, the key understanding involves which unit of measurement is accepted and agreed upon for a given, known system whose performance characteristics were established based on those same principles.

Whatever type of mover, air or hydronics, the units and methods of establishing, then parlaying their performance are used perhaps because they best suit the current packaging and context they are most used in, as explained previously with packaged systems. Also, a mover 1 is an active device, while a terminal device 3 is a passive device. The active device generates continual applied force and the differential is one created by the input and output forces of the mover, from rear to front.

The terminal device 3 passively accepts the applied force and only creates loss of Total Power in the form of both Static and Velocity pressure, and not in equal measure. Above all, the terminal device's pressure drop alone is not a measure of velocity and static content, though its "total drop" and "specific drop" will be relevant in surmounting its total losses as a passive device. Delineating this measure of forces from primary mover 1 to terminal flow devices 3 sets the framework for determining which movers 1, terminal devices 3, and systems 5 are best suited for one another and how they react to one another.

The method and apparatus for general applications also complements the standard procedures for those skilled in the art of hydronics engineering or balancing:

General Use

A performance curve is plotted at "wide open" flow, or with a given known or unknown system attached, from zero flow at TDH to full flow at zero head. This also establishes the impeller diameter, assuming equipment selection is consistent with submittal data The remaining procedure of said method and apparatus follows the same guidelines for air system movers and terminal devices, with exceptions duly noted in this specification.

A Closed System

A closed system is less concerned with atmospheric pressure or makeup water, only that there is an adequate amount to fill the system without any entrained air. The TDH is normally a velocity head differential, dynamic discharge head minus dynamic suction head. I.e., nothing is added to account for static suction lift, as the close-piped returning loop equalizes the forces.

An Open System

A system open to atmosphere must maintain a water basin level at a given datum line to provide adequate static head and prevent cavitation on the suction side of the cooling tower pump. In order to do this, makeup water must be introduced through a regulated valve and flow sensor (Terminal Devices.)

The other key concern with the open system arises if there is suction static head below the pump centerline. This most often requires a much larger primary mover because the static suction lift, discharge static head, plus piping friction losses on both sides are added together, resulting in a much larger, higher pressure-producing pump being necessitated. This arrangement is mostly avoided in real systems, though logistically necessary in some cases.

Primary and Terminal Coil Heat Exchange

Heat exchange may be monitored at every juncture in a distribution system at which is placed a heat exchanger 8 in some form or another. Regarding air to water exchangers, such as that shown in FIG. 8, heat transfer characteristics may be determined using the following equations, Q representing heat flow rate in BTUH (British Thermal Units/Hour):

$$Qs(\text{sensible})=1.08\times CFM\times DT(\text{air side dry bulb})$$

$$Qt(\text{total})=4.5\times CFM\times DH(\text{enthalpy differential from air side wet bulb: } H1-H2)$$

$$Qt(\text{total})=500\times GPM\times DT(\text{water side})$$

$$Ql(\text{latent})=Qt-Qs$$

And for other than standard air and water:

$$\text{Air or gas: } Qt=60\times d\times CFM\times DH(\text{enthalpy diff.-from wet bulb.})$$

$$Qs=60\times Cp\times d\times DT(\text{air side-dry bulb in F.})$$

$$\text{Water: } Qt=60\times Cp\times d\times GPM\times DT(\text{water side})$$

$$\text{Thermal Fluids: } Qt=GPM\times SG\times 500\times Cp\times DT(\text{fluid side})$$

Note: Fluid or gas mixtures, such as glycol solution with an arbitrary percentage of content would have their own flow charts or tables that provide correction factors for Cp (specific heat) and d (density) or SG (specific gravity) with the equation above for thermal fluids or aqueous solutions. These figures would vary based on the temperature of and percent mixture of the solutions.

D=Delta (referring to temperature or enthalpy differential)

H=Enthalpy, as read from a psychrometric chart from corresponding wet bulb reading.

Qt=Total heat flow

Qs=Sensible heat flow

SG=Specific Gravity

Cp=Specific Heat

Note: Q sensible is used for heating only mode operation and Q total for chilled water/liquid cooling. Latent flow may be used to determine a ratio of air moisture content (total/latent) and may be used to determine grains/lb or lb/lb of moisture on a psychrometric chart or tabulated data with the following equations:

$$Q=4840\times \text{cfm}\times DW(\text{pounds of moisture})$$

$$Q=0.69\times \text{cfm}\times DW(\text{grains of moisture})$$

Heat exchange effectiveness equations:

$$E(\text{Effectiveness})=\text{actual transfer for the given device/maximum possible transfer between airstreams}$$

$$E=Ws(X1-X2)/W\text{min}(X1-X3)=We(X4-X3)/W\text{min}(X1-X3)$$

E=Total heat effectiveness or a breakdown of sensible/latent effectiveness

X=Dry bulb temp, humidity ratio, or enthalpy at the locations indicated in FIG. 8B, all differences being positive values Ws=mass flow rate of supply air, pounds of dry air per hour We=mass flow rate of exhaust air, pounds of dry air per hour Wmin=lesser of Ws and We Leaving supply air condition:

$$X2=X1-[e\ W\text{min}/Ws(X1-X3)]$$

Leaving exhaust air condition:

$$X4=X3+[e\ W\text{min}/We(X1-X3)]$$

It should be noted that maximum effectiveness potential can never be more than the enthalpy (total heat) differential of the two airstreams. Counter flow heat exchangers have the greatest maximum effectiveness theoretically approaching 100%. Secondly, Cross Flow exchangers exhibit maximum effectiveness at mid-range. Lastly, parallel flow heat exchangers are approximately 50% effective and are used more for specialized purposes, where no other configuration is feasible.

It should be noted that closed pipe loops, or "run-around" heat exchangers (air-fluid-air) have individual components whose effectiveness is combined by factoring. For example, if two devices each have an effectiveness of 90%, the two are factored to determine combined effectiveness: e.g., 0.90×0.90=0.81 effectiveness (or 81%.)

The described method and apparatus will address the basic key issues of heat exchange through automated temperature sensing of air or fluid streams in any form, number, or combination, including but not limited to the depictions shown in FIG. 8, FIG. 8A, and FIG. 8B. The sensor logic utilized by the method and apparatus will pertain directly to thermal dynamics and fluid mechanics, namely to exploit the maximum potential of any given movers 1 and terminal devices 3 under given conditions. This includes the total and specific fluidic gains/losses the components of the distribution system create in of themselves and, above all, these previous elements may be manipulated in cooperation with one another for maximum heat exchange effectiveness under varying conditions.

Once establishing maximum effectiveness possible—actual versus potential—the system will monitor heat exchange devices 8 continually because pressure drops and heat transfer coefficients will increase over time or misuse as these are susceptible to corrosion, cross leakage, fouling, freeze-ups, and condensation, all of which are factors that will increase heat transfer coefficients and, thus, minimize effectiveness. These are the key and relevant items that will be addressed by said method and apparatus through both flow-pressure and temperature sensing considerations.

BTUH may be determined entirely by temperature sensor input and calculation and will fluctuate to reflect changes in increasing and decreasing load. The accuracy of this method, however, suffers at temperature differentials below 10 and is further confused by the heating advantage of maintaining approximately 90% of heat exchange at only 50% hot water flow in heating modes of operation. Thus, the most accurate method of monitoring BTUH when ideal conditions are not available is to monitor water side (GPM) flow rate with a flow meter or calibrated valve (Terminal Device) and, similarly, establish the total air side flow rate by way of the flow monitor station 2 simultaneously.

The method and apparatus will perform calculations based on temperature differentials, known coil flow-pressure drops, valve coefficients, and its own air-fluid flow-pressure sensing as set forth in this description, noting any reasonable limitations that would prevent it from producing accurate results and displaying them on the user interface.

Temperature/Density Correction

A correction factor for total airflow measured at an appropriately situated flow monitor station, if provided, will be supplied based on any deviation from standard air conditions at 70 F, 29.92 Hg (or 14.696 PSI) atmospheric pressure at sea level, specific heat (Cp) of 0.24 Btu/lb, and a density of 0.075 lb/cu ft. For other than standard air: V=1096 SQ. RT. Vp/d. Temperature and altitude influences will cause these changes and the system will correct for air-gas temp./density or fluid viscosity. Water does not require correction if measured with the GPM unit, which already accounts for volumetric flow. Standard water: Sea level, 68 F, Cp=1.0, d=8.33 lb/gal (or 62.4 lb/cu. ft. when not used in a GPM equation.) This is obtained from 8.33 lb/gal×7.49 gal/cu ft=62.4 lb/cu. ft.

Fluid density properties will also vary for fluids other than air, such as gases, glycol solutions, or any other fluid or mixture being distributed and delivered in a given or changing state. Corrected flow-volume rates and pressures will also reflect these changes, based on the given gas-fluids' varying densities and SG's (Specific Gravities.)

Note that either the flow sensing instruments or the temperature sensing instruments may make these adjustments—relative to any deviation from standard air, water and known fluids—but not both.

RH—Relative Humidity

RH may be determined with dry and wet bulb sensors placed at all required locations, preferably in an equal area traverse arrangement when taken in an open cross-section, such as at an open filter intake.

This arrangement will anticipate air stratification and avert incorrect temperature sensor feedback due to localized effects, such as those caused by stratified air, particularly in a mixing box. Here, air streams of distinctly differing temperatures, densities, and moisture contents are being combined quite suddenly, namely outdoor air with return air from one or more sources.

When a mixed air enthalpy or content is to be determined in a mixing box, as opposed to two ducted airstreams wherein they are measured separately, a traverse must be performed to obtain truly accurate results due to air stratification and turbulent conditions, again pointing out another limitation of current sensor use and placement.

Normal sensing locations include entering and leaving coil, outdoor air, and return air, preferably when ducted separately. When they are not, the two must have distinctly original and separate sources, otherwise the air is already mixed. Alternatively, the combined air may be traversed at the face area of the mixing box as is and results averaged.

Open plenum air handling rooms tend to foster the problem of indefinite air mixtures with one or more systems sharing return and outdoor air sources and, consequently, load shifting with one another. Also, it is nearly impossible to determine exact degrees of OA or RA content per each system, let alone precisely adjust them independently of one another by damper control. Each unit and heat exchanger 8 should account for all air supplied by returning that air in equal measure from its own zones served, less any outdoor air entering through itself.

Indoor conditions will be quite different from one location to another, particularly in open plenum returns or partial ducted (transfer-type) arrangements, which clearly don't work and cannot be assigned definitive CFM ratings due to near total static pressure loss. When a questionable situation arises, sensors should be placed at either a central return air location or an average taken of all return air locations in distinct zones close to or just inside the register inlets where indoor air samples are truly representative of indoor conditions, reflecting occupant loads, equipment, lights, and overall latent and sensible influences after they have taken effect. Odd or isolated zones should be avoided as opposed to central thoroughfares where there is occupancy and kinetic activity.

Latent changes may be viewed in terms of air moisture content, or the addition or removal of moisture content, which may be expressed either as a ratio or actual moisture in lbs/lb or grains/lb, as described in the previous section. This may also be converted to gallons, liters, or any unit required with or without a flow rate.

Using the correct method and locations for temperature sensing, mixed air is calculated as follows:

$$\% OA=100(Tr-Tm)/(Tr-To)$$

$$\% RA=100(Tm-To)/(Tr-To)$$

Hm (mixed air enthalpy)=XoHo+XrHr/100
X=% (OA or RA)
H=Enthalpy (OA or RA)

The mixed air enthalpy represents the actual load the coil or heat exchanger has to deal with, not just indoor air alone. Again, more OA=more load on coil. Basically put, MA is the entering air as a whole. It will be standard for most systems that have outside air or any other returning air stream originating from more than one source that will mix with the primary air and, hence, enter the coil or heat exchange device. The total load (Qt) on the coil 8 or exchange surface will be the total heat transferred between the entering (mixed) air stream and the leaving (supply) air stream as specified by design. Wet bulb temperatures and the corresponding enthalpy differential as expressed in the Qt equation noted previously shall apply. Qs may be used for heat mode, heating-only systems, or any analysis reflecting dry bulb (sensible only) changes.

The building load calculation will largely determine the sizing (capacity) of the coil/heat exchange device 8 needed and its resultant pairing with a mover 1 designed to supply the volumetric flow necessary to distributed this heat flow to meet peak load demand and create air changes/hr, another code requirement that varies with each type of dwelling. ACH=CFM×60/Rm. Vol.

Note, however, that, contrary to popular belief and outside of typically packaged systems, there is no truly direct or measurable relationship between heat transfer and a CFM capacity rating. It is a unilateral equation, though a CFM rate may be established deductively from heat transfer of a known system in a given context, after the fact. One follows the other from contingency rather than necessity. The equations are still relative, namely to their differentials of temperature and enthalpy. This is where the sizing and flow capacity (CFM) of the mover stands to change for the better with improved flow delivery, from end to end of the distribution cycle. Overall, it exemplifies the distinct advantage of precise fluidic control, totally and terminally, along with likewise thermal control wherein they reap mutual benefit.

Psychrometric Chart Display

A full display 6 of all heat flow movement on a psychrometric chart may be provided for a fully comprehensive analysis of enthalpy changes, sensible and latent heat flow of all airstreams depicted, including mixed airstreams, effects of adiabatic saturation, lb/lb or grains/lb of moisture in air. It may also be used to illustrate actual heat flow by animating the distinctly horizontal, vertical, and slanting moves that sensible, latent, and other more complex changes, such as adiabatic saturation, incur. This may also be used in conjunction with the Vectorial Display 6 described in this later section.

Terminal Flow Control and Sensing Devices

Ideally, the terminal flow control 3 and sensing devices 4 are an integral part of the invention 25 as whole, though one may be viewed as a separate device in the form of a partially retrofitted option on new or existing systems 5. The terminal system 5 and its components are essentially a microcosm of the mover's functions and complement its performance in the most effective way possible with the described method and apparatus air-fluid distribution system and associated performance curve characteristics. The key difference, again, is that the terminal device 3 is a passive one, whereas the mover 1 is an active one.

Above all, the sum of the individual needs of the components of a system 5, less diversity factor 22, will determine overall demand on the system as a whole and it is in the success of these sub-systems that success of the whole is largely contingent upon; success here being defined as achieving optimal efficiency of local operations with least total demand being placed on the primary mover 1, and, hence, the total power usage of the system in whole; in a given time period, under maximum load conditions.

It is understood, however, that in a variable system 24, loads are changing or shifting from one area to another during the course of a day in an occupied space, and so maximum load per zone is the local concern. The primary concern is the total required for all zones, less diversity 22; in so far as the primary mover 1 is concerned and what it may be expected to achieve. The terms "instant" and "not instant" are used to indicate where and when air-fluid flow and zone temperature conditions are available at any given time. They are not instantaneous, as air-fluid flow and heat exchange thus produced is directed to where it is needed and when it is needed.

System Diversity

When a diversity 22 is present, as recommended, the described method and apparatus may be used to 1) expand or widen the diversity beyond what was previously possible and 2) determine which path(s) of distribution can best be utilized in dispersing range and run of this diversity, through thermal and fluid mechanic considerations.

Figure 20:
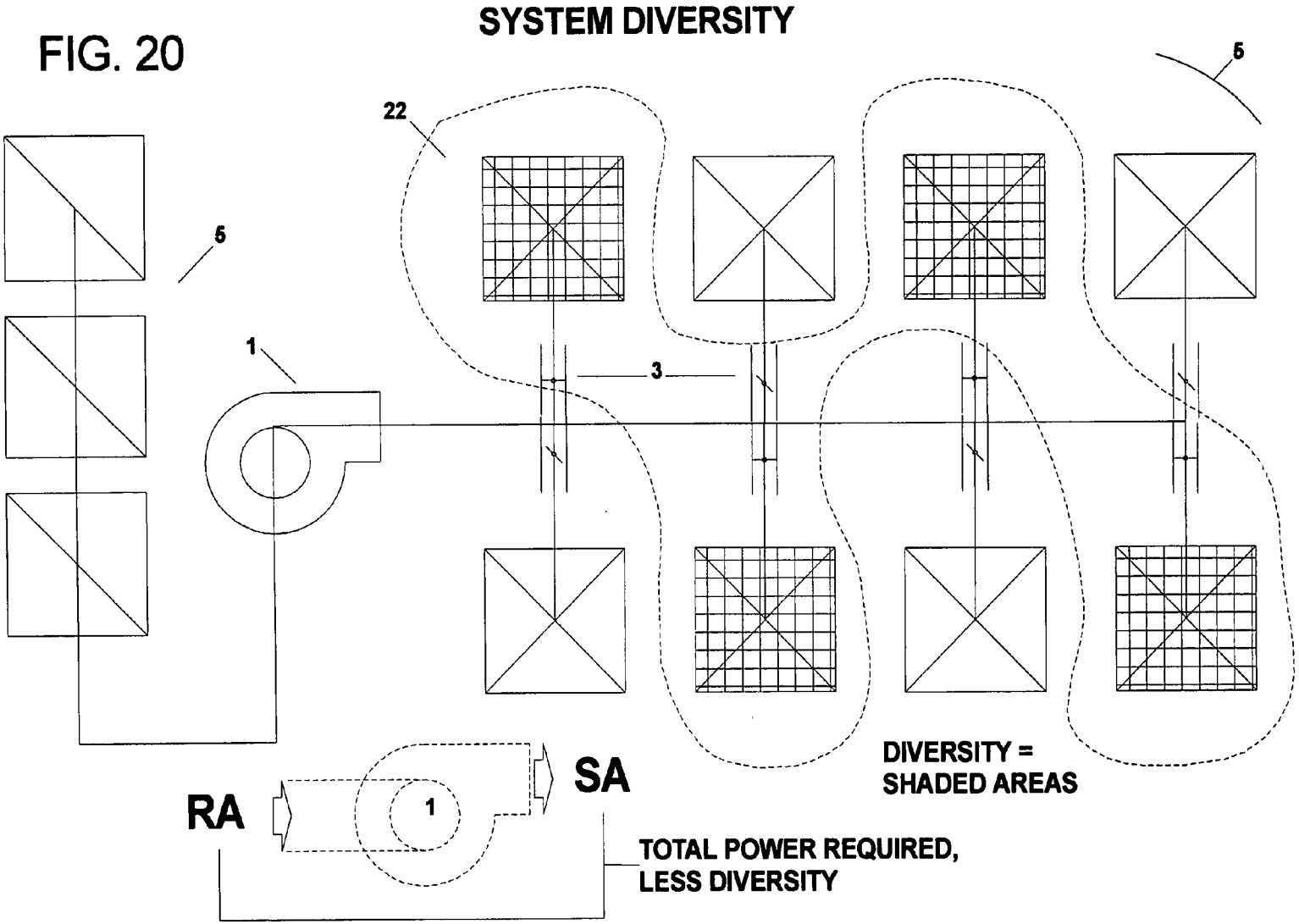
FIG. 20 is a basic depiction of System Diversity, a concept referred to throughout the description to illustrate a variable distribution system's tempering of total mover capacity to required system, and no more, no less, to accommodate load where and when needed. This functions as a supporting concept for said method and apparatus and additional claims presented.

FIG. 20 illustrates a shorthand representation of diversity. The boundaries represent that portion of a system exposed to one side of a building or zone and its changing load over the course of a day.

Minimum load conditions or flow positions will automatically be addressed by the method and apparatus by placing them into the increased margin of diversity 22 than would normally be available with current systems, as these tend to over-perform at this low end of the spectrum. This may be due to lingering dead bands that linger too long when a zone seeks to return to minimum cooling or just enough to maintain the "mean temperature average."

The zone settings and temperatures, however, will always be at the mercy of localized zone sensor placement and/or occupant settings if local control is enabled. Some systems allow local control to be disabled and can only be set from the main building or energy management system to rule out the "occupant tampering" element.

The main problem, however, usually arises from zones whose boundaries are not clearly delineated, or "crossover zones" as we will call them. For example, one branch of a system supplying enclosed offices is controlled by a corridor sensor external to the offices and, thus, this terminal branch's VAV controller and temperature control is dictated by sensor input from an area entirely separated from or only somewhat adjacent to itself. Another example: an open space with cubicles served (conditioned) by two or more different systems with the zone sensor having been placed at a far wall somewhere due to construction or architectural logistics, etc., and not where the occupants actually work. Though rarely seen, some systems use averaging sensors in more than one location to compensate for this problem. However, the emphasis of these existing systems weighs too heavily on temperature feedback and temperature sensing in general.

By and large, the described method and apparatus differs from existing systems with its emphasis on fluidic control, as overlooking this vast step and placing higher concern with the end result alone (temperature) is a far-reaching problem in itself. The air-fluid's mechanics and the path it takes to reach its destination are what make the highest demands on the primary mover 1, and hence, total power consumption on itself and the coil/heat exchanger 8 as well, whether this is a refrigerant or chilled/hot water coil.

If air-fluid is not distributed to a conditioned zone in adequate measure, the zone will take longer to cool, refrigerant compressors will cycle up, and chillers will operate on higher load demand as well. Returning air-fluid will have as much to do with this effect as supplied air-fluid and the obstacles that must be overcome in the circuitous path 5 to and from the primary mover 1, or any additional mover within the system, or sub-system within the system. Applying the fluidic attribute to existing temperature and load management via temperature control will only improve these systems vastly and establish the best means of achieving the required end of automated temperature control systems, as one cannot be correctly justified without the other.

Among all else, the method and apparatus is essentially an intelligent and fully articulated flow-pressure control device, though it will operate within the framework of any new or existing system 5 notwithstanding any limitations of the actual valve or "variable air volume" terminal 3—in simplest form a motor-controlled damper with a defined range of motion—to which it is fitted. Regardless of the existing terminal device's limitations, the said method and apparatus will enable the best possible and most articulated control of that existing device and system until a novel VAV, damper-actuator, or valve succeeds current ones and same principles will apply. In fact, the method and apparatus will directly result in the development of a successive device 3 or mover 1 through its very utilization.

Above all, the method and apparatus will diagnose problems with and evaluate the effectiveness of the existing terminal flow device 3 to which it is connected, how to best employ its more desirable qualities and, in lab use, assist in developing a more effective device for future field use.

Lab and Field Use Embodiment

In terms of a significant embodiment, the apparatus and method of such, will also operate as an air-fluid valve flow-pressure metering and diagnostic device across the valve or damper's full range of motion, establishing unique characteristic curves, along with all described advances of current invention. This compound function will enable the apparatus to plot a complete portraiture of all of the valve characteristics based on the starting point (constant) of a given total pressure or total power input. The correction factors for fluids other than standard air or water will be applied as constants or variables aptly noted as such.

Lab Use or Engineering Data

The output display of the method and apparatus will, first and foremost, illustrate how much Total Pressure or power is lost through the air-fluid valve or terminal control unit's orifice, with mover application being held constant.

Figure 11:
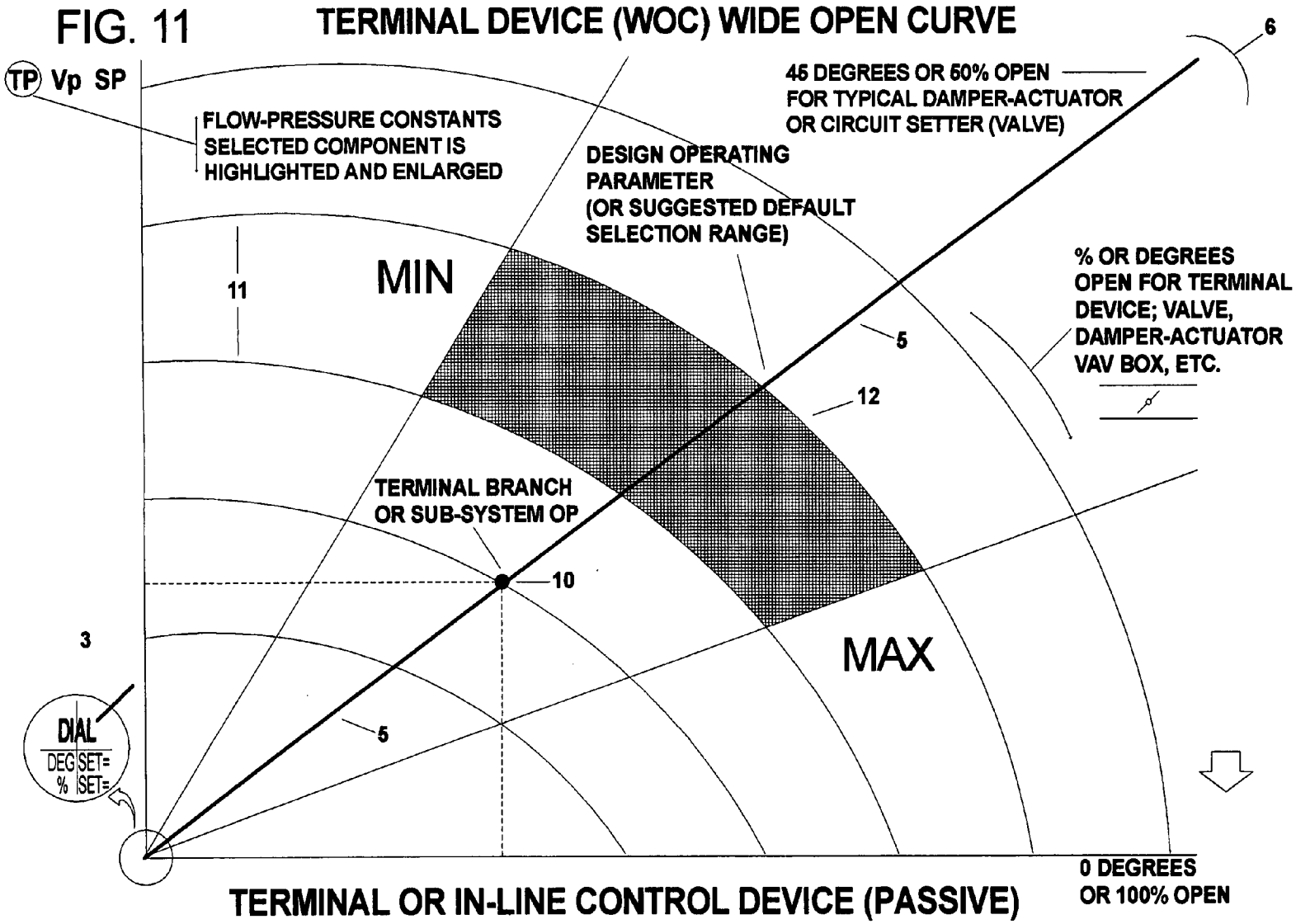
FIG. 11 illustrates a complete "wide open" portrait of a modulating terminal device (or valvic device) through its full range of motion, along with an index of options (to the left) notating TP, Vp, and Sp for arbitrary setting. The suggested default or design operating parameters are shaded for the selected operating range. A suggested default or design-specified terminal branch or sub-system OP is also shown at 45 degrees (50% open.) The index also includes a dial setting for altering the TD's characteristics under any and all conditions with TP, Vp, or SP being switchable and variable through any percentage or degree of closure.

FIG. 11 illustrates the main display of a modulating terminal device 3 as it might appear for full evaluation with optional settings for any and all variables present.

Additionally, the method and apparatus will note and display 6 highly descriptive information pertaining to the said valve's flow characteristics across a full spectrum of effectiveness or non-effectiveness and may include a traditional Cv (valve flow coefficient) for hydronics applications, though this considers only dynamic losses based on an effective area inside a valve or terminal device 3 for standard water at 1 PSI of drop in its full open position. Similarly, a K factor or Ak factor negates the SP gradient. Most catalogued equipment will simply designate a generic pressure drop in "WC (or "WG) units and so we will distinguish between all unitary elements at work and their specific role throughout this description.

Referring to FIG. 11, FIGS. 15, 15A, and 15B, once overall loss of TP is exhibited in full open position, a Total Static pressure drop (SP) and Velocity Pressure drop (Vp) will be depicted as well to evaluate test environment or "as-built" characteristics. This will also establish a design method for calculating system friction/head losses and, conversely, those that would contemplate high velocities.

As with the primary mover's Total Gains and Specific Gains, the terminal device will illustrate Total Losses and Specific Losses. Above all, it will answer the following key questions, as posed here:

Q: How much of a total impact loss did this unit create in of itself?

Q: How much of the total loss is in the form of SP (Static Pressure?) %

Q: How much of the total loss is in the form of Vp (Velocity Pressure?) %

Vp/SP ratio or SP/Vp ratio, or expressed as factors.

This will provide useful, if not all required engineering or "lab conditions" testing data and is not the same as the field or installed version, as it is not practical to have this three-fold sensor arrangement in a field version. It is only necessary to establish comprehensive and official certified data for a catalogued device. And once this is done, the device is of known characteristics and its performance can then be accurately predicted with simplified sensing elements in field use, and more so with the now fully articulated method as follows.

Measurements will be taken from inlet to outlet of said valve or terminal control unit 3 to illustrate the loss occurring during the air-fluid's path before and after encountering the terminal unit/valve 3 in its full open or other position as arbitrarily set. This will be useful for design considerations among many other uses. Following this initial orientation, a three-part performance curve comprised of TP, SP, and Vp will be plotted across the full range of motion.

The "percentages of content," a term traditionally used in reference to mixed airstreams, will be determined: SP and Vp of TP. Namely, the Velocity Factor or Gradient of this content will be the key consideration in high velocity applications or systems and what remains is in the form of static pressure. The opposite would apply to high pressure-type applications and systems, where the SP gradient is dominant.

Useful ratios will be noted, from fully closed to maximum flow capacity, so all specific changes, losses, valuable characteristics can be viewed 6 entirely across the plotted full range of motion, with the ability to "lock in" all desired characteristics and constants for viewing consideration for their ultimate effect on the system whole or "big picture." This can be a useful function under changing load conditions and the various counter-effects that may be imposed to reap added benefits of energy management through specific flow control and timely setting.

The method and apparatus will establish a comprehensive evaluation of all air-fluid terminal control unit 3 characteristics, their value or lack thereof, in full scope of operation within or without the context of the total system 5, terminal system 5, and primary mover 1 in whatever form, number, or combination. This, in turn, will establish the best suited operating range or point of greatest SP/Vp throughput for the valve or terminal control device under a given total pressure drop.

This technique, made possible by the method and apparatus, may also be employed to determine which system 5 or type of system (vessel or conduit of air-fluid delivery) is best suited to that valve or terminal control unit 3 for the desired application. These functions may be served with or without a "blow-through" or "draw-through" system attached.

Total Gains/Losses—Specific Gains/Losses

Equipment cataloguing, selection, and system design will be made possible by the described method and apparatus in its determination of Total Gains versus Total Losses, as they pertain to any primary, secondary, or tertiary mover and terminal devices arranged in series, parallel, or in any other form, number, or combination that produces useful work.

The primary mover's 1 total gains will be matched to a total system 5, including any and all terminal, in-line devices 3, ductwork/piping/vessel/conduits, fittings, attachments, and all objects comprising that system through which the air-fluid must traverse to reach its critical run branch 5 and return, less any established diversity amount 22.

In lieu of any minimum or maximum operating parameters 23, the terminal device's total losses will be suitably matched to its terminal branch subsystem, falling under total system considerations.

Specific Gains and Specific Losses of all system components will then be articulated by the method and apparatus, which will then precisely assess the individual needs of total and subsystem requirements.

The WOC (Wide Open Curve)

To begin with, a "wide open" test can be conducted under defined lab conditions, such as those delineated in FIG. 11.

At zero to maximum flow, the terminal flow system's curves (constants) 11 are plotted across some degree or percent of "wide open" setting, based on its size and suggested operating range 12, though this fact may not yet be known until tested and determined empirically. At some value above "no flow" or full closure, a minimum flow rate is established. Note that certain minimums are required for terminal devices 3 at different sizes/capacities due to Reynolds number effects as well as terminal heat exchangers 8, such as VAV boxes requiring a heat minimum cutout. Once again, SP, Vp, and TP are plotted as individual performance curves 11, or flow constants, an option shown at the top left of the index column in FIG. 11.

Wide open curves were originally established with movers 1 tested under ideal lab conditions with no system 5 attached to them, i.e, with little or no external influence. For example, AMCA has a standard of testing a blower with approximately 10 duct widths of enclosure on the discharge side, with the inlet being fully open to atmosphere and no other constraints on the primary mover itself. This example or any other variation understood or agreed upon as "wide open" testing may be defined and accepted as a given precept. In whatever form it may take or improve on, the forthcoming principles remain the same.

With regard to the said method and apparatus, the "wide open" starting point is applied to a terminal device 3 under logic control 9 of said method and apparatus 25, with or without a blow-through/draw-through system attached, thus producing an added claim.

Field Conditions

Under field conditions testing of an "as-built" system 5, best results will be achieved if the described method and apparatus 25 is used from origination. If this is not the case, "aftermarket" components may be installed as a retrofitted option. For example, necessary key system components may be fitted with some or all of the sensor grids 13, 14, 15 or equivalent inlet/outlet-only sensing arrangements, along with the user interface 6, which may be as large as an entire building management system, or as small as a localized push-button display panel 6.

In any case, utilizing the method and apparatus according to specifications will produce far superior results than traditional methods of sensor control currently in use, particularly with proper calibration using said method.

Furthermore, a known valve or terminal control unit 3 with a known or unknown system 5 attached may be evaluated as well, and vice versa. Once valve characteristics 11 alone are established, the true operating point 10 of an unknown system connected to that valve 3 may be established, as pictured in FIG. 7A.

Terminal Branch System Performance Curves

With its own TP constant 11 and percent or degree opening as a starting point, the terminal controller 3 function of the method and apparatus can determine its actual system's curve 5 and operating point 10 and may juxtapose it with the intended one for comparison, if one is provided by the design engineer or manufacturer's submittal data. This may all be displayed on the user interface 6. Above all, it would eliminate any guesswork and provide a proof for any problematic performance based on known facts and presubmitted data asserting those facts.

The curve may be viewed independently, as shown in FIG. 10, or with total system curve 5 and mover curve 11 being juxtaposed: FIG. 9, 9A, 9B, 9C.

As a recommended option for an existing, "as-built" system 5, the primary mover 1 can also be equipped with the same conceptual device that will plot and display 6 these curves 5, 11 prior to and after the balancing procedure is undertaken.

The principle operation of the method and apparatus applies to the terminal device 3 as follows: The performance curve will be a compound one, composed of SP, Vp, and, finally, TP. When the known terminal control unit 3 is placed within the context of a terminal branch system 5, it immediately produces a comparison of these three key gradients against its own "ide open" characteristics, these being known and established previously. This can, in turn, establish the characteristics of the system 5 to which it is connected by plotting the coordinates of both the real and intended design operation points 10. FIG. 12

Though most system designers, in conjunction with manufacturers, provide a "total system curve" 5 based only on the "total static pressure" of the primary mover 1, this believed to be a total evaluation of the system 5 and has been the basis for sizing the primary mover 1, this procedure is here taken much further by having a preset design curve for the sub-system (terminal branches) as well. In a similar manner, though more advanced, the method and apparatus will establish a design OP (Operating Point) 10 of that sub-system 5 in addition to the primary mover 1, and with a full scope of characteristics rendered for each. Note: If an OP is not provided, a default set point based on the suggested operating range 12 for that Terminal Device 3 remains in effect. FIG. 11

The Terminal Device 3 may also adapt itself to the type of system 5 to which it is connected for peak efficiency, given the existing or "as-built" context of the system.

Evaluation of Known or Unknown Valve Characteristics

Using the method and apparatus testing under lab conditions, the manufacturer's sizing and performance evaluation of these terminal devices 3 will be based namely on the SP/Vp ratio against its range of closure and at whatever throughput one or the other is dominant for specified effective ranges. This generic starting point may serve to first pair a given type of terminal device with either high or low pressure-based systems. Generally speaking, VAV (air) systems are known as velocity-oriented systems and so control of the Vp factor becomes a key function. Even so, current systems focus on maintaining constant system static pressure at some arbitrarily selected point in a distribution system taking many paths when it is clearly known that this is the least accurate technique applicable, especially in a VAV system. This is where precise control of both SP/Vp factors becomes not only appropriate, but necessary. In hydronics systems, Venturi-type valves such as those in calibrated balancing valves are used to minimize total pressure loss and have an overall high throughput of velocity and pressure—the lengthier, the better. This device is known as a preferred means for determining flow in hydronics terminal coil systems, as well as metering total GPM at the discharge or suction of a primary mover (pump.) Where water or fluids are concerned, the Venturi itself measures a form of velocity head from upstream (High) to downstream (Low) in direction of flow and has desirable characteristics in maintaining total head when the calibrated valve is throttled for balancing, thus lowering its flow coefficient. The Venturi method is also the most accepted means of determining mover (pump) characteristics via flow metering in lab use, as pressure drops or Cv's are not known until after such knowns are established, first through flow (velocity-oriented) metering, then pressure drop as a secondary function.

Currently in hydronics use, the Plug Valve has the most desirable characteristics in some cases with its even curve across a full range of motion, without any sharp dips or deviations at the lower and higher ends of closure. This is desirable to have at the main pump discharge or a primary loop (main circuit.) Other valves, however, have specific uses for differing purposes. Commonly found on hydronics sub-loop circuits, Ball and Butterfly Valves may assist in evening out pressure drops and, thus, directing fluid flow to other circuits with steeper "cut-off" and Upstream Leverage, despite lacking "uniform" flow characteristics.

Upstream Leverage

Upstream leverage is another claimed concept in all distribution systems 5 that strongly supports the use of Terminal Devices 3 under the control of said method and apparatus and, above all, the level of precision it affords to such distribution and delivery. This is perhaps best understood in regard to specific system characteristics and applies to any main branch to terminal control relationship being as close-controlled to the main duct or primary loop as possible at every critical juncture.

This method of valve selection, appropriate placement, and articulate utilization of such a device, as with said method and apparatus, clearly provides most efficient use of total power and strongest leverage in distribution.

Directing flow to various takeoff branches should occur at connections most adjacent to or as far upstream as possible from main runs, where many current systems use face area dampering, such as that employed by so-called "balance-free" diffuser terminal outlets that have servo-actuated damper blades on the face of the RGD. Clearly one of the worst possible placements of dampers, this causes mainly localized dynamic (Vp) loss at the face of the terminal outlet diffuser with high SP loss upstream.

Furthermore, almost all of the SP portion of the TP supplied to that branch is lost almost entirely to that branch's length of run and, secondly, to fittings, respectively. Pressure loss equals inefficiency, as pressure generation makes the highest demand on BHP and, hence, total power; which, if not lost, may have otherwise been available to reach other runs where and when needed.

Consequently, the majority of flow and pressure is not transferred to another branch via the main duct, but rather is largely lost by remaining stagnant in that sub-branch or loop. This is why air-fluid control via valve or damper throttling to a sub-branch must be made as far upstream and as close to its main run as possible.

Operating Points

OP's (Operating Points) 10 move up and down, left and right, respectively, with effective Static Pressure and Velocity Pressure changes as monitored 6 by described method and apparatus, where previously this was based singly on static pressure, or total static pressure where movers are concerned.

The described method and apparatus will, however, take into account all effective changes, including static, dynamic, and total as well. It will then make determinations based on how they interact with one another in relation to the Primary Mover 1, Terminal Devices 3, and the System whole 5.

As shown in FIG. 12, the operating point 10 rides with either the mover's curve 11 or, conversely, the system curve 5, depending on which component comes into play, or is specifically altered while the other remains constant.

Where a Terminal Device 3 is concerned, its input flow constant simply takes the place of where a mover curve (@ speed of rotation) would be 11. Terminal Device 3 or valve changes of motion ride the valve flow constant 11, until this is altered, and all changes can be viewed within the terminal branch. One or the other variable is altered, thereby causing it to "ride" on the others constant curve. Refer to FIG. 11, FIG. 12.

In general terms, the system curve 5, whether it represents the system as a whole or its independently controlled branches, is always unique due to what is known as its "as-built" characteristics. Despite a design engineer's best intentions, the actual system will always have unique attributes that cause it to deviate in one direction or another from its intended point of operation 10, which is initially established, along with mover curves 11, on submittal data at the outset of a building project. With this being the case, the system's operating coordinate 10 will ride the steady mover curve 11.

The Sub-System Curve

Figure 9C:
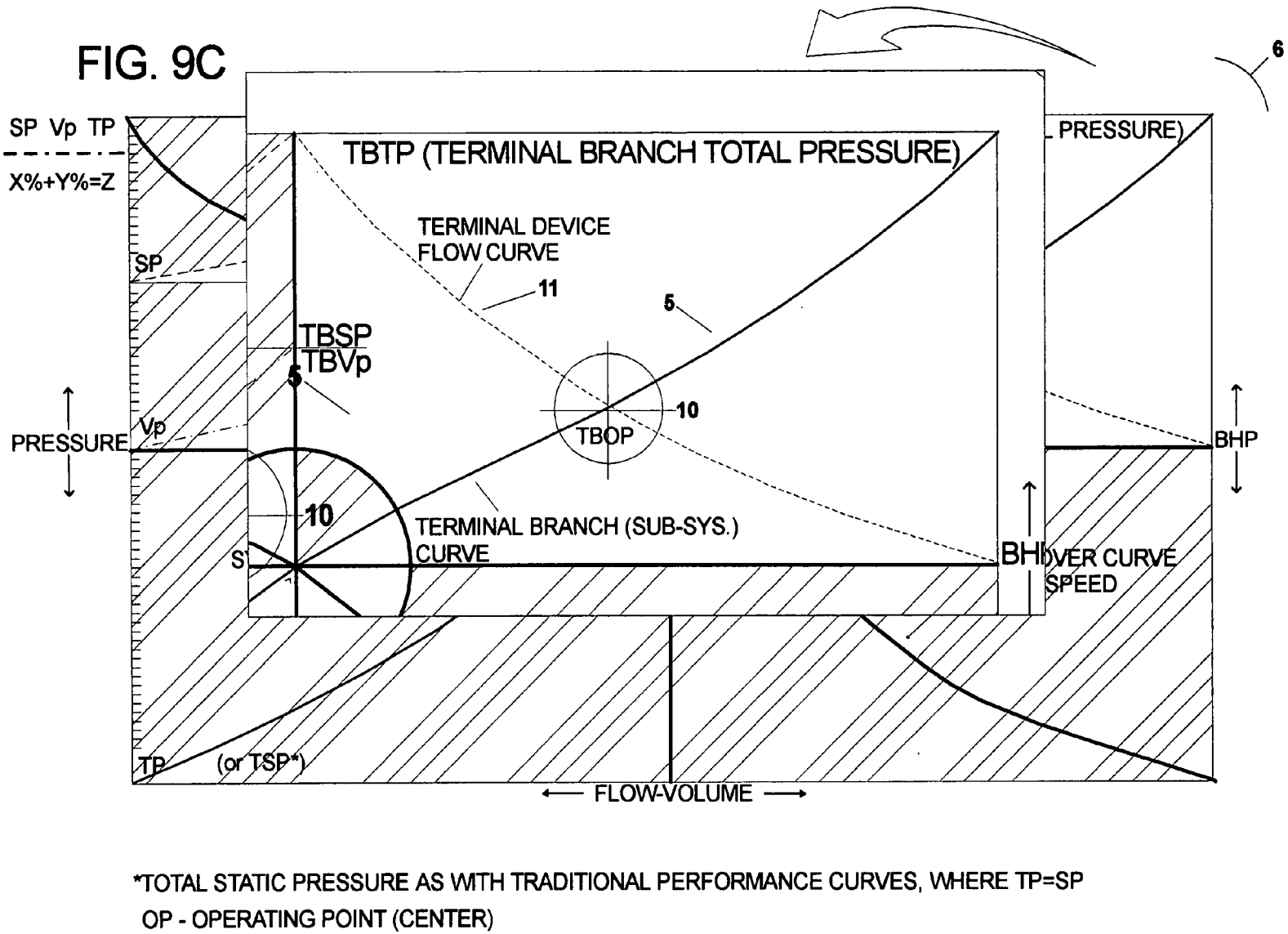
FIG. 9C illustrates a detail view of the Terminal Branch (or Sub-System) main Total Pressure curve plotted against the terminal device flow constant curve. Terminal Branch Operating Point shown in cross hairs. Also shown to the left of curve display are indexed options for selecting a TBSP or TBVp (Terminal Branch Static Pressure or Terminal Branch Velocity Pressure) curve breakdown.

A sub-system curve 5 for this particular terminal branch system is established, as opposed to a total system driven by a primary mover 1. This TB curve 5 transposes and influences the Terminal Device constant 11, now with a defined "load" attached in addition to the effect imposed by its degree of closure. Where these intersect is the terminal branch or sub-system's OP (Operating Point) 10. FIG. 9C.

A default setting 12 for this curve 11 will be provided based on the manufacturer's recommendation for this size and range of box, these being previously known and established facts through lab method testing as outlined in this description or otherwise accepted standards. Among other deciding factors, the criteria may involve inlet size, terminal outlet (diffuser) sizes, noise, throw, and other related criteria for the given system or application.

The design engineer may determine his own curve based on whatever unique characteristics his system and/or subsystem may have, or that he believes they may have. By its very nature and gradient inclination, the said method and apparatus will correct itself despite any oversights, miscalculations, installation problems, etc., in so far as this is possible with the given constraints of the primary mover 1, available stock unit, motor, and drive sizes 7, and, above all, the "as-built" ductwork/piping/vessel 5. Wherever these problems may stem from, the gradient factors always break down to Static, Dynamic, and Total losses, leakage aside, though a predetermined allowance should rule out the leakage factor at the outset of system construction. This is further addressed under leakage tester embodiment. Ultimately, a logic-oriented re-plotting of the curves along with juxtaposition leads to the source of the problem, clearly bringing it to light.

A Review of the Total System Curve

At the outset, the design engineer establishes the system curve of the entire system 5, this being under full load and full flow conditions, less diversity 22. All systems, including CV (Constant Volume) systems, are begun this way. This initial process is based on the WOAF (Wide Open Air Flow) of the fin, the primary mover 1 of the entire system 5 as a whole. Subsequently, it is based on the system curve 5 for the entire system under maximum demand conditions with the critical length of run or equivalent critical run being a prevalent concern, so that fan power/pumping power may reach all parts of the system as a whole. This is typically a primary concern in hydronics with less emphasis placed on dynamic losses, as pressure losses (length of run or piping friction.) Suction lift in open systems is also of paramount concern, though certainly not the only concern. Along with reaching critical runs in hydronics systems, maintaining relatively equal pressure drops with minimal loss of total dynamic head, particularly around the equipment room cluster, is desirable to eliminate any additional head that valves 3 and other terminal devices 3 have to deal with beyond this primary loop. With air, gas, and lighter fluid systems of varying densities and specific gravities, all the more reason exists to establish specific gradients, namely SP and Vp of TP.

Interactive Concern

Although being pressure independent variable systems under self-calibrating logic control, the sub-systems still need be concerned with the primary system, mainly to determine if there will be enough of a minimum operating pressure available at the terminal's inlet. This will be a simple binary decision: yes or no.

The minimum operating pressure will be a measure of TP. The breakdown of its gradients (SP and Vp) and the measure of specific content will largely be determined by the selected valve 3 or Terminal Device 3 and its pre-established characteristics 11 as chosen for the application at hand.

A common problem in current systems are certain limiting factors which may interfere with normal function of the system, such as a blanket system pressure-limiting constant being maintained and not exceeded, this to protect the ductwork from bursting at the seams or fittings—or in the case of hydronics, a pump casing pressure maximum. The method and apparatus solves this problem with discriminating sensor interpretation 2, 4 and highly advanced logic control 9, which allows the system to explore venues current systems preclude themselves from by their own limiting "blanket" assessments of system control.

The terminal unit's critical run branch will be automatically identified and assigned on system startup, whereby all terminal control devices 3 communicate sensor feedback 4 and draw value comparisons. Note that the critical run may change throughout the normal operation of a VAV system 24.

System status, however, may change and be reset if more total system power becomes available after initial startup. This may be due to obstructions later found in the system, clouding its true flow characteristics or, more commonly, if smoke dampers at firewall partitions are found to be closed, completely altering the system curve 5 profile. Also note that the furthest branch is not necessarily the most critical, as the "equivalent" furthest branch is often a tightly wound branch somewhere at midpoint in a system branching out in all directions. Equivalent means the calculated total losses of the air-fluid path to and from the primary mover (dynamic and friction) are higher, not always due to length of run or distance away from the mover. Once again, this former assessment of critical run is based solely on static pressure.

Here is another pivotal adjustment pointing out differences in existing systems, though no known previous automated system ever established any critical run, rather leaving this process to the balancer for creative interpretation. And those in practice that may establish this critical run do so with only static pressure readings, not total (impact) readings, again ignoring the velocity gradient. SP increases alone may and will result from undue system restriction and not from mover power as applied effectively.

Under control of the method and apparatus, the Terminal Devices 3 discussed here will use their own internal impact sensors 13 to make the critical run determination, not their static sensors 14 with which they are also equipped and make use of appropriately.

Primary Mover—Terminal Control Relationship

Alternatively, there may be fewer losses than anticipated, as is common with hydronics systems, after a multitude of safety factors and other considerable allowances are made. This being the case, the method and apparatus can adapt to this and make the delivery of flow more useful at some other location and, ultimately, "ramp down" 7 the primary mover 1, causing it to utilize less total power. This may be accomplished by way of mover speed control 7, such as that achieved with a VFD (Variable Frequency Driver,) which most current VAV systems are equipped with as an alternative successor to Vortex Vanes. Now virtually outmoded, these were affixed to blower inlets and contributed to the adverse condition known as system effect losses, irretrievable dynamic losses occurring particularly at a blower's inlet. They were also obviously without the added benefit of motor speed reduction at the expense of undue system pressure increase and total pressure/power loss.

Now in wide use, VFD's operate from 0 to 60 HZ and up to now have used this variable only to maintain constant pressure as sensed by a single static sensor placed approximately ⅔ into the system. In contrast, the said method and apparatus described may utilize this speed control variable 7 correctly, whether it be via VFD or any motor with speed control not dependent on the concept of VFD or any other brand concept, to extract added benefits from the mover 1. Note that the aforementioned sensor-VFD system is the least effective means of total system control, as it is governed by a general rule of thumb, subject to misleading results and fluctuating circumstances abundantly clear to the professional experienced in VAV systems.

Static Pressure Control

This leads to the problem of static-pressure sensing control in general. It will always be misleading due to system constraints, such as blockage or restriction inside of ductwork which will inaccurately reflect how much of the static reading itself may be attributed to fan power as applied effectively or fan power being held back by undue restriction and, thus, converting to static in whole or part, again at the expense of dynamic losses. To emphasize this point, if a single duct outlet were to be capped entirely, the total fan power would convert to 100% static pressure, this never being more than or exceeding the fan's known total static pressure itself at any given point in a system.

In actual practice, SP sensing alone does not equate, per se, to a corresponding flow rate for a known device within an unknown system 5, these tested with same current methods. And technically, any "as-built" system may be called unknown. SP sensing may suffice, however, for operations whose function is to maintain pressure constancy, such as bypass/relief functions, where flow is of no consequence. The static pressure profile is suited to this as well, where a packaged unit and practical field considerations are concerned.

Figure 14C:
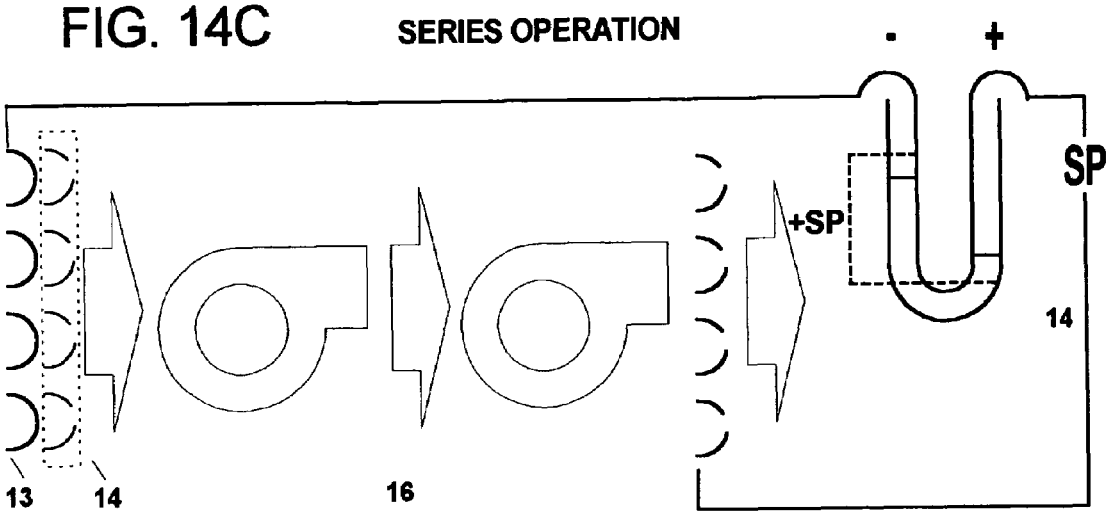
FIG. 14C depicts Mover sensor logic and augmented SP, as demonstrated by Series Operation. Optional sensor grid fitting also shown.
Figure 14D:
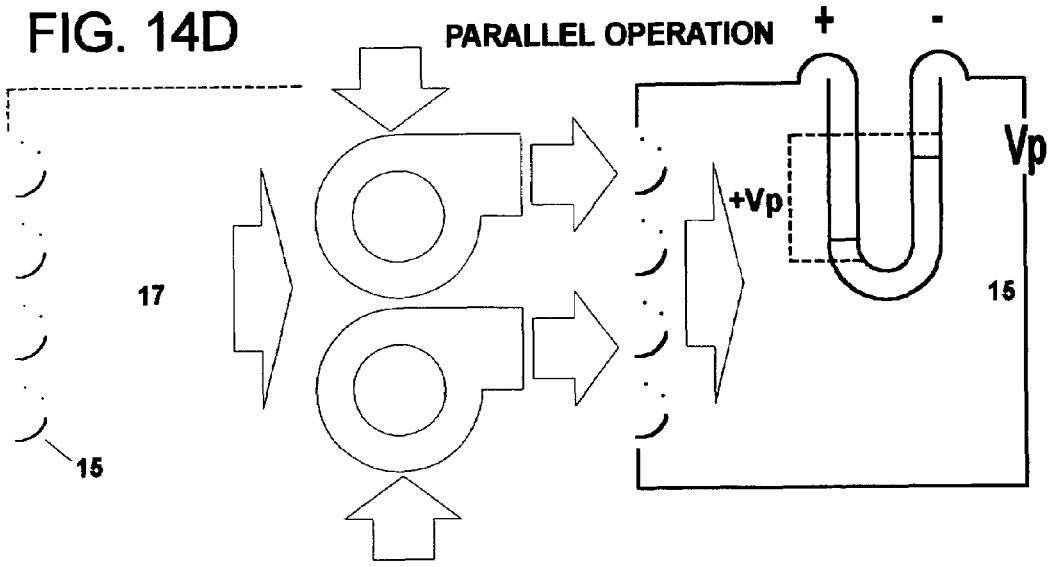
FIG. 14D depicts Mover sensor logic and augmented Vp, as demonstrated by Parallel Operation. Optional sensor grid fitting also shown.
Figure 15C:
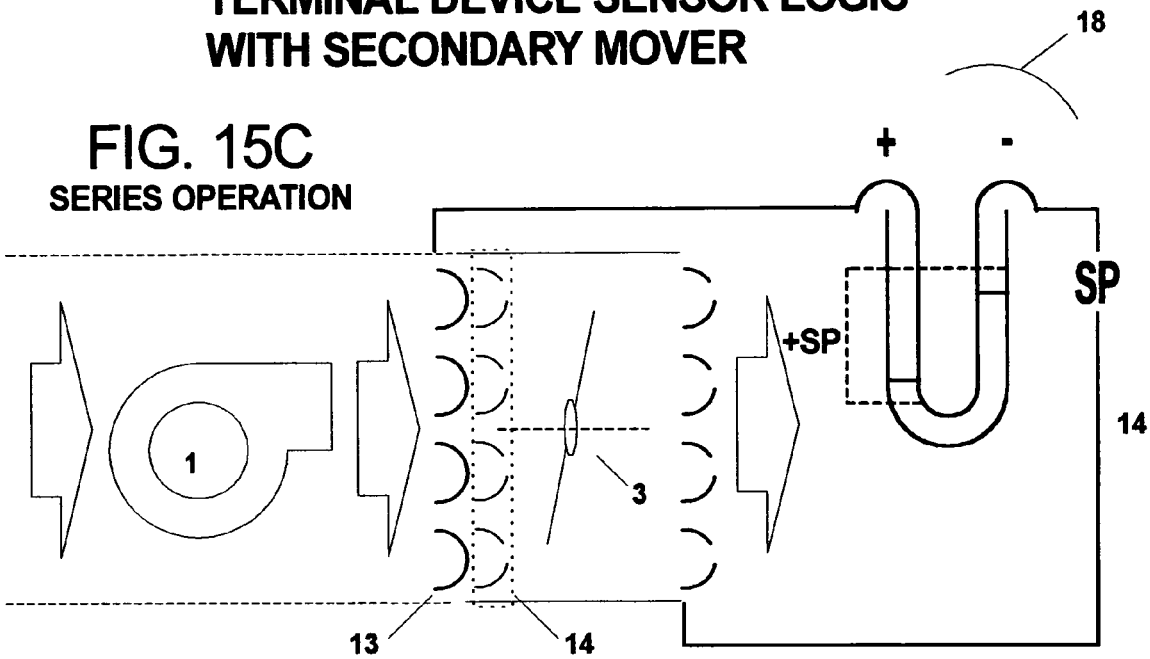
FIG. 15C depicts Terminal or In-line device sensor logic with a secondary mover in Series Operation and the resulting increase in SP.
Figure 15D:
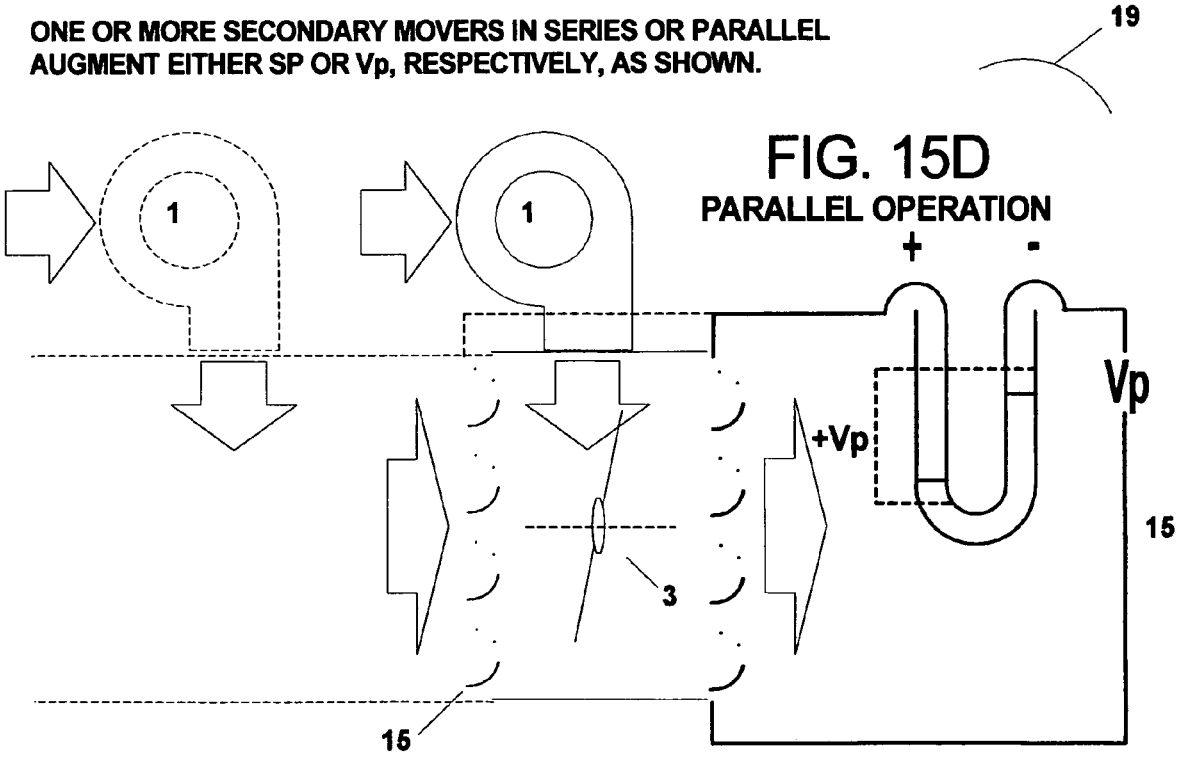
FIG. 15D depicts Terminal or In-line device sensor logic with a secondary mover in Parallel Operation and the resulting increase in Vp.

If more than one mover 1 is involved, then two or more in series 16 will combine total pressures, approximately—not exactly—in equal measure, and, conversely, parallel arrangements 17 will approximately remain constant on pressure and double on flow, assuming each are of similar size and capacity. Note the augmentative effects these arrangements have on movers in FIGS. 14C and 14D.

Mover aside, this same principle holds true for Terminal Devices 3 (in series 18 or parallel 19,) most often used for reheat cycles in fan-powered VAV terminals by introducing induced plenum air at one or more stages of heat and/or fan speed that occur intermittently. In HVAC applications, these are used primarily for perimeter areas of a building. Note the augmentative effects these arrangements have on Terminal Devices in FIGS. 15C and 15D.

Additionally, induction terminals, with or without secondary fan power, stand to benefit from higher velocities by inducing secondary air more effectively and avoiding additional fan power requirements, if not entirely.

The specific contents of the total power applied potentially throughout the system 5, will largely be determined by the primary mover 1 characteristics 11. Again, high-pressure type movers have the characteristics of higher static output with a smaller velocity gradient. The lower-pressure type, an extreme example being a propeller fan (axial type,) produces higher flow-volume at the expense of static pressure. Taking into account varying characteristics among them, centrifugal fans typically produce the higher pressures, particularly BI (Backward Inclined,) while axial fans produce high flow, high volume and are best suited to those applications, such as smoke evac systems for wide open areas.

Each basic unit is specifically chosen for the task it is designed and built for, with many variations in between affording it the benefits of either. Thus, beginning with the primary mover 1, the described control method and apparatus carries this underlying theme and the pressure gradient concept with it through to each and every terminal branch of the system 5 and this pervading point will be emphasized throughout.

However, this concept may be taken further when the context of the system is viewed as a whole environment. For example, if total system power is not available or has "ramped" down 7 to maintain a constant system static pressure and, consequently, some of the VAV terminals may be starved for air. This may be due to a diversity factor 22 and, thus, total air per terminals/outlets exceeding the fan's total capacity, as is typically the case.

If a particular zone requires more air due to load changes or unusual shifts that don't follow the predicted movement of the sun from East to West, the terminals may strike a compromise among other zones that may not require as much air flow. This may be achieved by having those terminals (usually adjacent ones) close slightly on cue, until adequate inlet flows/pressures are obtained at the terminal in question. This "squeeze" can help boost nearby zones just enough to cover lean periods and return to normal default operation.

The system may also perform a timed tradeoff, so to speak, by alternating availability of operating pressure to needy terminals, while still maintaining zone temperature set points, which will tend to linger with adequate insulation and generous load calculations whether or not the desired air changes are occurring in the building/zone.

Falling short on total system pressure (typically a static measurement) is the most common problem with current VAV systems 24, particularly those with a diversity factor 22, the end result of this often being that the VFD remains at or close to its full speed (60 HZ) operation most of the time, defeating its own purpose to begin with: to maintain constant though often inadequate system pressure and, presumably, flow rate to all branches 5 at a lower total demand on the primary mover 1. Here may lay a strong defending argument for old vortex vanes, which at least maintain a degree of system pressure, albeit at the expense of dynamic losses.

Another interactive example could involve ramping 7 the primary mover 1 down indiscriminately to conserve energy if all zones achieve their temperature set points, still taking minimum air changes (air changes per hour) and minimum fresh air requirements into account, these being predicated by ASHRAE standards and other municipal building code requirements.

This process may allow the fan 1 to slow down below its system static set point, so this factor alone is not the only deciding one. Maintaining suction pressure and flow rate, however, are often one of the most difficult challenges when ramping down or lowering fan speed 7 in any way, and the suction side or mixing box intake is one of the first casualties of lower fan speeds in the framework of an "as-built" system. One of the biggest challenges is the problem of the OA damper and mixing box controls maintaining adequate OA flow in a VAV system 24 in constant modulation, with a pressure limiting constant, and mover rotation variable 7. Designing these systems is not impossible, but the margin for error greatly diminishes and, therefore, precise flow-pressure control becomes imperative.

Mover systems equipped with the ⅔ rule static sensor are meant to maintain a constant system static pressure (usually 1.5") to protect the ductwork for its class and rating when VAV terminals throttle back and, hence, increase system static pressure, placing the ductwork under increasing duress. However, most systems' effective operation is at the mercy of where these sensors are placed, or able to be placed due to access and logistical issues. And the question remains whether these locations are truly representative of the system as a whole. Being single point static sensors in multi-directional ductwork with variable airstreams undergoing constant conversion, it can reasonably be deduced that they are, in fact, not providing uniform or reliable feedback of what the system in whole or part is experiencing, and are largely governed by a rule of thumb.

Depending on the complexity of the system 5, (number of take-off branches, fittings, etc.,) the static feedback alone will vary considerably from one definitive portion of the system to the next, especially under VAV control with widespread fluctuation at all times.

This being noted, the function of the air-fluid distribution system 5 as a whole is best served by having comprehensive, definitive, and intelligent sources of feedback from the terminal branches 3, 4, as supplied by the described method and apparatus.

System Flow Diagram

Beginning with the Primary Mover 1 and the Total System characteristics 5, the logical decision-making process will follow a "hierarchy" of the system on start up. This will lead through to each Terminal Device 3 and terminal branch, wherever a flow monitor station 4, meter, or any sub-circuit control system is located.

The sequence of operation will adhere to, but will not be restricted by the procedure of the method and apparatus as outlined in this description, though any omissions due to unknown or previously non-established effects will be duly accounted for by way of upgradeable, tabulated databases 9. These will include any and all pertinent data, such as late mover equipment (blowers, pumps, motors, drives, etc.) and late system construction components (ductwork, piping, vessels, conduits, Terminal Devices, etc.) The expandable databases 9 will also include any and all scientific/engineering data pertaining to thermal and fluid mechanics, such as psychrometric data tabulated in tenths of degrees or lower, and duct/piping friction loss/head loss tables, fitting loss coefficients, Reynolds numbers, and any K/Ak-factors predetermined or as establish with said method and apparatus.

Figure 21:
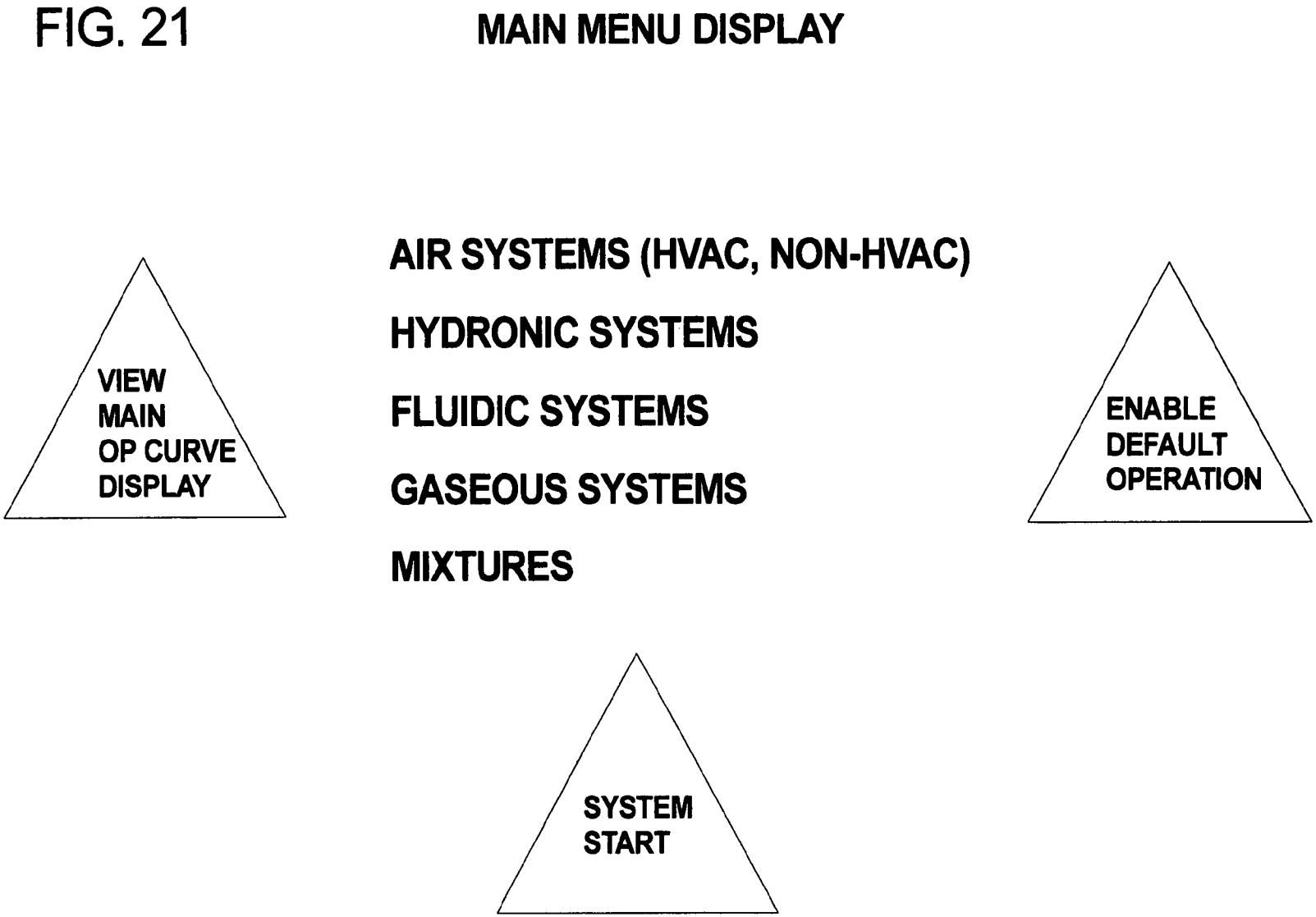
FIG. 21 depicts the Main Menu display as it might appear to offer a selection of key options, namely the type of distribution system, prior to proceeding to system start.
Figure 22:
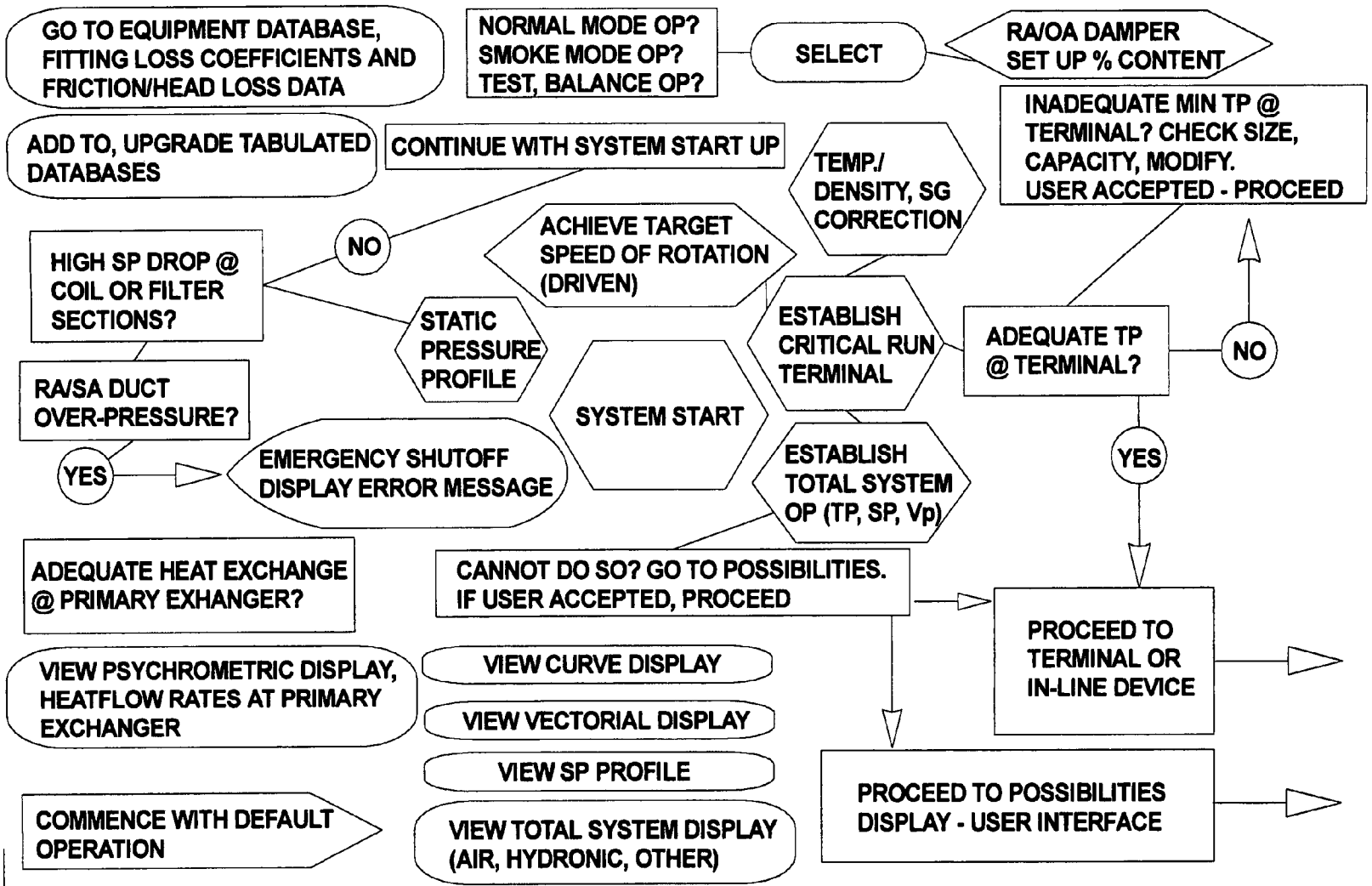
FIG. 22 outlines a basic air system flow chart with all key considerations for such a system, establishing a standard for prioritization before proceeding to each subsequent step or mode of system operation. Any additional considerations or requirements are met through an upgradeable, searchable database that covers, but is not limited to, general equipment selection, movers, terminal devices, heat exchangers, fittings, and troubleshoot possibilities.

The system flow charts may be viewed in FIGS. 21, 22, 22A, 22B, 22C, and 22D. After initial menu selection for type/classification of system (FIG. 21,) the process begins with System Start and key determination of system status, as shown in FIG. 22 (air) and FIG. 22A (hydronics.) First of all, the system will establish mode of operation, Total system OP 10, target speed of mover rotation 11, and all procedures as outlined in this description, beginning with "Initial Operating Point for System Total." 10 The schematic layout essentially reflects the structure of the user interface panel 6, where a number of key options will be available for selection.

The System Modes will establish what initial setup the primary mover 1 and main damper control 3 will have to activate for the desired mode of operation. Of these will be included: Normal Mode Op, Smoke Mode Op, Balance mode Op, and Test Mode Op.

With regard to the Terminal Device flow chart (FIG. 22B,) these options will extend to operating mode parameters, namely the following: MIN (Minimum,) MAX (Maximum,) FULL OPEN, FULL CLOSED, AUTO—HEAT, and AUTO—COOL. The MIN/MAX parameters are intended mainly for Balance Mode Op, wherein these parameters may be calibrated in an unknown or "as-built" system for testing and balancing purposes. The FULL OPEN/CLOSED parameters will be intended mainly for Smoke Mode Op, such as for purge systems or auto "shut down" systems. They may also be used for any form of "wide open" system testing, with or without a diversity, which may be done in Test Mode Op.

Note, however, that MAX conditions are not FULL OPEN conditions, as the system characteristics 5 will not be the same when marked against the mover characteristics 11, thus misrepresenting the true system operating point 10 as intended. The terminals 3 equaling the diversity amount 22 will also be either FULL CLOSED or in MIN position to accurately reflect this condition.

Other initial options include DISPLAY SYS DIVERSITY and MAP SYS DIVERSITY, a selection which allows the "as-built" system to be analyzed in whole and part under set conditions to map the most appropriate terminal runs for inclusion in the margin for diversity 22, namely those that are the least critical. This will be determined by sensor logic 4 at each terminal device 3 and value comparisons drawn after establishing the most critical run. Terminal Branch system operating points 10 will also evaluate these runs on a per branch basis, in whatever scope or portion of the total system is desired, as the gradient breakdown of these sub-systems may be either complementary or rudimentary to the primary mover. Runs may also be assessed in any mover-system or terminal device range, speed, position, and infinite or finite combinations of mover-system-device changes.

The diversity 22 then becomes another useful proponent in the system 5, and may or may not be changed arbitrarily. It may be discovered, for example, that wider diversities are available with seasonal changes or with load occupancy changes. Otherwise, a fixed diversity amount is pre-established for specified conditions.

ZONE SENSOR FEEDBACK may also be prioritized, localized, averaged, or omitted for any particular zone or terminal device. This way "crossover zones" and other undue external influences won't cause the system to misinterpret load changes or demands for that zone served by the terminal branch. Also, the sensing logic may be oriented around areas that reflect the largest, smallest, or mean demand, as selected. Results will differ with each project, but the method and apparatus provides the tools to best tailor these variables on a per project basis for the desired results, thermally, statically, and dynamically.

FIG. 21 shows how the main menu display 6 might appear to allow selection from a variety of distribution systems 5. It also allows the key option of enabling DEFAULT OPERATION. This option will produce the best results when the described method and apparatus is used from origination, but may also function in an "as-built" system that has undergone initial testing utilizing said method and apparatus. Essentially, it will place all components of the primary moving unit and system at settings that will be indexed according to its own pre-established criteria or suggested operating ranges 12 for movers 1 and Terminal Devices 3.

This initial mode of operation will also enable the system to "learn" about how the many variables in the distribution system come together to provide the best results, desired results, or most effective operation through computer-assisted calculation of run possibilities and diversity mapping. In this sense, it may function as an AI (Artificial Intelligence) system. Limitations will be imposed only by the size and scope of its database, and this will grow in short time with empirical testing utilizing the principles and procedures outlined in this description. Ultimately, its faculties allow it to interpolate rather than extrapolate data, which is a key fault in current theoretical projection of "would be" system operation. As mentioned previously, this problem stems from contingency rather than necessity.

Given the size and scope of currently available data in aging, though neglected reference texts, an enormous lexicon can already be built on existing data alone which has until now remained untapped. Adding to this problem, many fundamentals have been grossly overlooked in current systems and crucial lessons in the advancement of these technologies have been skipped. Simply identifying these may solve long-standing problems in the state of the art. Such a lexicon can be advanced and cultivated by the described method and apparatus, allowing it to achieve omni-presence in environmental systems through sensory interpretation where this was not previously possible.

Figure 22A:
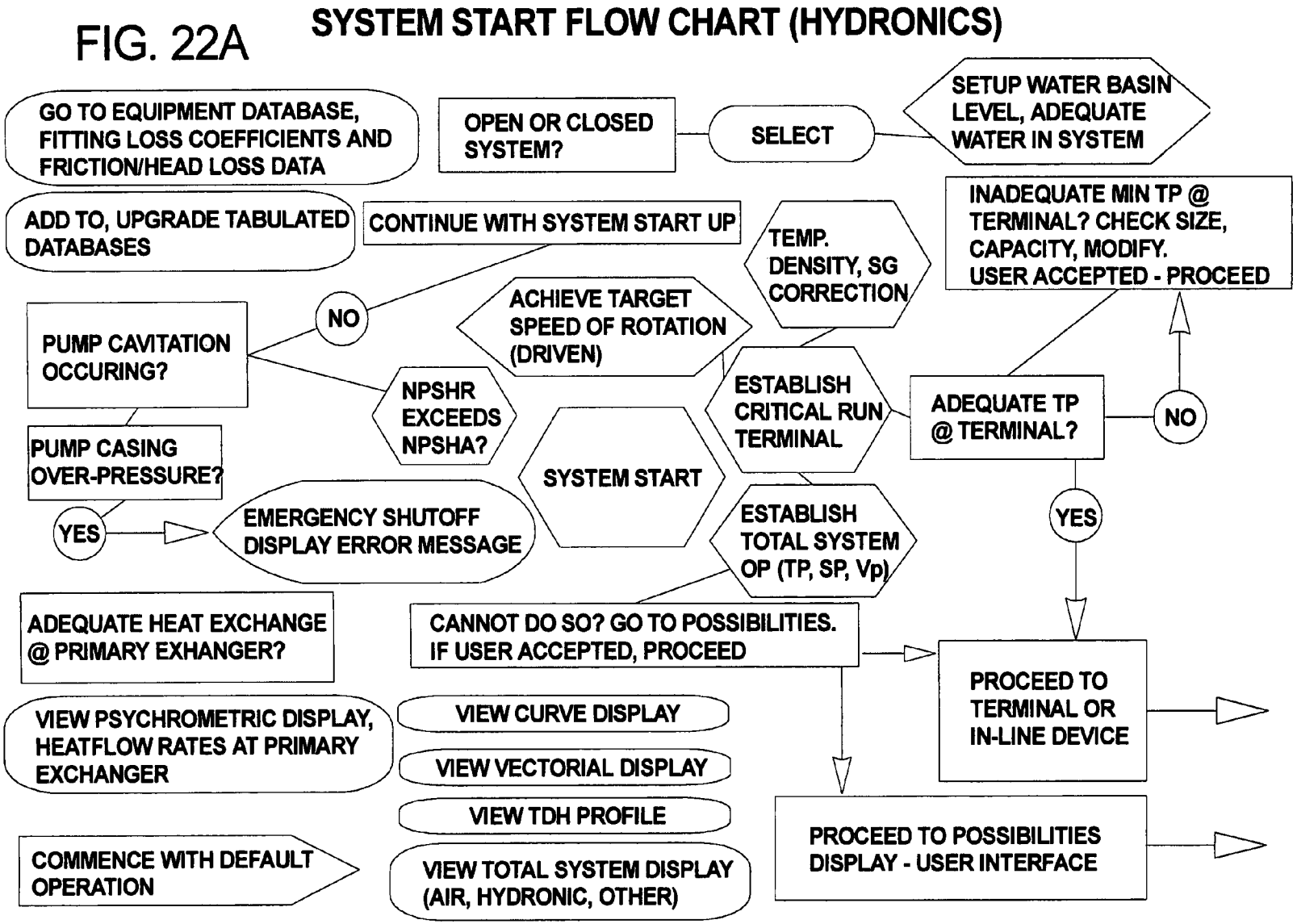
FIG. 22A outlines a basic hydronics system flow chart with all key considerations for such a system, establishing a standard for prioritization before proceeding to each subsequent step or mode of system operation. Any additional considerations or requirements are met through an upgradeable, searchable database that covers, but is not limited to, general equipment selection, movers, terminal devices, heat exchangers, fittings, and troubleshoot possibilities.
Figure 22B:
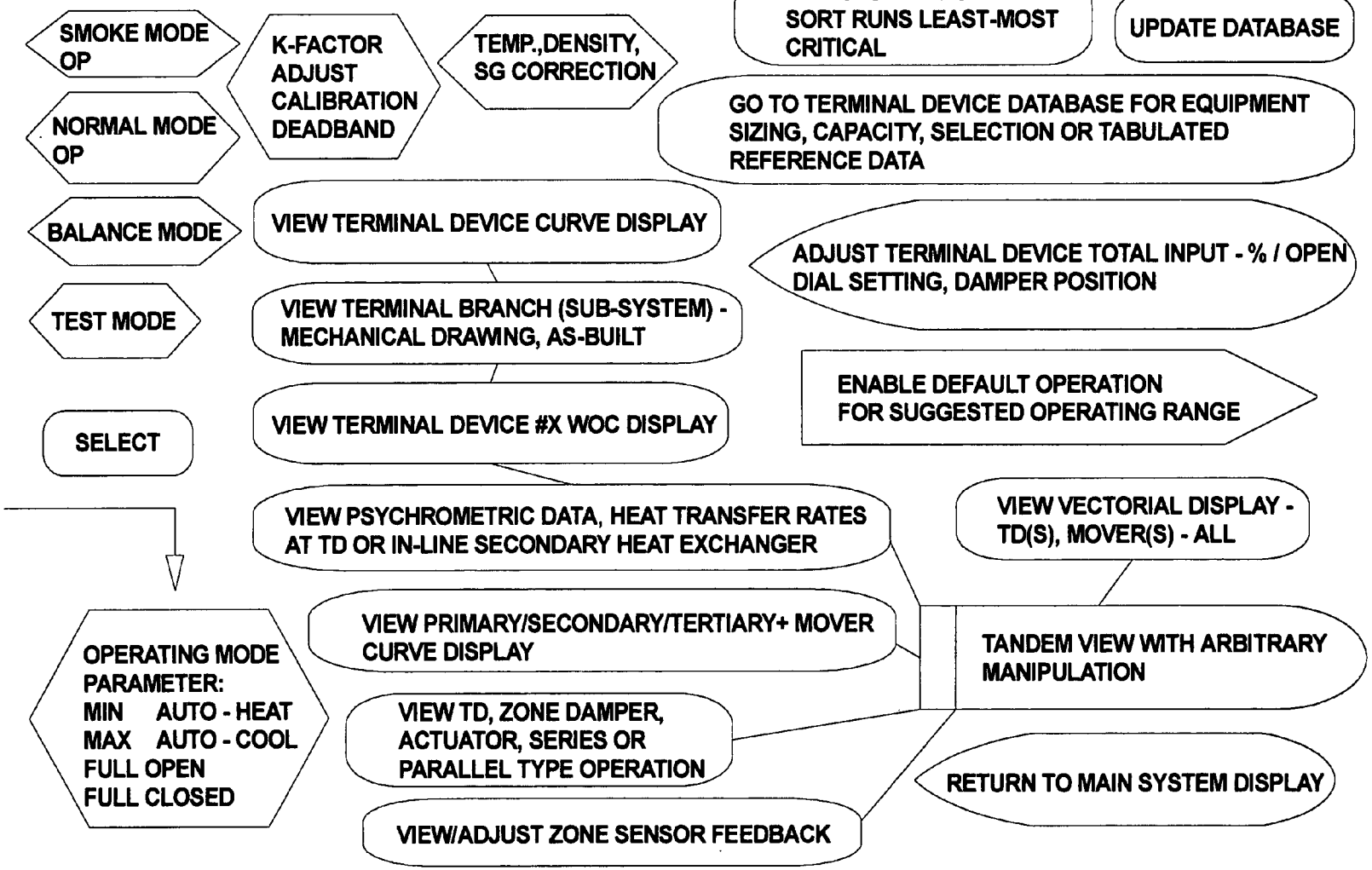
FIG. 22B outlines a basic terminal device system flow chart with all key considerations for such a system, establishing a standard for prioritization before proceeding to each subsequent step or mode of system operation. Any additional considerations or requirements are met through an upgradeable, searchable database that covers, but is not limited to, general equipment selection, movers, terminal devices, heat exchangers, fittings, and troubleshoot possibilities.

FIG. 22 illustrates the air system flow chart. FIG. 22A notes the key differences for a hydronics system 5. FIG. 22B represents the layout for a terminal device 3, after initial system setup has occurred and proceeded to this point through user acceptance or default setting. Finally, FIGS. 22C and 22D present a Possibilities Display Menu for air and hydronics systems, respectively. This is intended for troubleshooting hardware equipment failures that would prevent the system from proceeding through each sequence or step of its operation. The notable feature employed in doing this involves using described methodology and sensor logic for determination of where the problem originates from, namely whether it is internal or external to the primary mover 1 and/or terminal device 3. It will also determine the nature of the problem by the gradient inclination (TP, SP, Vp) outlined in this same description. The Possibilities Display 6 is also supplemented by an expandable database 9.

Vectorial Analysis

Figure 19A:
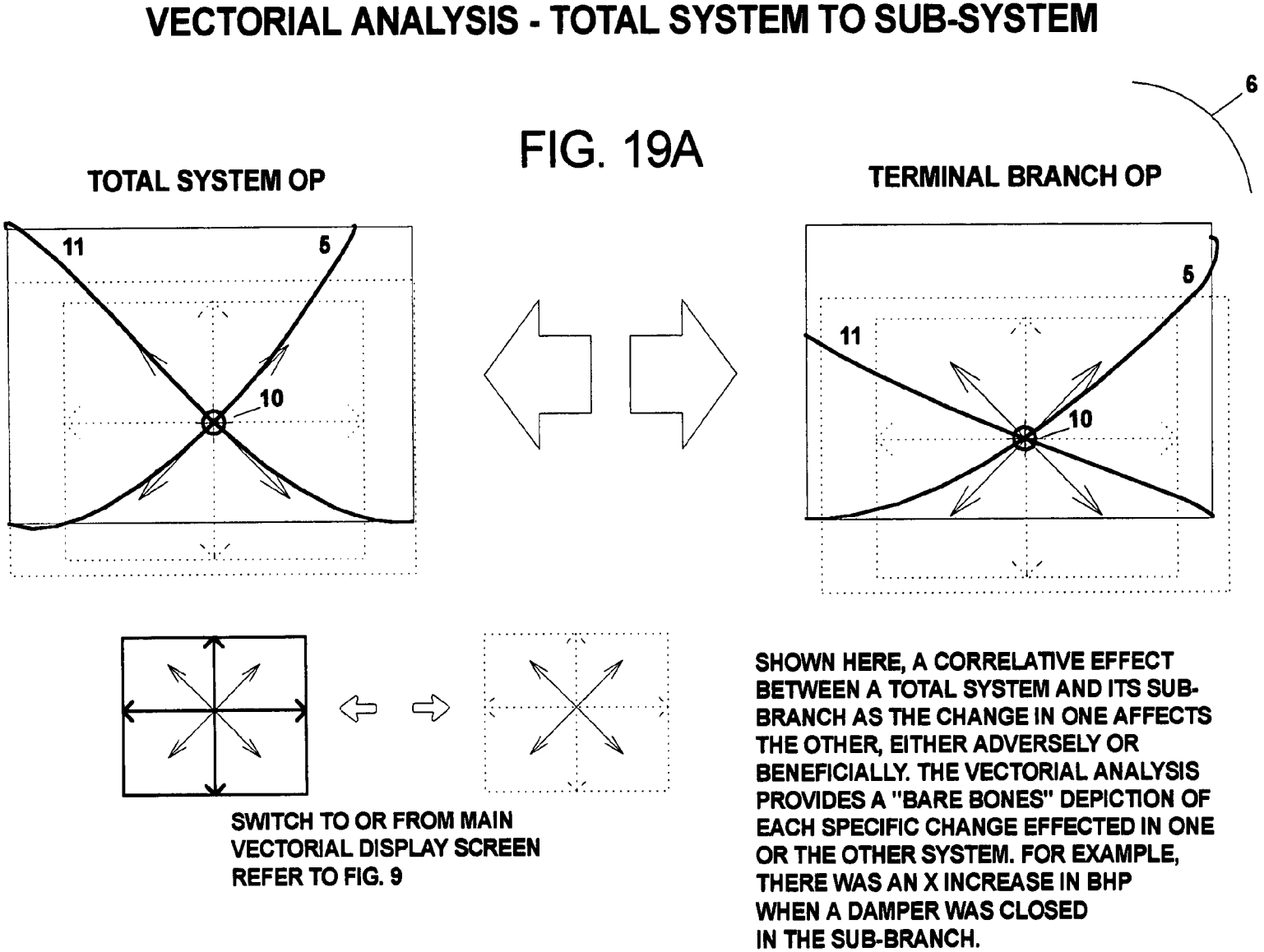
FIG. 19A shows a Total to Sub-System Vectorial Analysis where a correlative relationship may be drawn between these or any other system components generating such a curve or movement vector. This framework is transposed on the main curve display screens, or may be viewed independently to show a "bare bones" rendition of any and all effective changes as mover-system adjustments are made arbitrarily or automatically through default operation.

FIG. 19 and FIG. 19A show a vectorial depiction of all mover 11 and system 5 changes which may be viewed superimposed on the actual main curve displays 6, or viewed separately as changes occur in real or sampled time periods. This provides a "bare bones" rendition of any desirable or undesirable changes, which may be occurring within each component of the system. The vectors may also portray mover and system changes imposed arbitrarily when viewed as a whole or independently. In whole or part, each component may be compared and contrasted.

One example would show how changes to a sub-system affect a primary mover's BHP and SP, or vice versa. The encircled cross hairs represent the total or sub-system OP (operating point) 10 and this may be user-manipulated for design or testing purposes, so the total and terminal effects of an entire air-fluid distribution system may be viewed prior to any system being built.

Using known equipment data as referenced from its own database or other accepted sources, the method and apparatus can function as a virtual system for HVAC or air-fluid distribution system performance.

All equipment performance and selection data may be provided, from primary mover 1 and terminal device 3 sizing down to final drive 7 adjustment to the motor, though this data may be too precise for actual stock sizing available. Whatever resources are used, an added claim stands to improve the precision of equipment sizing if said method and apparatus is used from origination.

An upgradeable, catalogued database will be referred to in the course of system design and selection, though ultimately, this will be a user decision. Actual system and sub-system data will draw from database storage of ductwork/piping/vessel fitting loss coefficients and friction/head loss data, as this may need to be stored and retrieved from a timely source. Equipment sizing and capacity may be entered manually, however, from tabulated data or other reference materials as an added option. User or default options will allow flexibility in this area. Ultimately, if computer assisted design is integrated from the design stage, system data may be carried over from this stage, whether fully automated or prepared by tabulated references and calculation.

Fluid changes may also be viewed in tandem with load (heat flow) changes, so one may visually depict how the other is compromised or augmented by the changes. This display may be shown in any form, number or combination of components, depending on the size and scope of the entire distribution system.

Final Recommendations for Equipment Sizing, Capacity, and Performance

After the described method and apparatus performs the task of evaluating the entire system and all of its components, it will collect, calculate, tabulate, and display the results of its findings from a key menu list beginning at the top of the hierarchy for that system, from the primary mover on down. There may be one main menu listing all directories and/or sub-menus if, for example, there is an air system and a hydronics system with chillers and a cooling tower. These key categories can be separated according to their classifications and mover characteristics, this being a pump in the case of a hydronics or fluid delivery system.

The final collation command may be requested when the building management systems operator or, more appropriately, the testing and balancing agency, has decided that the preliminary testing, with existing conditions being constant, has been performed to requirements and meets acceptable standards. The findings may be accompanied by specific recommendations and sizing or re-sizing of equipment capacities for first cost or long-term benefit, or this may be left open to interpretation by simply presenting objective final results in the form of plotted curves 11, 5, operating points 10, and statistical figures evaluating all relevant components of the system, including individual and total final power input/output. The presentation of this information shall be orderly and reflect key aspects of the distribution system in a clear and concise manner, emphasizing a standard for prioritization.

The final deduction of all system characteristics will be reduced to total power (or wattage) consumed by the system in whole, along with the power produced by the primary mover. Totally and terminally, this may all be broken down into BHP, kilowatt input/output, and BTUH or MBH heat flow. Following this, a breakdown of the system's individual components will be analyzed, including specific heat transfer in BTUH and effectiveness of heat exchangers. Parallels may be drawn between air or fluid flow and electrical flow, with each system component having its own characteristic effect on localized and general power draw.

Typically, amperage use will increase in high velocity applications and, conversely, voltage will increase in high-pressure applications. This way, the actual contents of Total Power may be assessed and tailored to specific systems. A more detailed analysis may identify how various conversions of TP throughout the system play on the total system power draw under varying loads, demands, and differing conditions as arbitrarily set.

If shop drawings are available or integration with a computer assisted design system becomes possible, the sizing, shape, and fitting of all main and terminal branch runs 5 will be suited to or contrasted against known or projected operating points 10, based on intended design or "as-built" configuration.

Motor and Drive Replacement Recommendations

Using the following equations, the method and apparatus may recommend pulley and drive sizes as well as motor sizes 7 by direct BHP calculation, if required. Also, "tag" HP may be obtained from stock sizing, as would be readily available from its database.

FRPM MRPM=MPULLEY SHEAVE DIA./FPULLEY SHEAVE DIA.

FRPM—Fan RPM (also, driven RPM)
MRPM—Motor RPM (also, driver RPM)
D—Driven Pulley
d—Driver Pulley
C—Center Distance—Bore to Bore
L—Length of drive belt The FRPM, or driven speed of mover rotation 11 required, is determined first from actual total capacity CFM of the primary mover 1 and corresponding FRPM at this flow rate as tested within a real "as-built" system under constant, pre-established conditions. All data is obtained from the sensing apparatus as previously described.

If the flow rate does not meet the specified amount totally 2 or terminally 4, a complete review of system characteristics 5 may be required, and said method and apparatus 25 provides all the means for doing so. This would bring under scrutiny any ductwork, fittings, terminal devices, or other components of the system that may contribute to this adverse effect, as previously described.

If the system is otherwise accepted, the relationship as follows is direct to flow and, thereby, a new FRPM and corresponding driver pulley size is calculated for the new required flow rate. Alternatively, a fan pulley size may also be provided, though this method of adjustment is generally not recommended if the fan falls below a 1:1 ratio with the motor pulley, along with other motor-mover considerations involving stability of operation and maintaining an adequate center distance. For prevention of early wear and failure, the angle of drive belt to pullies is usually kept under forty degrees. Erroneous drive choices, however, will be limited by stock sizing guidance in that incorrect drive arrangements will normally not be compatible with motor frame, bore, and other standard sizing, unless there are more serious design flaws.

Belt size: $L=2C+1.57(D+d)+(D-d)$ SQ./$4C$

FRPM ratios are cubed to brake horsepower, so the projected FRPM determined at the final required flow rate of the given system 5 will also provide the suggested brake horsepower required at this operating point 10. We must assume, however, that the original design figure and catalogued equipment characteristics have been correctly applied for this logic to work. It must be remembered, however, that an element of contingency still remains here. An estimated FRPM and resulting flow rate 2 may be figured by pulley and motor tag data, along with any mover performance curves 11 provided by the manufacturer, though this use would be suggested only as an additional point of verification.

Note that fan speed 11 and BHP calculations from actual power draw are considered the most reliable field measurements in an "as-built" system 5 and static pressures are the least. This again supports the need for dynamic and total sensing considerations, because where unknowns exist, they may always be determined with the described method and apparatus through interpolation of available, correctly obtained data. Between Total Power and Total Pressure breakdown, there will be no unknown that cannot be deduced (as opposed to induced) by this method and apparatus under actual operation of a real system. And prior to this, the projection of design operation will be most accurate if the method and apparatus is used from origination, this simply making any extrapolation of performance characteristics more viable from the outset.

Ultimately, the test required to establish the "Initial Operating Point for System Total . . . " 10 will re-affirm true performance characteristics once repeated by the method and apparatus with the new motor and drive configuration. This initial process will establish the real OP 10.

Normally, if the deviation is not great, the same motor and drives 7 may be used, if there is a VP (Variable Pitch) adjustment 7 with room left on the driver pulley for an FRPM increase or decrease. An increase will also increase amperage draw on the motor, which should not approach or exceed the service factor on its tag, and this will be the usual common sense indicator to those practicing the art that a motor and pulley change may be required if flow rates and pressures are still not achieved. In some cases, only a pulley adjustment may be needed, just until the motor is drawing full load amps. Beyond this, a motor change at the corresponding BHP or stock size equivalent may be necessitated. If stock and frame sizes are greatly exceeded or receded, this is usually an indicator that the mover is improperly sized or that the system connected thereto is ill suited to its primary mover.

Hardware Requirements

Hardware components governing the method and apparatus will be comprised of a central processing system (micro controller) 9 in one or more locations, and sensing elements 13, 14, 15 in arrangements described and depicted 2, 4. Local control through open architecture, or Ethernet reflect some of the prevailing trends in building control systems and the described method and apparatus may or may not be accommodated to fit with these current trends for compatibility.

Logical processes and programming shall conform to but not be limited in scope of operation by flow charts as shown in drawings. The main control system 9 may be implemented through any programmable micro controller 9 or EEPROM with typical inputs/outputs and universal logic control. Displays 6 may be either full monitor stations or smaller push-button panels for complete or retrofitted systems. The user interface 6 will have portability for connection to local LAN's (Local Area Networks,) or more centralized networks. Whatever the hardware or software, or operating system technology employed, the system remains as a separate and distinguished entity not bound to conform to any existing or novel hardware/software system limitations or restrictions.

When terminal flow device 3 characteristic curves 5 and system curves 5 are being established across a full range of damper/valve motion, the micro controller type and quality will determine how resolutely and, hence, precisely the range can be monitored. The micro controller will interpret and process the transducer signal to a degree of precision afforded by its own internal scale. This range will also define the incremental spacing within the parameters of the damper/valve's full range of motion from 0 to X flow at given pressure gradients.

As stated in the background, the analytical plotting of curves 5, 11 will supercede current systems' linear tendencies by establishing the described thermal and fluid mechanic relationships prior to effecting motor control 7, 3. This avoids direct modulation along the processor-motor controller's linear scale of motion, as current direct-acting control systems are prone to slavishly follow. Precision will also be afforded by the quality of the sensor transducers, which convert the pneumatic or fluid signals into electrical ones. Notwithstanding hardware limitations, the operating principles of the method and apparatus will be retained and results will only improve with hardware development.

A stepper motor or similar motion control device shall be the recommended means of damper/valve control 3 employed to establish a clear, graduated range of motion in harmony with the micro controller's 9 capabilities, and each increment will be broken down into radians of motion to precisely coincide with percent or degree of damper/valve closure.

Sensing instrumentation, in its most basic form a U-tube manometer or micro-manometer, will "sample" flow rates and pressure gradients, thus a timed, metered signal may be generated in every one second or higher intervals, also dependent on the nature of the micro controller. The readings are then averaged within a given time frame. This sampling duration variable may be set arbitrarily, though a five second sampling of a sensor transducer signal is commonly adapted when taking an "instant" reading. Other more precise applications, however, may require sampling occurring within a fraction of a second, such as that described in "Determining the Volume of a Given Vessel or Enclosure" embodiment description. A sampling's total duration may be entered arbitrarily in the TEST MODE of the method and apparatus for a short or long-term analysis, as desired or specified. Alternatively, flow rates, pressure gradients, thermal relationships, temperatures, and overall mover and system characteristics may simply be monitored in real time with all related factors coming into play.

Overview

The total flow-pressure power passing through the measuring device (TP) is made up of SP+Vp. It is known that these two are mutually convertible at various points in an air-fluid distribution system and that TP decreases in the direction of flow. Static pressure tends to regain some ⅔ of the way into a duct system after exiting the mover's discharge; at this starting point much of the mover's total power being in the form of pure velocity, until it "solidifies" into pressure downstream. The method and apparatus isolates these key analytical elements and determines their specific usefulness within an air-fluid distribution system.

The method and apparatus will determine how much of that total power is in the form of dynamic flow and how much is in the form of stagnant air, gas, fluid, etc. When TP=SP, there is no dynamic flow, hence zero velocity. The total applied power is in the form of 100% static pressure so long as mover power is applied. For a flow control device and primary moving system as a whole to assess useful flow characteristics, the TP must contain the right measure of both ingredients for the intended purpose. Both velocity and static pressure gradients are needed to provide total "strength" in distributing air-fluid to various parts of the system with a changing ductwork/piping landscape.

A preponderance of one or the other elements typically creates an imbalance, though it may also provide a useful purpose if manipulated. For example, velocity-based flow's notable characteristics are speed, volumetric flow, inductiveness, and penetrating ability. Namely, this type of air movement establishes the flow rate or flow-volume (CFM) passing a given cross section of the duct. High velocity jets are known to foster the induction process, for example in induction terminal boxes with a primary nozzle supplying high velocity air, which induces a secondary air stream of a relatively higher pressure.

Static pressure provides the lateral force needed to overcome friction losses (or length of run, which may include roughness factors) and may exist dormant within the system as pent up potential energy that may once again be expelled in the form of velocity during the conversion process. This occurs at various points in the system, as dictated by expansion, reduction, and direction in ductwork/piping fittings. These components can be compared to amperage (rate of speed, kinetic movement, cycle) and voltage (applied pressure or force, potential energy) in electrical engineering or general scientific terms.

There are three key forms of losses associated with ductwork air distribution and fluid distribution in general: 1) Dynamic losses, associated with fitting loss coefficients and measured against velocity. 2) Friction losses, associated with length of run and roughness factors on the surface of ductwork/piping/vessels, all measured against static pressure. 3) Leakage losses. Simply put, holes in the duct/piping/vessel bleeding air-fluid at a defined, constant rate per surface area. This may be in the form of exfiltration (going out) or infiltration (coming in.)

In current practice, specific losses, namely dynamic, are ultimately converted to "inches of static pressure," the common accepted language for sizing of mover characteristics. The length of run is already based on an assigned static/head loss per 100 ft of ductwork/piping as determined against round duct conversions or piping charts. Finally, a tally of all losses is made and figured in "WC units of total static pressure, or Total Feet of Head in the case of hydronics. This figure is then plotted as the Total Static or Total Head system curve. Ultimately, the primary mover's total power must meet or exceed this sum amount within acceptable tolerances. However, the dynamic aspect of this equation is not apparent to a flow sensor that measures only static pressure within a system, or only velocity pressure within a system. Even total pressure as a solitary gradient within a system is not adequate. Current sensing equipment cannot differentiate between the three after the fact, after the design total is figured from semantics based solely on a general rule of thumb or other pre-conceived ideas.

Beginning with the primary mover 1, the said method and apparatus's unique sensing functions 9 extend to the system 5 as a whole and make it a complete, stand-alone system with no previous platform derived from current systems. The method and apparatus of total and terminal control is able to measure every aspect of air-fluid and thermal flow broken down into its prime components and make valuable, calculated assessments as to its usefulness or inadequacy for the specified purpose. It also plots exacting curves of all pertinent performance characteristics, including that of the primary mover 1, terminal flow control 3 and heat exchange devices 8, and their correlation to main and sub-branches 5.

Percentage of Content (SP and Vp of TP)

Just as mixed air streams have been tested to establish percentages of OA/RA content of Total Air, similarly, the specific content of SP and Vp of TP (Total Pressure) can also be established. The percentage of content will also be indexed on a user interface 6, along with juxtaposed performance curves 5, 11.

Ideally, a shop drawing may be required of all "as-built" ductwork to obtain exact fitting, area, and length of run dimensions to determine exactly how these pertain to the monitored flow-pressure characteristics 2, 4. The described database may also contain all this standardized information for immediate reference and curve plotting, particularly if created and stored on the same system or retrieved from a computer file.

Varying flow characteristics are necessitated in a broad range of technological applications, from providing a defined sweep pattern of airflow across a clean room to applying exact amounts of room pressurization differential in a hospital operating room, or within some contained vessel. Particulate control and highly articulated control of mixture/gas delivery may also be achieved. Smoke control and related systems stand to benefit from this method and apparatus as well.

Smoke Control Systems

Generally speaking, smoke evacuation (or exhaust) systems require high volume, high velocity flow for evacuating smoke as quickly as possible from large open areas, such as hotel or condominium lobbies, convention halls or auditoriums. On the other hand, smoke purge (or pressurization) systems require higher pressure-based systems to purge egress corridors and create pressure "sandwiches" that isolate occupants from an area of incidence where a fire and resulting smoke originates. This area is in turn evacuated (exhausted) or system shutdown occurs to prevent further migration.

Purge systems also serve to pressurize stairwells and elevator shafts, two highly critical concerns of a smoke control system, particularly in high rise buildings that often experience high pressure loss and fluctuation due to building envelope leakage, infiltration or exfiltration. This is particularly true of elevator shafts, which suffer the most from this problem and, additionally, have an extensive roughness factor due to CBS construction. If not adequately pressurized, however, they may be susceptible to becoming a vehicle of smoke migration. Still, this remains a source of debate due to many other influential factors coming into play, namely windage and building stacking effect.

A building stacking effect is formed by a downdraft in warm climates and an updraft in cold climates occurring in the building core elevator shaft. These drafts are mobilized by indoor and outdoor temperature differentials that influence the pressure profile from top to bottom of a building. This effect can only be overcome with correctly applied fan power, a possible relief system, and consistent distribution from top to bottom. Windage is also an influential factor, creating a positive influence on the windward side and a negative one on the leeward. This occurs through infiltration/exfiltration of the building envelope, tending to "skew" the pressure profile of the shaft like an uneven deck of cards.

Clearly, this problem presents a design-build challenge from any perspective. Above all, these influences leave little margin for error in providing adequate pressure in any tall column, such as a stairwell or shaft to be purged and, thus, made immune to smoke infiltration. An extensive length of run and roughness factors, due to the vessel not being a smooth conductor, necessitates a high-pressure application. Distribution aside, correct mover selection to start with is the key remedy in smoke control systems. Typically, vane-axial fans are used for "evac" systems, and higher-pressure BI centrifugal fans should be used for purge systems where taller buildings and extended shafts or columns are concerned.

Other Uses

Another basic example involves the portion of an air distribution system where air exits into a conditioned space. The discharge point where the terminal air outlet (diffuser) is located requires a high velocity content to develop an adequate throw pattern, isovel, and overcome fitting (dynamic losses) associated therewith. The air requires a total "push" to move it an adequate distance, then requires a speedy delivery for its final exit. However, the primary air temperature, the room temperature and its pressurized (stagnant) or otherwise fluent condition, all contribute to the form of the isovel. These factors also determine the throw and speed and in what manner the room air (secondary air) entrainment occurs under the terminal discharge of the air-fluid, prior, of course, to its re-circulation. Thus, utilizing the method and apparatus, throw patterns can be more precisely applied and formed in exacting detail with both thermal and fluid mechanics considerations. In this usage, zone sensing may be applied to control the effect of the given room, vessel, or any other enclosure. The isovel may perhaps be viewed with thermal or infrared viewing to observe its actual shape and filigreed form. Such an observation may serve a purpose with other fluids, such as gases or air-gas mixtures with or without combustion and/or thrust being produced for specific and useful work. In this sense a terminal diffuser may be likened to a thrust nozzle, a fuel injector, or any terminal device of delivery.

The room, compartment, or enclosure itself may also be viewed as a contained vessel against which static pressure is measured, or against which a differential static pressure is measured from room to adjacent room/area. Typically, the arrangement may be such that all rooms within a building are relatively lower in pressure to this core area up to the outer bounds of the building envelope and out to open atmosphere. This function may serve a room pressurization application, such as that used for medical or clean rooms. Using the method and apparatus and the knowledge that precise force can be applied where 10" WC equates to 5.2 lbs/ft Sq. of force over area, this may be used most effectively. The environment can also be controlled under varying conditions to meet preset parameters for desired building pressurization. This may be done on a per room basis with a consideration of all rooms and changes incurred such as opening doors.

Additionally, heat transfer increases and decreases with velocity changes in forced convection or counter-flow systems, depending on mass flow rate and total enthalpy transferred. Using the described method and apparatus, heat transfer may be precisely controlled at terminal heat exchangers in cooperation with temperature/density/SG changes of air and fluids for maximum effectiveness.

Other portions of a distribution system may reap the advantages of high velocities to overcome such obstacles due to low flow coefficients and overall high dynamic losses. Alternately, higher static pressure will carry the air-fluid through longer straight sections and provide precise pressure application where needed.

Summary

The overall planned approach presented by the method and apparatus, which applies the key gradients in the correct measure where and when needed, will allow the conversion process of SP and Vp throughout a given distribution system to preserve the utmost Total Pressure, this all the while decreasing in the direction of flow. As a result, this will be considerably more than if it were squandered through neglectful design and sensing considerations.

Additionally, evaluating this effect in exacting degree at various portions of a distribution system will create lower horsepower demand and lower total power required to perform specific tasks at any given time. High-pressure systems may always be needed for some applications, but achieving a tempered balance is one solution to fluid distribution problems that ultimately create high demands on total system power through overuse of static pressure gradients and misuse of dynamic flow.

Dual Damper Control Embodiment

To present a key example of how a primary mover and a terminal control device may work in conjunction for a desired effect, note FIG. 16, Series Operation 18, and FIG. 16A, Parallel Operation 19.

The primary mover 1 (or blower in this example) is equipped with a VFD (Variable Frequency Drive) or some other form of speed control 7. Driven speed of rotation is understood as being direct to flow-volume (CFM.) In short, fan rpm direct to flow, flow squared to pressures, and flow-from ratios cubed to brake horsepower.

In this example, a known flow rate and Total Pressure as supplied by the blower 1 pass through the terminal device 3, less losses; these created by overall pressure drop of the terminal device from inlet to outlet, length of run, flex fittings, and finally, terminal outlet diffusers downstream of this. Coefficients and other tabulated factors are supplied by the system database.

Let us theoretically assume that the pressure content of the Total Pressure produced by the fan is 50/50, 50 percent Velocity Pressure and 50 percent Static Pressure and the primary mover 1 is operating at 50 percent capacity (30 HERTZ,) these conditions to be understood as the normal operating conditions, all dampers fully open and the system curve reflecting this design condition.

Suppose that the primary damper-actuator 3 were closed to 50 percent, noting that this degree of closure is not direct to pressure drop, as this depends on the damper/terminal device 3 characteristics. For this example, we will assume that flow has also dropped 50 percent from its previous "wide open" condition and overall pressure has dropped to flow-squared, or 25 percent.

The desired effect would be to increase the Static Pressure content of the Total Pressure by creating an "artificial" system curve 5 when throttling the damper 3. The velocity portion of the equation has been substantially reduced and the remainder of the Total Pressure has been converted to static for the desired effect, whether this be to overcome more length of run losses or some other specialized purpose.

Keeping in mind that some Total Pressure is lost fore of the system in this process, the total system curve moves up and to the left along the mover's curve. 11 FIG. 12A If not interpreted correctly, the above action could be misconstrued as being an indicator of undue system restriction 5, or conversely, adverse mover performance 11. One is contingent upon the other.

In this case, we are proceeding with the assumption that the mover and system's performance curves 11, 5 are known and firmly established. If one is known, the other may be established using said method and apparatus, as previously described.

Leakage losses will be indicated by any deviation of the system curve 5 in the opposite direction from a firmly established starting point 10—this down and to the right, along the mover's steady curve 11. FIG. 12A. This issue is specifically addressed under leakage tester embodiment.

If a closed damper 3 in a given system 5, for example, were unknown, then a false system curve 5 would be plotted, not reflecting actual "full flow" conditions. However, in this example, the throttling of the primary damper 3 is deliberately imposed to create a desired effect. Again, because Total Pressure loss occurs fore of the system due to the damper's throttling, the frequency drive must ramp up to the appropriate level 7, increasing fan power used if the Total Pressure is to be maintained aft of this primary damper 3; keeping in mind when blower changes are effected that the blower's curve 11 moves along the system's curve 5 to its new driven speed of rotation. FIG. 12.

Figure 6A:
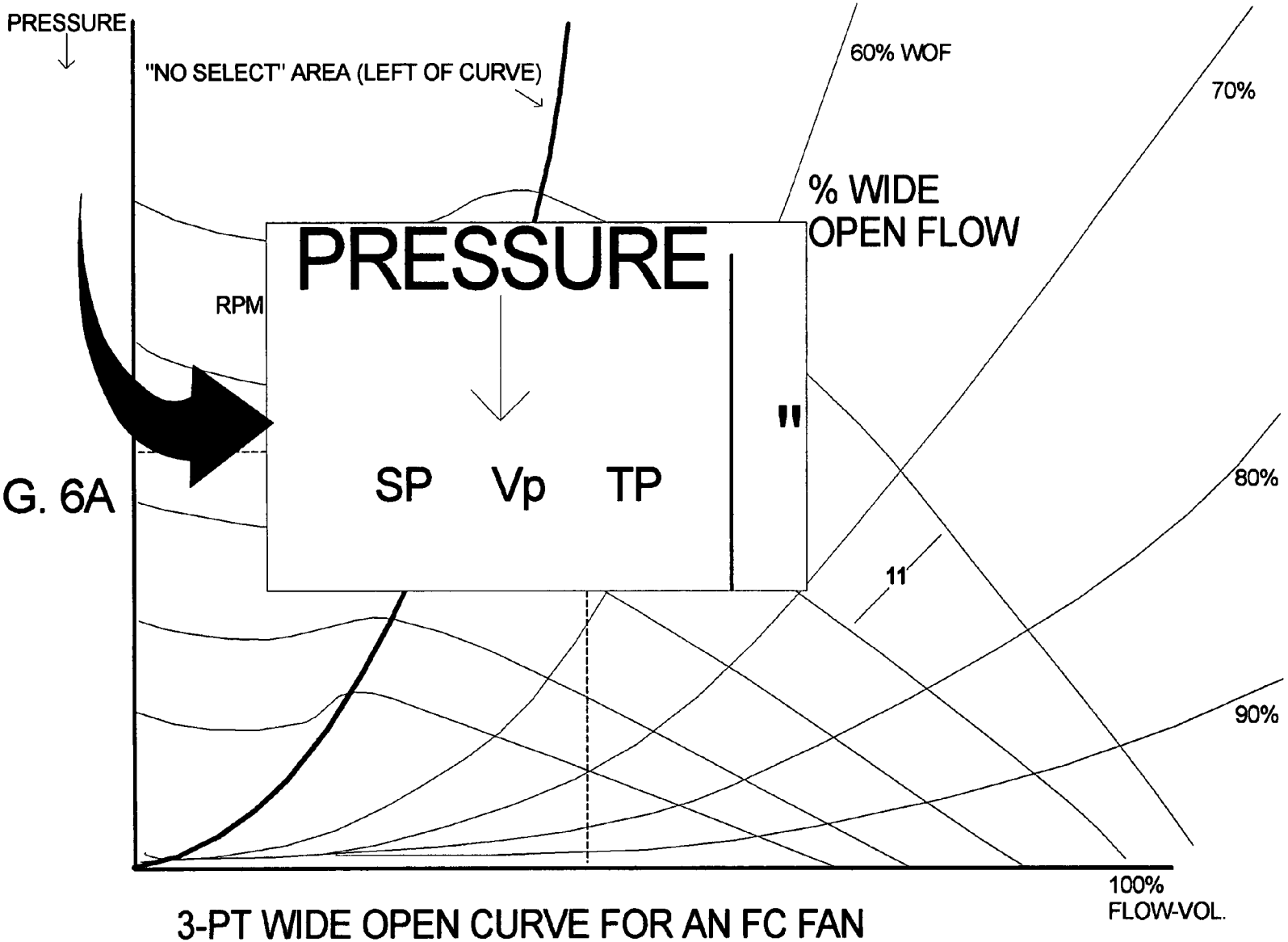
FIG. 6A depicts a mover "wide open" curve with three part pressure option displayed as made possible by said method and apparatus.

This data may also be viewed on the mover's wide open performance curve across a full range of speeds, each being independent of the other when held constant, referring to FIGS. 6 and 6A.

To what degree this move is necessitated all depends on what effect is desired and can be determined with high precision, based on percentage of content (SP and Vp of TP) and the degree to which the system curve 5 strays from its original starting position or meets its target position, FIG. 12A. Also a factor, the degree to which the mover 1 must ramp up or down 7 to accommodate the system 5, or maintain the desired operating point 10 (FIG. 12) keeping in mind any fundamental changes which may be viewed on the Vectorial Display.

This may enable a user to manipulate the OP 10 in horizontal, vertical, or in any direction, the purpose of which may be to create desired effects in the system 5 and mover 11 without compromising one or the other elements, such as BHP, heat transfer, or flow-volume, while still maintaining necessary constants. Also, the fixed OP 10 may in itself be the desired constant in a variable system 24 undergoing many changes.

If conditions at this point in the system 5 are acceptable, such as short length of run and few fitting losses, then ramping up the VFD 7 and increasing the power of the mover 1 may not be necessary to achieve the desired effect. Additionally, the degree to which the mover must exert more power to maintain the desired pressure or flow rate is a direct reflection of how efficiently sized and fitted the connected ductwork is. Though now solved, this problem may have been avoided entirely, however, if the described method and apparatus had been used from origination in designing, selecting, and sizing the mover 1 and system 5.

Following the action of the primary damper 3, the secondary damper 18 may then modulate to its minimum and maximum set parameters within these pre-established conditions as required by the specific task at hand. FIG. 16.

As depicted in FIG. 16A, the parallel damper 19 and additional flow source provide a cumulative velocity to traverse fitting and directional losses, though the primary damper 3 may provide critical run leverage by generating Static Pressure in tandem with motor-drive speed control 7 and, thus, maintaining adequate Total Pressure.

Generally, Parallel Operation 19, as demonstrated in FIG. 16A, is intended for a system 5 with excessive bends and fittings (Vp gradients.) It may also serve a function in Constant Pressure applications, with mover 1, speed control 7, terminal devices 3, and all related system components working in tandem. Series Operation 18, as demonstrated in FIG. 16, may be used in those systems 5 with longer runs and minimal fittings (SP gradients.) This arrangement may also serve a function in Constant Volume applications, with mover, speed control, terminal devices, and all related system components working in tandem.

The method and apparatus will also plot TP/SP/Vp curves with the SP/Vp ratio shown on display, as with any other embodiment of the same. This will include the entire course of all moves or deviations from any prior operating points 10.

Leakage Testing

A main concern in all ductwork construction, aside from being correctly sized and fitted to begin with, is leakage. In the past, leakage characteristics have been difficult to pin down in the practical world, as leakage testing at the outset of all projects is rarely ever performed, unless specified from the outset. The conditions are also demanding and stipulate that all the drop cut out fittings or all outlet/inlet portions of the main duct be capped by section. Even this method is a faulty one, as most leakage occurs at fitting joints, terminals, and other 'takeoff' points that are installed later in the duct construction process.

As a valid solution to current leak testing problems, the described method and apparatus may be utilized to accurately distinguish whether losses and general deviations in a given system 5 are due to leakage, undue flow or undue restriction (improperly fitted or sized ductwork.) The versatile leakage tester embodiment of the method and apparatus may take a variety of forms not limited to those described here. The examples presented here demonstrate leakage testing conducted with the following: 1) a capped duct main section or some unknown vessel or enclosure 5. 2) a new or existing system 5 that has already been fitted. Results may be obtained with or without a known system 5 and OP 10, as shown in FIGS. 17 and 17A.

Additionally, the primary mover 1 and terminal (flow metering) device 3 are recommended to be tested with method and apparatus of same, though this is not necessary for adequate results in regards to existing movers/systems.

In any case, leakage rate and quantity may be determined by variances in the system curve 5 plotted against the primary mover 11 or the terminal device 11 that reflect relative increases in velocity and, conversely, decreases in static pressure; basically put, pressure loss due to leakage and more free flow as a result. Again, the starting point may be a known curve 5 established by the design engineer, or may begin at default settings supplied with the mover 1 and/or terminal device 3 for their recommended scope and range for optimal efficiency.

The default setting criteria will be based on known, pre-determined facts establishing which type of system 5 the selected mover 1 and terminal device 3 are best suited to for optimal efficiency. This will be determined by reliable test results conducted under described method and apparatus testing procedures for lab or field conditions as circumstances permit.

To illustrate the general point of determining leakage, the effect on the three-part curve would be the following: A system deviation would occur from an established design OP 10. The total system 5 moves down and to the right. A percentile increase in the Vp gradient will be notable in particular. This may also be represented by a single vector pointing down and to the right diagonally.

FIG. 17 depicts a capped main section 5 undergoing leakage testing. Terminal device damper shut-off 3 is used to bring the section to its SP rating and maintain this level. It is then able to measure quantitative velocity passing through, per duct surface area, as a direct indication of leakage. Its exact CFM amount and whether it is within acceptable tolerances can then be determined.

Note that the Vp must be converted to FPM units prior to actual CFM of leakage being determined: FPM×Area=CFM. Also, the following duct data is supplied: Duct type, material, seal class, leakage class, pressure class, design static pressure, airflow volume, surface area, airflow surface factor, % predicted leakage versus actual measured. The FPM across the total surface area determines the actual flow (CFM) of leakage.

Sequence of operation: The mover 1 ramps up 7 or the terminal device 3 closes its damper-actuator until static sensor input reaches the entered value of the duct rating and stops. Once SP and Vp solitary curves experience level off, the exact percentage of Vp content is determined and noted in sampled or real time. This figure is then converted to FPM units across an adjusted area, this determined from only that section being isolated for testing. FPM=SQ. RT Vp×4005 for standard air. CFM leakage flow rate is established. For non-standard air, a density adjustment is made: V=1096 SQ. RT. Vp/d.

FIG. 17 shows SP and Vp solitary curve displays 6 plotting level-off plateaus, where each gradient is required to remain constant under testing conditions.

The above embodiment allows for convenient in-line leakage testing at any point in a distribution system 5 under control of same method and apparatus 25, from the primary mover 1 to any designated section 5 where there is a terminal device 3 fitted with damper control throughout a system in entirety, whereas previously, crude orifice plates and cumbersome "clamp-on" leakage testers have been employed with enormous effort and inconvenience, one capped section at a time.

Determining Volume of a Given Vessel or Enclosure

Figure 18:
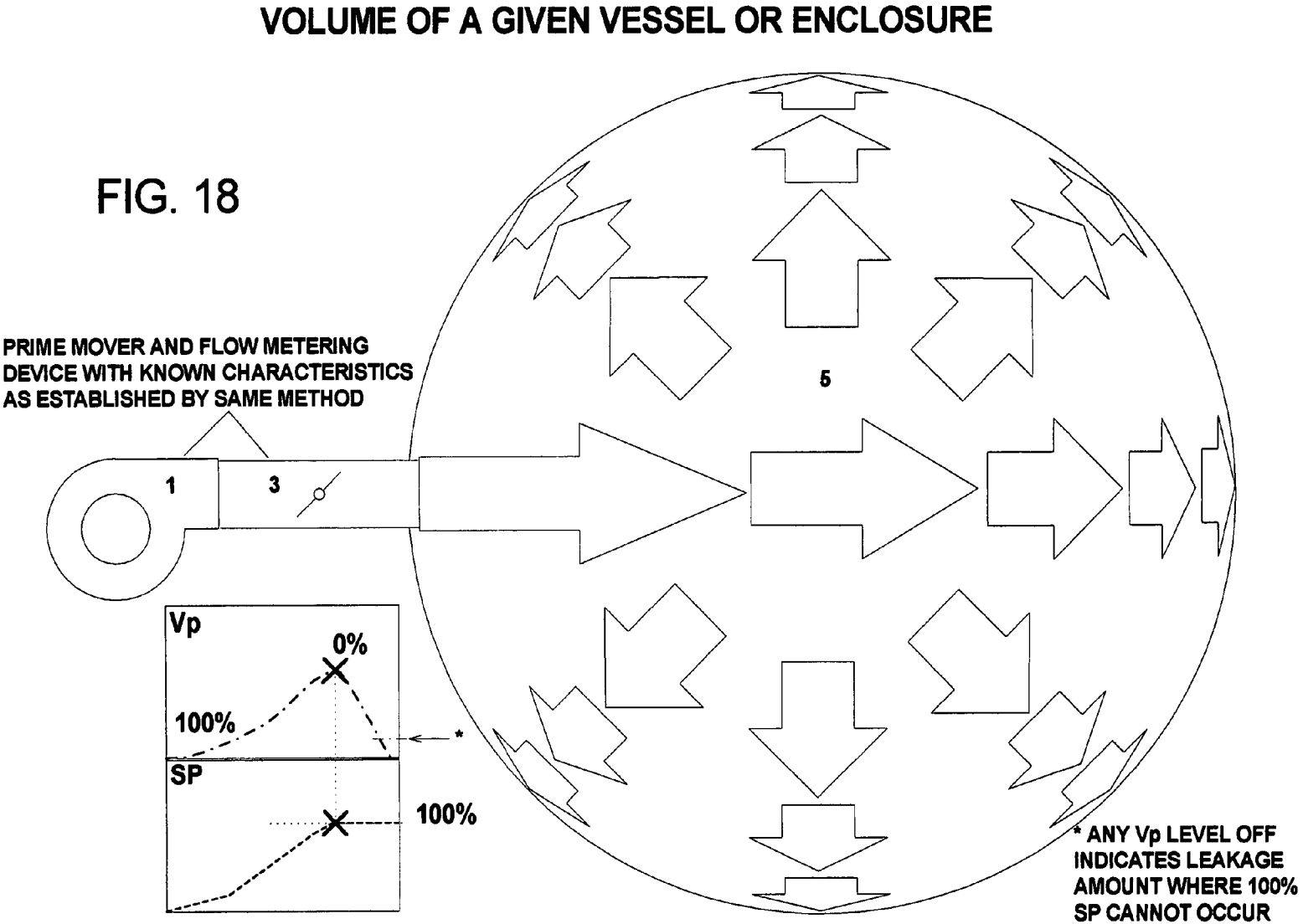
FIG. 18 depicts an additional embodiment used for determining the volume and overall characteristics of a given vessel or enclosure. Curves displayed with cut offs and level offs, along with percentages of Vp and SP content. Vp cut off occurs where SP reaches 100% of mover's total static power, less total static drop of the terminal device, less any Vp deemed leakage at level off.

By metering a free flow rate and considering density of air or specific gravity of a fluid entering a vessel, the said method and apparatus may determine the interior volume of a given vessel or enclosure 5. FIG. 18.

First, the system curve 5 of the vessel/enclosure 5 may be established through precise, instant readings. Assuming a known terminal device 3 or flow-pressure station 2 connected thereto, the free flow rate continues until build up of static resistance causes it to begin to cease. This exact point, wherein flow encounters maximum resistance—or the total static power of the primary mover 1—will be marked as a cutoff point. The exact flow volume rate that passed the metering device will be derived from CFM units, after Vp is converted to FPM. Therefore, an instant reading occurring at this cutoff point of 60 CFM, for example, will mean 60/60=1 cubic foot of interior volume inside of the vessel or enclosure.

Any flow characteristics beyond this pivotal point will be plotted and noted as well. These may be interpreted as static and dynamic factors present after the vessel has been filled to its full interior volume, or more indicatively, when the primary mover 1 has reached its total static power, less the total static drop of the metering device, less any Vp which may exist in the form of leakage leaving the vessel at a steady rate.

Thus, a lesser, tapering off of dynamic flow may be measured and interpreted as a leakage rate after the threshold of full volume has been achieved. Static qualities may be noted as well, before and after the vessel has reached its full volume, depending on whether compressible or non-compressible fluids are being used and what changes of fluid state may be occurring.

The method and apparatus embodiment may also be used for compressible gases, fluids, or mixtures, given temperature/density/SG corrections. Also, the desired level of compression may be set by adjusting these figures after full volume of the vessel is achieved one time over. The gas or fluid may be further compressed beyond this point with temperatures, densities, specific gravities being precisely monitored and set according to known characteristics of the gas/fluid/mixture or level of compression within the vessel.

A uni-directional valve, or shredder-type valve, such as those used in containers of such gases or fluids may be employed to keep the compression level constant and contained. If articulate control of the gas-fluid's passage into the container is desired, a fitting terminal device 3 similar to those previously discussed may be employed. Units of measurement may be switched or converted, e.g., PSI, "Hg, metric equivalents, etc.

The above embodiment may be ideally suited to the same air-fluid distribution system 5 for its refrigerant compression/expansion cycle, affording precise control of the mover (compressor) 1 and thermostatic expansion valve, a terminal device 3 in itself. The compressors are normally rotary-type or positive displacement movers, which are inclined to be less responsive to pressure. This is precisely why adequate pressure control within the vessel containing the gases in changing states can be highly beneficial to the refrigeration cycle, along with properly timed movement or flow-rate. The method and apparatus provides the means to control such a system with quantitative precision and exact timing, which is crucial to the expansion and condensate cycle, as this tends to over or under shoot in current systems with wide dead bands, not allowing full heat exchange potential to be realized between the evaporative and condensate phases. Employing the method and apparatus in such a manner avoids loss of and boosts optimal heat exchange effectiveness within this system itself, which may simply be viewed as an additional distribution system with terminal (valvic) control and a mover of one form or another.

The above function of the method and apparatus may apply to any cooling or heating system condensate, expansion, absorption, or other cycle, with or without a change of state, involving air-fluid mechanics including gases, mixtures, and thermal dynamics as described in any form, number, or combination.

Flow-Head (or Flow-Pressure) Stability

Due to a condition known as flow-head instability, a piping distribution system 5 may tend to cause automatic or sensor-motor controls to hunt in an adverse cycle, short-circuiting the distribution system and causing incorrect sensor feedback. As a result, automatic controls operate in a small part of their range. This condition occurs mainly in hydronics distribution systems in which three-way valve control is used on primary or secondary circuits. These circuits often have improperly sized differential valve capacities or flow coefficients assigned to them (Cv's or K factors in air and like systems) across an appropriate range of movement between full flow to full bypass of a main or terminal circuit. In open hydronics systems, elevation and the location of these bypass lines also impacts this effect.

Among other things, system flow-head variation can cause chiller short cycling, diminished heat exchange effectiveness at primary and/or terminal heat exchange devices, such as cooling or heating coils. It may also create other load imbalance problems, such as load shifting or load sharing.

Use of the described method and apparatus increases and improves the characteristics of this critical range of valve movement between full flow to full bypass.

Range of Mover-System Loading and Unloading

During normal operation, loading and unloading of terminal units 3 with increases and decreases in system demand alter the OP (Operating Point) 10 of the system 5. Terminal devices may include but not be limited to: valves, heat exchange terminals 8, and any solid-state components, which affect airside, waterside, heat-flow, etc.

Appropriate boundaries may be established for pumping or moving equipment that represent parameters of possible loads. FIG. 35. These parameters 23 are set by the diverse loading and unloading of terminal units/devices 3 within the system 5 and are largely tied to the system diversity 22. This designated region, as best established by said method and apparatus, outlines the scope of pumping or moving energy that can be conserved when the mover speed is variable 7. This area is greatly increased in scope and breadth by the method and apparatus, namely but not solely due to improved flow-head stability and its ability to increase the margin, size and scope of diversity 22. Specifically, the area of mover and terminal device operation 24 is "flattened" and "widened," an area where modulating valves 3 or terminal devices 3 operate best. The other key benefits: BHP demand and total power required is lessened, system resistance is lessened, static efficiency is increased. Note FIG. 35, cross-hatched areas. Additionally, this support is furthered by its individual breakdown of TP where and when needed, and as specifically demanded by terminal or in-line components (valves, etc.) with all of their pre-determined characteristics therewith. In what number and to what degree the valve demand is required is also tempered by the method and apparatus. The latter effects may also be established with the method and apparatus as previously stated or otherwise.

Also referring to FIG. 35, independent system curves or independent heads are plotted to illustrate and define system constants against any system variation as produced by loading/unloading within the variable system 24, thermal or mechanical. As a result, the pressure (head) or flow capacity may be arbitrarily adjusted to either increase system pressure or increase system flow and place the operating point 10 where best suited or desired. Note that the relationship need not be inversely related, wherein one decreases as the other increases, as these may also be viewed and controlled as independent relationships and manipulated for useful purposes by way of the method and apparatus. Thus, the use of the method and apparatus allows one to alter the system characteristics 5 independently, and/or alter the mover characteristics 11 independently and, ultimately, reconfigure the operating point 10 or juxtapose the new operating point 10 with a previous one. Altering mover characteristics 11, for example, may be accomplished by specific changes to RPM, drive changes or, in the case of pumps, changed impeller diameters as varied in direct proportion to flow. Additionally, any relationship relating to flow-pressure, BHP, and affinity laws present enough information to either extrapolate or, preferably, interpolate performance projections. The described method and apparatus provides the best means for an accurate interpolation of performance data or any relevant data and for providing equipment recommendations. Altering system characteristics 5, for example, may be accomplished by fitting changes to the distribution system entailing all tabulated and database references as previously noted.

In hydronics systems, the minimum differential head constant shown in FIG. 35 is presented as a constant derived from the distribution system's critical run 5 and terminal device 3 at full demand or full capacity. The total vertical difference of the system curve extremes represents the total system losses (main circuits and all terminals) from minimum to maximum demand operation. The center vertical line represents the pressure/head constant delineated by a vertical move top to bottom only. The solid system line crossing the center in FIG. 35 represents where a constant volume system (non-variable or symmetrically loaded) would operate, if it were thought of as such a system. You might say that it is tempered precisely between the two outer parameters shows Dotted steep and flat curve lines delineated the parameters of total system operation.

The crosshatched areas shown in FIG. 35 represent the possibilities and constraints of variable system operation 24 with a variable mover 7 attached. Mover efficiency and affinity relationships may also be considered and the operating point 10 deliberately placed in effective areas by the method and apparatus. The parameters set by the HI and LO curve areas 23 may provide an exact window of mover rpm control 111 or terminal valve modulation control 11, whether interpolated from an existing system or specifically designed using the method and apparatus from origination. Vectors may better illustrate this and other critical areas to avoid a crowded image. Their immediate length and direction demarcate exact system operation and boundaries. They also identify the operative element at hand as previously noted. Once these designated boundaries are firmly defined and an OP placed, the method and apparatus may refer to its database to determine exactly appropriated equipment, or closest stock equivalents currently available, i.e., movers and fittings for the fully designed system.

In most hydronics systems with standard water, velocity may be negated for practical purposes, and so TP=SP. In an air system, the parameters shown in FIG. 35 are outlined through the TP, Vp, and SP breakdown. Similarly, the operating parameters for an air system can be determined by the critical run and terminal device, noting that in this case the parameters are not determined only by a differential static or differential head pressure. A hydronics system has return piping friction losses plus the terminal device (valve) total drop that are accounted for in a closed loop system. Water must return in a closed piping system, where air is delivered to an open space and converted to 100% velocity at some point. Despite this interruption between a variable supply air distribution terminal and its ducted or non-ducted return air plenum, the starting datum parameter for an air system is similarly set by the critical run and its maximum demand, considering total, static, and velocity pressures. Conversely, its minimum demand position sets the low demand parameter and a variable mover 7 ramps down to track with the variable system 24 with open or closed loop control. This action, however, changes the system curve 5 considerably and is the main reason current VAV systems have trouble operating in lower demand situations, further compounded by the ramp down and Total Pressure loss of the mover 1 based on current sensor use and placement, which clearly does not work. The complete landscape of the distribution system changes. Its total dynamics change, even the critical run or runs may change from the maximum demand position. The prescribed mover's reaction to the "new" system changes as well. The method and apparatus addresses these problems by identifying and evaluating these critical runs with or without system diversity, mapping, changing runs, etc., among other means described.

In basic terms, Total Pressure conversion occurs with motorized damper, terminal device 3 repositioning, change of flow cross-sectional areas, k-factors, etc. The other counter-productive variable in current systems is the mover variable 7. The variable speed mover or older vortex system tracks down as dictated by incorrect static sensing and, consequently, lowers Total fan pressure 20 indiscriminately, particularly on the suction side—its first casualty, as noted previously. Current static pressure sensing methods and their described limitations cannot cope with these changes. The method and apparatus addresses this problem as described.

Key Contrasts of the Differential Pressure/Head Constant

In the case of an air system, the differential pressure constant shown in FIG. 35 may be replaced by a Total External Pressure 21, unlike a differential head in a hydronics system. Specifically, this accounts for all supply air and return air ducting external to the prime mover 1 and losses needed to be overcome by total mover gains—in maximum total system demand 23. This denotation is chosen in light of current packaged systems, which include blowers, coils, filter sections, modules, in-line devices, etc., as noted previously. Again, note the TEP 21 as delineated in FIG. 3, and as distinguished from prior understanding with the added breakdown of TP into SP and Vp. Referring again to System Effect losses, particularly on the suction side of packaged movers or packaged "units" as currently understood, there is a special consideration for the suction pressure as viewed independently, due to outdoor air and return air rates, which must be maintained within tolerances in a variable air volume (and pressure) system commonly prone to suction pressure losses as mentioned previously. Such deficiencies, in turn, contribute to variable air systems' failure to achieve adequate outdoor air rates and, moreover, return air rates, which recover cooling load. Thus, the Unit Total External Pressure 21 as here described is the differential pressure constant (vertical) viewed in the crosshatched operating zone in FIG. 35. Additionally, the method and apparatus can re-plot these parameters for minimum operation due to reasons previously described, including maintaining outdoor air rates. Above all, the parameters and complete characteristics of mover-system operation will always be appropriately tracked throughout all degrees of system or terminal device ranging at all times and conditions of such operation, as previously described. Namely, the key consideration will be Vp in an air system and, above all, the conversion of TP into VP and SP elements, which is not a problem when referring to a standard hydronics system, where TP=SP. Thus, the operating zone 24 shown in FIG. 35 is delineated separately and at separate mover and valve constants 11 for both minimum and maximum operation of air terminal devices 3, unlike in a standard hydronics system, where this may or may not be deemed necessary.

In contrast, the parameters shown in FIG. 35 indicate total pressure loss and gain required for a hydronics distribution system's supply and return mains. In an open hydronics system, return head is either negated by elevation or provided for by additional pumping power if suction lift is required (usually avoided.) One key difference between a hydronics system and an air system when viewing FIG. 35 is that flow increases as head lowers in a hydronics system, where flow decreases as pressure lowers in an air system, at least where performance curves and projected affinity relationships are concerned. These are the common extrapolations as currently understood when viewing performance curves supplied by a manufacturer. The method and apparatus addresses this problem as previously described. In any case, the purely functional image in FIG. 35 simply "flip-flops" where both air or hydronics systems and their min/max or "total" parameters are concerned. Separate, detailed images for a pump or a blower curve would be provided on a detailed display 6, since BHP, RPM, and efficiency markings are quite different for the two. Again, the key exception to the above problem is already pre-determined by the method and apparatus as previously described. And that is that these characteristics may be misleading in a system 5 where, for example, static increases occur due to undue restriction, rather than increases in flow by previously thought performance prediction. This is sometimes referred to as an "artificial" change in the system 5, such as when a discharge balancing damper 3 is throttled to increase pump head for desired results.

Steep curved pumps or movers 1 do not respond well to valve differential head. One goal is to minimize the valve pressure ratio increase between the mover 1 and the valve or terminal device 3, or maintain the Unit Total External Pressure 21 in air systems. Through maintaining optimal flow-head stability and previously described use of the method and apparatus, the method and apparatus minimizes the valve pressure ratio increase between the mover 1 and valves or terminal/in-line devices 3 within a distribution system 5. The method and apparatus makes possible a wider range of load 24 and, thus, a flatter operating curve for terminal equipment. This can also permit the use of steeper curved movers 1 to maximize their limited range 24 within distribution systems 5, or vice versa; steeper curved systems 5 may be paired with flatter movers 1. It then follows from the above and previous description that the method and apparatus allows automatic control valves 3 and all variables within the distribution system or sub-system to operate in a greater, more effective range 24.

Variable Air Volume Systems

Figure 23:
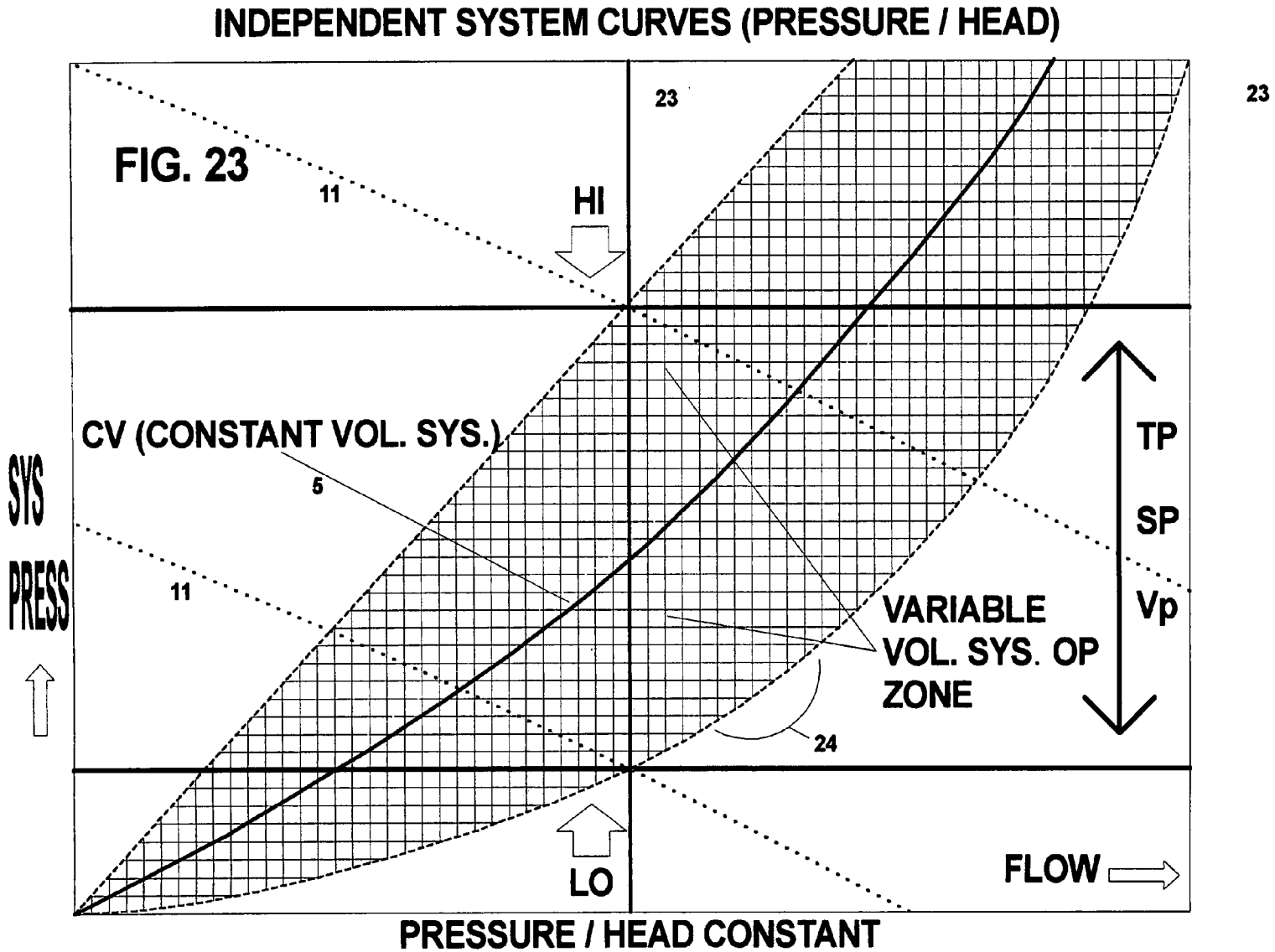
FIG. 23 illustrates the final marginal boundaries for constant and variable system performance with a final pressure/head constant, low to high.

Because of the complexities of a VAV system with two or more terminal branches and a plurality of terminal VAV devices in constant modulation, it becomes necessary to address the performance of the primary mover, as well as the system whole and all aspects of the dynamics involved. The system curve independent pressure constant and parameters, as depicted in FIG. 23 illustrate the distinct window for VAV or variable hydronics system operation. During VAV operation (24), terminal branch dynamics change the total and terminal system (5). In doing so, the "critical run" or "critical path" must be established and also tracked by the control system, as the route of this path may also change and be assigned from one terminal device to another under differing conditions of operation. The described method addresses this problem, firstly by establishing the main critical run terminal from terminal device sensor input (4) and sorting each run (5) and device (3) in the system from least to most critical in total sensor value, with the least critical being assigned to the margin for diversity (22), these placed in either their minimum or closed positions. FIG. 20.

The constant established in FIG. 23 outlines all the necessary boundaries for the variable volume system and where to best place the operating point for the given mover and valve constants (11) at any speed or position. The method proceeds as follows: The main critical run is established with all dampers indexed to their maximum positions (HI) at their maximum mover driven RPM (11) required to achieve the prescribed flow rate with the given system profile as set here. 2) A critical run is established in minimum position (LO) for the minimum or lowest demand operating parameter. This repositioning is primarily due to the velocity factor, wherein flow coefficients (dynamic) factors change significantly with valve throttling, particularly in a velocity-based system. All ranges between parameters are also tracked when runs are sorted from least to most critical within the established boundaries (24).

Series Operation

Using embodiments described in series and parallel damper functions (18, 19), the control method utilizes automated controls to effect whatever main or terminal damper changes are necessary to maintain the operating point (10) where designated as terminal devices (3) and the system whole (5) modulate. For example, if a sub-system change such as would be caused by an opening valve on a terminal branch alters the total system curve (5) and rides the mover curve (11) to cause more sensed flow (Vp)—down and to the right—the main damper control, FIG. 16 (3) can respond by throttling down to create an artificial static pressure increase to meet and maintain the deviated operating point (10). An increase in flow signifies a decrease in pressure by conversion. For creating leverage in reaching critical runs or increasing the static pressure in a system, main damper control may be manipulated to produce static increase, as described in series damper operation. FIG. 16.

Though Total Pressure may be lost on the whole as well, the method and apparatus keeps this at a minimum through its key functions. Again, Total loss occurs in direction of flow or through System Effect losses never recovered at any point in the system (5). Subsequently, as Total Pressure is lost or gained, a function of the method causes the variable mover (1) to increase or decrease rotational speed (7) to adjust this measure in exact proportion to what was lost or gained, in this example using its Total Pressure sensors (13). Alternatively, the other sensors: SP, Vp (14, 15) may be used as well to adjust x or y values independently. The affinity relationship dictating that rpm is squared to all deducted pressures and cubed to BHP governs this calculating function. The specified content percentages (% SP % Vp of TP) will determine these net pressure losses and in what measure to effect motorized controls.

The final goal or step of this function is to return the Total System curve (5) to its original point of operation (10) along the mover or valve constant (11) and, ultimately, maintain optimal flow-pressure stability in the system whole (5). Increased diversity potential (22) in the system by way of the method and apparatus also provides a wider, more effective range for damper-valve (3) modulation and, thus, greater added stability. The above functions may be alternately achieved by series blower operation FIG. 14C or any additional flow source in series.

Parallel Operation

Similarly, if a static increase (SP) occurs and, thus, a dynamic decrease, then parallel operation (17, 19) can take effect as described in embodiments, whether through auxiliary fan power—a secondary mover in parallel (17), a relief opening, a bypass, or a secondary source of flow in parallel. FIG. 16A The above description also applies to terminal devices (3) in series or parallel operation (18, 19) with secondary mover power, FIGS. 15C and 15D, to create gains where losses of one form or another occur or, alternately, create dampering losses where gains of one form or another occur. FIG. 16, 16A Among other influential factors, the above functions with "best mode of operation" being variable system function contribute to optimal flow-pressure or flow-head stability. This process can maintain total and/or terminal system flow-pressure stability and may track with any and all system or sub-system changes (5). More specifically, all mover and system components can track to fully articulate system requirements with or without auxiliary flow-pressure variables, e.g., from secondary, tertiary movers, other sources, etc. One key purpose serves the function of full and relief valves or unidirectional valves, where flow and/or pressure are compensated or dispensated to maintain flow-pressure stability.

Using the above relationships through embodiments as described, affinity performance "projections" need not be followed as the method and apparatus follows its own sensor logic based in a real, "as-built" system as really sensed. Above all, all mover-system relationships are viewed and controlled in the context of correctly coordinated performance curves, as is the only valid means to proceed with accurate performance prediction.

Support of the method is strengthened by the fact that it is a deductive and not an inductive process based on Total, Velocity, and Static Pressures (13, 15, 14) being established independently through most to least accurate sensing. Static being the acknowledged least accurate field sensing method, it will always be accurately deducted from Total Power or Total Wattage and Velocity factors, closed loop or closed circuit differentials with an absolute value. As previously noted, however, Total and Static values may have atmospheric references or must be corrected for this and other internal losses as accounted for by said method through BHP evaluation.

In any case, there will be at least three or more verification points, which will include the Total Power (voltage and amperage) deduction of BHP, considered as another of the most accurate data points in field measurement, along with RPM and a multi-point velocity reading to establish CFM flow rate, as with a pitot tube. The total wattage of the motor powered mover and the corrected BHP as derived from current readings is also represented by the "Mover Total Pressure," a key component of the apparatus, where voltage and amperage parallel static pressure and velocity pressure, respectively.

Additionally, this process can be described as a deductive method of Total Pressure and Total Power, namely where corrected BHP is concerned. Unknowns are determined based on interpolation between two or more firmly established knowns and step functions either compensate or dispensate pressure gradients as needed or demanded by a distribution system.

The data points as described in "Initial Point of System Operation" also further support a starting point of system operation and continued tracked operation. Any unknowns that remain are further crosschecked by current power factors and negated or supported by those knowns most firmly established. Under lab testing conditions in a controlled environment, these performance characteristics will also be further supported by the described method and apparatus and carried into the field with greater certainty.

Through variable mover-system operation, the "best mode of operation," and critical path mapping, it follows that diversity potential in the distribution system is increased by way of the method and apparatus, thus providing a wider, more effective range for damper-valve modulation and greater stability for the system whole.

The many functions and embodiments of the method and apparatus shall not be limited to those described here in any form, number, or combination, nor to any industry, field, art, or science that may employ such means to further its advancement through utilization of the method and apparatus. Such parallels to other arts, which the described method and apparatus stands to advance, may include: electronics or electric current flow, where electromotive forces (voltage and amperage) are concerned, semiconductor operation, signal modulation (frequency and amplitude) transmission and reception, telecommunications, information transfer, storage and retrieval—computerized or otherwise. Use of the method and apparatus stands to improve overall engine operation, transmission, power, and performance, including BHP to torque relationships; any variety of gas, fluid, or mixtures and their movement, distribution, or containment, including hydraulic machines or those otherwise pressurized below or above atmosphere. Use of the method and apparatus may advance the economic principle of supply and demand and currency flow. Biologically or mechanically, the use of the method and apparatus may advance cardiological functions such as cardio (aerobic) and anaerobic (force and resistance) heart and muscle operation, where circulatory or other such biological or mechanical vascular systems are concerned. The method and apparatus may pertain to pulsation, modulation, or pulse-width modulation in place of rotation for movers that do not rotate or other solid-state machines not utilizing moving parts. Finally, the principle operation of the method and apparatus may be reduced to the prime concepts of kinetic energy and potential energy.

I claim:

1. An apparatus for flow-pressure control and monitoring of constant or variable volume air-fluid distribution systems, terminal devices, and prime movers comprising a primary mover (1) with variable speed control or means of modulation (7), including metering of voltage and amperage; means of Power Factor metering; means of KW metering; means of power triangle metering (P, S, Q), including phase angle display of signal modulation;

a means of measuring mover driven speed of rotation (RPM);

a means of measuring mover driver speed of rotation (RPM);

a means of measuring torque;

connecting ductwork or distribution system (5);

a cross-sectional housing with independent total, static, and velocity multi-point pressure sensors (2, 13, 14, 15) or simplified sensing probes consisting of total impact and static probes, where Vp may be derived from the deduction TP, Total Pressure−SP, Static Pressure=Vp, Velocity Pressure and wherein a Mover Total Pressure (20) may be applied by sensing means, including a total impact single or multi-point sensor (13) at its inlet or intake;

a terminal control device (3), as with a damper or valve housing effectively fitted with total impact, static, and velocity sensors (4, 13, 14, 15) and fitted with motor control actuation; stepper motor control allowning damper angle setting to effective radian angles against valve constants and coefficients according to damper position from fully closed to wide open flow;

a heat exchanger housing (8), its air side fitted with dry and wet bulb air temperature sensors and fluid side fitted with fluid temperature sensors in and out of the heat exchanger along with a one, two, or three-way fluid control valve (3) on its return side piping;

open ports for external inputs, zone sensors/thermostats, or other controlled sources as may be set arbitrarily;

a signal processor (9) with an input from all temperature and pressure sensors (2, 4, 13, 14, 15) and input/output to motor control (7) and damper actuation (3);

an output to a panel display monitor (6) with a Cartesian graph indicating performance curve coordinates of the mover (11), the distribution system (5), the terminal device (3), scalar and vector data; also including BHP data as factored from current and voltage readings, Power Factor data, derived data from direct Power Factor measuring means, direct KW measuring means, or from other means to determine output power; heat flow data from any heat exchange terminal (8).

2. A method for controlling and monitoring a mover-distribution system relationship utilizing the apparatus of claim 1 by systematically altering the said primary mover's slope with the said speed controller or means of modulation to change speed of mover driven rotation to modify the mover constant against the system constant as established by x/y value slope adjustment;

establishing a series or parallel slope where there are secondary movers to modify the mover constant against the system constant as by x/y value slope adjustment;

establishing a series or parallel slope where there are secondary system circuits to modify the system constant against the mover constant as by x/y value slope adjustment;

determining the primary mover's BHP or Mover Power with calculating steps through single or three phase current reading and Power Factor data as metered from the motor powering the mover;

correcting the mover's slope y value according to BHP or Mover Power changes;

correcting the said mover and said distribution system x/y slope values according to changes to one or the other, where one or the other is held constant when the other changes;

providing a constant reference of the said mover constant against said connecting distribution system as fitted according to system effective duct diameters per velocity and static pressures and converging or diverging angle geometry beffitting the mover to complement its total power throughput throughout said distribution system;

establishing, adjusting, and tuning total system constants throughout their full range of closure or percent of wide open flow;

establishing, adjusting, and tuning terminal valve constants throughout their full range of closure or percent of wide open flow;

deducting mover-system performance characteristics with said data as obtained from said flow sensing stations situated at the main discharge and the terminal discharge of the distribution system allowing a means for deducting mover total pressure as fully distributed and articulated throughout a distribution system;

solving mover-system unknowns through interpolative data utilizing said method of x/y coordination of mover-system relationships; or utilizing extrapolative data with calculating steps of applicable affinity laws where data is missing or unavailable;

marking in memory previous mover-system unknowns as firmly established through said method and storing them in the said database reference provided;

monitoring and adjusting a point of system operation through interpolated data utilizing the said panel display of claim 1;

monitoring and adjusting a point of sub-system operation through interpolated data utilizing the said panel display of claim 1;

monitoring, adjusting, and tuning the leading and lagging effects of capacitance and induction in high and low voltage electrical power distribution throughout a given system utilizing the power triangulation feature and said panel display of claim 1;

monitoring, adjusting, and tuning electrical characteristics of the prime mover power output modulation against terminal device or valve angle positioning according to PHI, phase angle and signal modulation for individual terminal device 90 degree quadrants and clocking the whole system 360 degrees for a plurality of devices under modulation utilizing the power triangulation feature and said panel display of claim 1.

3. The apparatus of claim 1 wherein the signal processor (9) contains an expandable database reference of known mover performance characteristics as established with the method of claim 2;

of known mover characteristics as established through curve plotting by way of the method of claim 2;

of known mover characteristics as established by other accepted means; and of known mover types, sizes, and capacities.

4. The apparatus of claim 1 wherein the signal processor (9) contains an expandable database reference of known terminal device performance characteristics as established with the method of claim 2;

of known terminal device characteristics as established through curve plotting by way of the method of claim 2;

of known terminal device characteristics as established by other accepted means; and of known terminal device types, sizes, and ranges.

5. A method for controlling and monitoring heat exchange effectiveness against mass flow rate utilizing the apparatus of claim 1 by monitoring heat exchange and mass flow rate with said main air monitor station, said temperature sensors, and said fluid control valve situated on the return loop of the fluid side piping;

adjusting control set points to appropriate constants for volumetric flow at specified temperatures from the said open port as set arbitrarily or as input received from said zone sensors.

6. A method for determining heat transfer in heat exchangers in accordance with claim 5, steps comprising metering the primary mover (1) and system (5) total air volume (2) at given pressures;

metering same airflow dry and wet bulb temperatures in and out of beat exchanger;

metering heat exchanger (8) total fluid volume for standard water (GPM) or other corrected fluid volume with terminal device (3) at return piping of heat exchanger (8);

correcting for densities, specific heat, and specific gravity;

calculating the total heat exchanged from the fluid side of the heat exchanger;

calculating the final total, latent and sensible heat exchanged from the air side of heat exchanger;

and displaying the data on the user interface for observation (6).

7. A method in accordance with claim 6 for determining heat transfer and heat exchange effectiveness in energy recovery units, steps comprising metering the supply air-fluid volume (2) at given pressures;

metering same supply with airflow dry and wet bulb temperatures;

metering the exhaust or return air-fluid volume (2) at given pressures;

metering same exhaust or return with airflow dry and wet bulb temperatures;

correcting for densities, specific heat, and specific gravity;

calculating the total mass flow rate of both air-fluid streams across heat exchange medium;

calculating the final total, latent, and sensible heat exchanged;

calculating percentage of heat exchange effectiveness expressed as a ratio;

and displaying test data results on the user interface (6).

* * * * *